US006737209B2

(12) United States Patent
Shigeta et al.

(10) Patent No.: US 6,737,209 B2
(45) Date of Patent: May 18, 2004

(54) COLOR IMAGE FORMING METHOD USING FLATTENED TONER

(75) Inventors: Kunio Shigeta, Hachioji (JP); Yotaro Sato, Hachioji (JP); Satoshi Haneda, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/172,690

(22) Filed: Jun. 14, 2002

(65) Prior Publication Data

US 2003/0152852 A1 Aug. 14, 2003

(30) Foreign Application Priority Data

Jun. 22, 2001 (JP) ..... 2001-189638
Jul. 4, 2001 (JP) ..... 2001-203310

(51) Int. Cl.[7] ..... G03G 13/01
(52) U.S. Cl. ..... 430/45; 430/47; 430/107.1; 430/110.3
(58) Field of Search ..... 430/45, 47, 107.1, 430/110.3

(56) References Cited

U.S. PATENT DOCUMENTS

2002/0106574 A1 * 8/2002 Haneda et al. ..... 430/110.3

FOREIGN PATENT DOCUMENTS

JP 11-167226 * 6/1999

OTHER PUBLICATIONS

Japanese Patent Office Machine–Assisted English Translation of JP 11–167,226 (pub Jun. 1999).*

* cited by examiner

*Primary Examiner*—Janis L. Dote
(74) *Attorney, Agent, or Firm*—Squire, Sanders & Dempsey

(57) ABSTRACT

A color image forming method in which a color toner image is formed through superposing toner images of three color toners of yellow, magenta, and cyan and a black toner, wherein each of the color toners is a flattened toner composed of particles each having an equivalent circle diameter d of 5 to 10 ($\mu$m) when viewed from a direction to make a projection area maximum, a thickness t of 1 to 4 ($\mu$m), and a flattening ratio d/t of 2 to 8 represented by a ratio of the equivalent circle diameter d to the thickness t, and the flattening ratio d/t of the particles of the color toners is larger than the flattening ratio $d_k/t_K$ of the particles of the black toner.

21 Claims, 7 Drawing Sheets

$d > d_k$ $d > d_k$, $t < t_k$

COLOR IMAGE FORMING METHOD USING FLATTENED TONER

BACKGROUND OF THE INVENTION

This invention relates to an image forming method for use in a copying machine, a printer, a FAX machine, etc., and in particular, to a color image forming method using a flattened toner for the toner of the developer to make the image better.

Recently, with the advent of information age, the demand for office machines such as a copying machine, a printer, and a facsimile machine had been rapidly increased, and the improvement of the characteristics of said copying machine etc. to make them, for instance, have a higher speed, have a higher image quality, and bring about no environmental pollution is now required. Further, accompanied by the wide spreading of the copying machine etc. capable of making color copies, the above-mentioned improvement of characteristics to make them have a higher speed, have a higher image quality, and cause no environmental pollution has become a more important problem.

The above-mentioned problem to make the copying machines etc. have a characteristic of no environmental pollution is an important subject relating to the environmental sanitation of the operators, and in particular, in the case of copying machines etc., the high-voltage corona charging device, which generates active gases such as harmful ozone and nitrogen oxide, is a problem; for the alternative technology, a pressure transfer method aiming at a low-voltage and ozone-less process was proposed and has been put into practice. However, it has now been proved that the above-mentioned pressure transfer method is difficult to control the pressing force, and is easy to produce an uneven transfer or a poor transfer. Further, in forming a color image, it has now been proved that toner particles of a plurality of colors stacked in layers are leveled down at the time of transfer to a transfer material, to produce scattering and smudging, which makes it impossible to obtain a clear and sharp image.

On the other hand, for making a copying machine etc. have a higher image quality, it is necessary to improve the property of the toner, and in particular, it has now been proved that it is important to use a toner having a small particle diameter of 5 to 10 $\mu$m and a sharp particle diameter distribution. Although such a toner can be obtained by classifying a coarsely made toner produced also by a conventional pulverization granulating method into the above-mentioned range of particle diameter, there has been a problem that the amount of toner removed by the classification process was considerably much, which made the yield lower, and productivity worse. Hence, in recent years, it has been developed a polymerization-granulated toner which is obtained by polymerization based on a suspension polymerization method, an emulsion polymerization method, or the like, and it is being put into practice. The above-mentioned polymerization-granulated toner has a comparatively small particle diameter and a harp particle diameter distribution; by using said polymerization-granulated toner, to make the image quality higher is accomplished, but here has been a problem that, because the polymerization-granulated toner was spherical, the cleaning performance was bad in the image forming process to cause toner filming to tend to occur, and the color toner particles stacked in layers at the time of color image formation became bulky, to be leveled down at the time of pressure transfer to tend to produce scattering and smudging, which made a clear and sharp color image difficult to obtain.

Further, as regards the above-mentioned subject to make a copying machine etc. have a higher speed, the improvement of fixing efficiency of a toner image on a transfer material is an important subject, and the improvement of fixing performance of the toner has been required.

Hence, for a method of improving the above-mentioned characteristics of a copying machine etc., it has been proposed a method to practice image formation using a flattened toner. For example, in the publication of the unexamined patent application H5-127420, it is proposed a technology of a flattened toner which is obtained by making spherical toner particles dispersed in a dispersion medium collide with a rotating disk at a high speed. Further, in the publication of the unexamined patent application H11-167226, it is proposed a technology of a flattened toner for use in color copying which has a diameter of 5 to 10 $\mu$m, a thickness of 0.5 to 3 $\mu$m, and a thickness-to-diameter ratio falling within a range of 0.1 to 0.4 and is obtained by making spherical toner particles collide with a rotating disk at a high speed. According to the above-mentioned publications, by using a flattened toner, thermal efficiency becomes larger because heat at the time of heat fixing is received by the flattened surface of the toner particles, which makes possible shortening of fixing time, and it is accomplished to make a copying machine etc. have a higher speed. Further, in the case where the above-mentioned flattened toner is used in color image formation, the color toner particles never become bulky, and a smooth image of a high quality like a silver halide photograph can be easily obtained. Moreover, to make a toner flattened is effective not only for making the toner have a small particle diameter but also for the reduction of toner consumption.

However, upon forming a color image, if yellow (Y), magenta (M), cyan (C), and black (K) toners are flattened in the same manner, a high-quality color image which is satisfactory for a user in respect to both of the picture image area and the letter image area cannot be obtained.

SUMMARY OF THE INVENTION

This invention has been proposed in view of the above-mentioned actual situation, and it is an object of the invention to provide an image forming method which does not produce poor cleaning and a hollow image defect (an image defect caused by it that toner particles are not or less deposited at the inner area of an image), not produce scattering and smudging, is capable of obtaining a clear and sharp color image which keeps a good gradation characteristic in a picture image area and has an excellent resolution and sharpness in a letter image area, causes little environmental pollution, is excellent in fixing performance, and is capable of image formation at a high speed.

As the result of diligent investigations of the inventors, this invention has been completed on the basis of the judgement that the reason for the incapability of answering the requirement of a user for image quality is that the toners of Y, M, C, and K have been flattened in the same manner regardless of the fact that the color toners of Y, M, and C have a different role from the black (K) toner in forming a color image.

Hence, the object of this invention can be accomplished by the following structure.

A color image forming method in which a color toner image is formed through superposing the layers of three color toners of yellow, megenta, and cyan and a black toner, wherein each of said color toners is a flattened toner composed of particles having an equivalent circle diameter d of 5 to 10 (μm) as viewed from the direction to make the projection area maximum, a thickness t of 1 to 4 (μm), and a flattening ratio d/t of 2 to 8 represented by the ratio of said equivalent circle diameter d to said thickness t, and the flattening ratio d/t of the particles of said color toners is large than the flattening ratio/$t_K$ of the particles of said black toner.

Owing to the relation $d_K/t_K<d/t$ between the flattening ratio of the K toner $d_K/t_K$ and the flattening ratio of the color toners d/t superposed, a high-quality color image which is excellent in gradation characteristic and granularity in color picture area and excellent in sharpness in black letter area can be obtained.

Further, the object of this invention can be also accomplished by any one of the following preferable structures (1) to (12).

(1) A color image forming method in which a color toner image is formed on an image forming member through superposing the layers of three color toners of yellow, magenta, and cyan and a black toner, and then said layers of toners composing said color toner image are transferred all at a time onto a transfer material, wherein each of said color toners is a flattened toner composed of particles having an equivalent circle diameter d of 5 to 10 (μm) and viewed from the direction to make the projection area maximum, a thickness t of 1 to 4 (μm), and a flattening ratio d/t of 2 to 8 represented by the ratio of said equivalent circle diameter d to said thickness t, and the thickness t of the particles of said color toners is smaller than the thickness $t_K$ of the particles of said black toner.

(2) A color image forming method in which toner images respectively composed of color toners of yellow, magenta, and cyan and a black toner are formed on a plurality of image forming members respectively, and the toner images on said plurality of image forming members are successively transferred onto a transfer material to form a color toner image, wherein each of said color toners is a flattened toner composed of particles having an equivalent circle diameter d of 5 to 10 (μm) as viewed from the direction to make the projection area maximum, a thickness t of 1 to 4 (μm), and a flattening ratio d/t of 2 to 8 represented by the ratio of said equivalent circle diameter d to said thickness t, and the thickness t of the particles of said color toners is smaller than the thickness $t_K$ of the particles of said black toner.

(3) A color image forming method in which toner images respectively composed of color toners of yellow, magenta, and cyan and a black toner are formed on a plurality of image forming members respectively, and the toner images on said plurality of image forming members are successively transferred onto an intermediate transfer member to form a color toner image, and then said toner images composing said color toner image are transferred all at a time onto a transfer material, wherein each of said color toners is a flattened toner composed of particles having an equivalent circle diameter d of 5 to 10 (μm), and a flattening ration d/t of 2 to 8 represented by the ratio of said equivalent circle diameter d to said thickness t, and the thickness t of the particles of said color toner is smaller than the thickness $t_K$ of the particles of said black toner.

(4) A color image forming method in which a color toner image is formed on an image forming member through superposing the layers of three color toners of yellow, magenta, and cyan and a black toner, and then said layers of toners composing said color toner image are transferred all at a time onto a transfer material, wherein each of said color toners is a flattened toner composed of particles having an equivalent circle diameter d of 5 to 10 (μm) as viewed from the direction to make the projection area maximum, a thickness t of 1 to 4 (μm), and a flattening ration d/t of 2 to 8 represented by the ratio of said equivalent circular diameter d to said thickness t, and the flattening ratio d/t of the particles of said color toners is larger than the flattening ration d/$t_K$ of the particles of said black toner.

(5) A color image forming method in which toner images respectively composed of color toners of yellow, magenta, and cyan and a black toner are formed on a plurality of image forming members respectively, and the toner images on said plurality of image forming members are successively transferred onto a transfer material to form a color toner image, wherein each of said color toners is a flattened toner composed of particles having an equivalent circle diameter d of 5 to 10 (μm) as viewed from the direction to make the projection area maximum, a thickness t of 1 to 4 (μm), and a flattening ratio d/t of 2 to 8 represented by the ratio of said equivalent circular diameter d to said thickness t, and the flattening ration d/t of the particles of said color toners is larger than the flattening ratio d/$t_K$ of the particles of said black toner.

(6) A color image forming method in which toner images respectively composed of color toners of yellow, magenta, and cyan and a black toner are formed on a plurality of image forming members respectively, and the toner images on said plurality of image forming members are successively transferred onto an intermediate transfer member to form a color toner image, and then said toner images composing said color toner image are transferred all at a time onto a transfer material, wherein each of said color toners is a flattened toner composed of particles having an equivalent circle diameter d of 5 to 10 (μm) as viewed from the direction to make the projection area maximum, a thickness of 1 to 4 (μm), and a flattening ratio d/t of 2 to 8 represented by the ratio of said equivalent circle diameter d to said thickness and the flattening ratio d/t of the particles of said color toner is smaller than the flattening ratio d/$t_K$ of the particles of said black toner In the above-mentioned structures (1) to (6), the following conditions (a) and (b) are set for the shape of the particles of color toners of Y, M, and C and black toner of K.

(a) The thickness t of the particles of the color toners is made smaller than the thickness $t_K$ of the particles of the black toner. By using flattened toners satisfying the above-mentioned condition, the thickness of the toner layers at the superposition area (an area where color toner particles are deposited) can be made thin; therefore, a high-quality image like an image to be produced by printing can be obtained. On the other hand, because the toner layer become able to secure a certain degree of thickness in a letter area, a letter image which is excellent in sharpness is formed. FIG. 2(*a*) is a schematic drawing showing such a state of toner deposition.

(b) The flattening ratio d/t of the particles of the color toners is made larger than the flattening ratio $d_K/t_K$ of the particles of the black toner. By using flattened toners satisfying the above-mentioned condition, the toner particles are deposited as laid down in the superposition area; therefore, even a small amount of toner particles can cover the surface of a transfer material, and the color reproducibility is excellent, while toner consumption can be reduced. On the other hand, because the toner layer becomes piled up to some extent in a letter area, a letter image having an excellent sharpness can be formed. FIG. 2(*b*) is a schematic drawing showing such a state of toner deposition.

(7) A color image forming method in which toner image is formed on an image forming member through superposing the layers of three color toners of yellow, magenta, and cyan and a black toner, and then said layers of toners composing said color toner image are transferred all at a time onto a transfer material, wherein each of said color toners is a flattened toner composed of particles having an equivalent circle diameter d of 5 to 10 (μm) as viewed from the direction to make the projection area maximum, a thickness t of 1 to 4 (μm), and a flattening ratio d/t of 2 to 8 represented by the ratio of said equivalent circle diameter d to said thickness t, and the equivalent circle diameter d of the particles of said color toners is larger than the equivalent circle diameter $d_K$, of the particles of said black toner.

(8) A color image forming method in which toner images respectively composed of color toners of yellow, magenta, and cyan and a black toner are formed on a plurality of image forming members respectively, and the toner images on said plurality of image forming members are successively transferred onto a transfer material to form a color toner image, wherein each of said color toners is a flattened toner composed of particles having an equivalent circle diameter d of 5 to 10 (μm) as viewed from the direction to make the projection area maximum, thickness t of 1 to 4 (μm), and a flattening ratio d/t of 2 to 8 represented by the ratio of said equivalent circle diameter d to said thickness t, and the equivalent circle diameter d of the particles of said color toners is larger than the equivalent circle diameter $d_K$ of the particles of said black toner.

(9) A color image forming method in which toner images respectively composed of color toners of yellow, magenta, and cyan and a black toner are formed on a plurality of image forming members respectively, and the toner images on said plurality of image forming members are successively transferred onto an intermediate transfer member to form a color toner image, and then said toner images composing said color toner image are transferred all at a time onto a transfer material wherein each of said color toners is a flattened toner composed of particles having an equivalent circle diameter d of 5 to 10 (μm) as viewed from the direction to make the projection area maximum, a thickness t of 1 to 4 (μm), and a flattening ratio d/t of 2 to 8 represented by the ratio of said equivalent circle diameter d to said thickness t, and the equivalent circle diameter d of the particles of said color toners is larger than the equivalent circle diameter $d_K$ of the particles of said black toner.

(10) A color image forming method in which a color toner image is formed on an image forming member through superposing the layers of three color toners of yellow, magenta, and cyan and a black toner, and then said layers of toners composing said color toner image are transferred all at a time onto a transfer material, wherein each of said color toners is a flattened toner composed of particles having an equivalent circle diameter d of 5 to 10 (μm) as viewed from the direction to make the projection area maximum, a thickness t of 1 to 4 (μm), and a flattening ratio d/t of 2 to 8 represented by the ratio of said equivalent circle diameter d to said thickness t, the equivalent circle diameter d of the particles of said color toners is larger than the equivalent circle diameter $d_K$ of the particles of said black toner, and the thickness t of the particles of said color toners is smaller than the thickness $t_K$ of the particles of said black toner.

(11) A color image forming method in which toner images respectively composed of color toners of yellow, magenta, and cyan and a black toner are formed on a plurality of image forming members respectively, and the toner images on said plurality of image forming members are successively transferred onto a transfer material to form a color toner image, wherein each of said color toners is a flattened toner composed of particles having an equivalent circle diameter d of 5 to 10 (μm) as viewed from the direction to make the projection area maximum, a thickness t of 1 to 4 (μm), and a flattening ratio d/t of 2 to 8 represented by the ratio of said equivalent circle diameter d to said thickness t, the equivalent circle diameter d of the particles of said color toners is larger than the equivalent circle diameter $d_K$ of the particle of said black toner, and the thickness t of the particles of said color toners is smaller than the thickness $t_K$ of the particles of said black toner.

(12) A color image forming method in which toner images respectively composed of color toners of yellow, magenta and cyan and a black toner are formed on a plurality of image forming members respectively, and the toner images on said plurality of image forming members are successively transferred onto an intermediate transfer member to form a color toner image, and then said toner images composing said color toner image are transferred all at a time onto a transfer material, wherein each of said color toners is a flattened toner composed of particles having an equivalent circle diameter d of 5 to 19 (μm) as viewed from the direction to make the projection area maximum, a thickness to of 1 to 4 (μm), and a flattening ratio d/t of 2 to 8 represented by the ratio of said equivalent circle diameter d to said thickness t, the equivalent circle diameter d of the particles of said color toners is larger than the equivalent circle diameter $d_K$ of the particle of said black toner, and the thickness t of the particles of said color toners is smaller than the thickness $t_K$ of the particles of said black toner.

In the above-mentioned structures (7) to (12), the following conditions (c) and (d) are set for the shape of the particles of the color toners of Y, M, and C, and the black toner of K.

(c) The equivalent circular diameter d of the particles of the color toners is made larger than the equivalent circle diameter $d_K$ of the particles of the black toner. By using flattened toners satisfying the above-mentioned condition, a letter image which is of high fidelity to the latent image and is excellent in resolution and sharpness is formed in a letter area (an area where black toner particles are mainly deposited). Further, in a superposition area (an area where color toner particles are deposited), developing performance is stable even in a highlight area where the amount of toner deposition is less, and a high-quality image like an image produced by printing having a good gradation characteristic can be obtained.

(d) The equivalent circle diameter d of the particles of the color toners is made larger than the equivalent circular diameter $d_K$ of the particles of the black toner, and the thickness t of the particles of the color toners is made smaller than the thickness $t_K$ of the particles of the black toner. By using flattened toners satisfying the above-mentioned condition, the toner particles are deposited as laid down in the superposition area; therefore, even a small amount of toner particles can cover the surface of a transfer material, and the color reproducibility is excellent, while toner consumption can be reduced. On the other hand, because the toner layer becomes piled up to some extent in a letter area, a letter image having an excellent resolution and sharpness can be formed.

FIG. 7 is a schematic drawing showing the state of toner deposition for the above-mentioned conditions (c) and (d).

DETAILED DESCRIPTION OF THE PREFERRED EMBODIMENT

Figure 1:
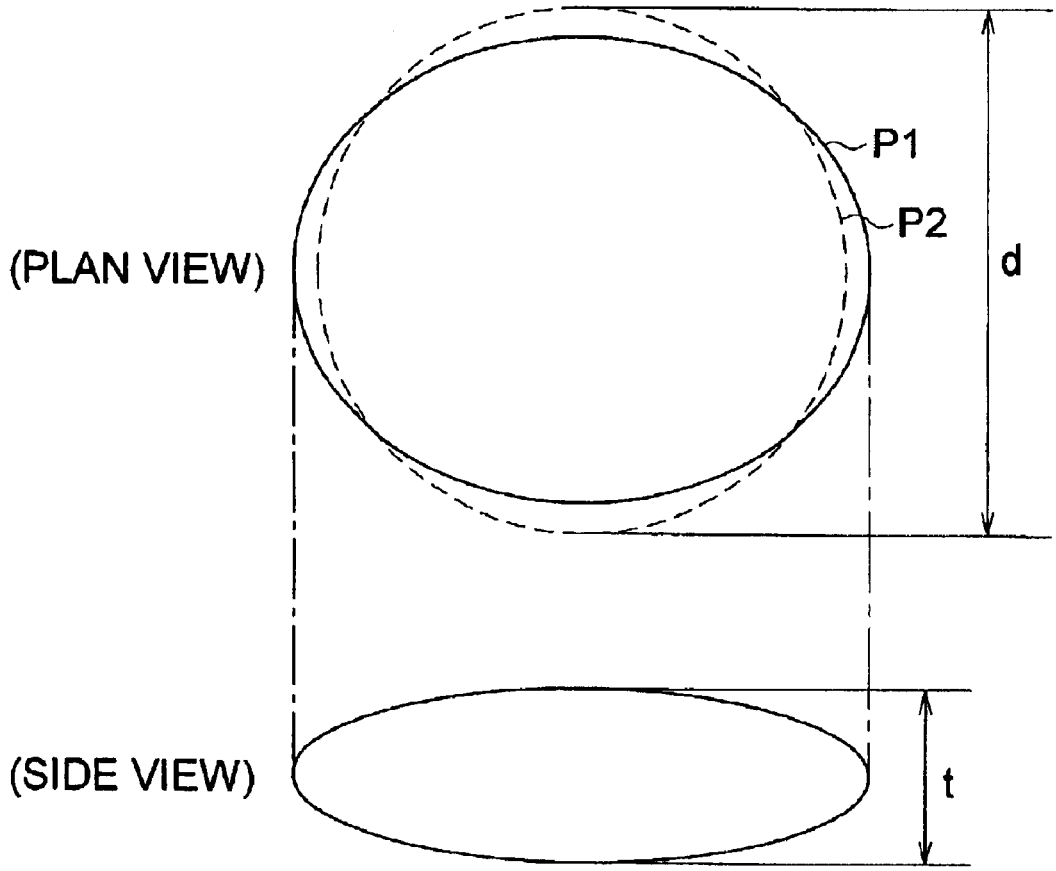
FIG. 1 shows the plan and a side view of a flattened toner particle.
Figure 2:
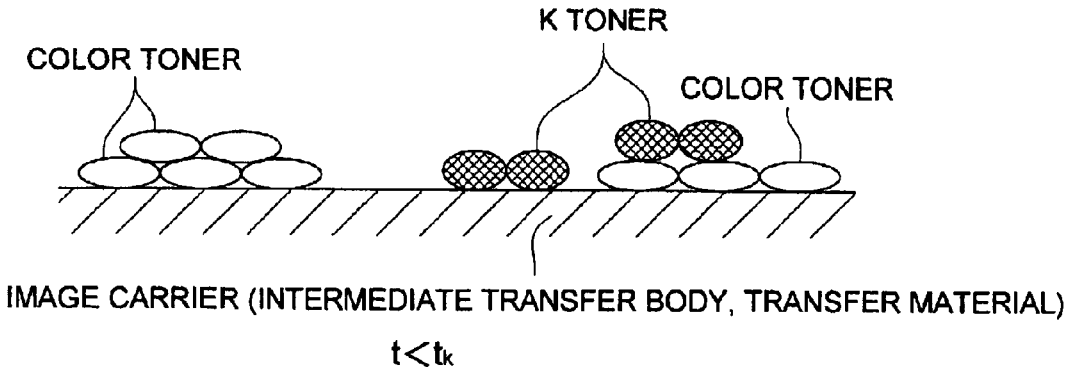
FIG. 2(*a*) and FIG. 2(*b*) are schematic drawings showing states of deposition of toner particles of this invention respectively.
Figure 2:
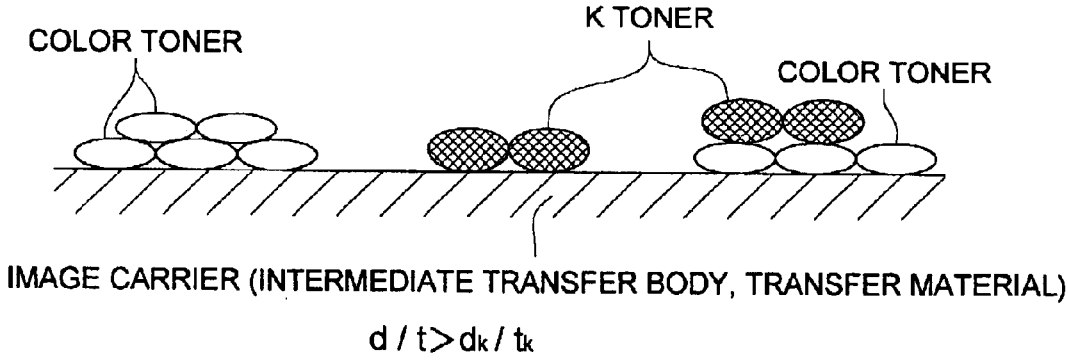

An image forming method of this invention is an image forming method in which a plurality of toner images successively formed on an image forming member by multiple developments or a plurality of toner images respectively formed on a plurality of image forming members are multiply transferred onto a transfer material or an intermediate transfer member to form a superposed image, and is characterized by using flattened toners (also called flattened toners of this invention) having properties described in the following for the three color toners of yellow, magenta, and cyan among the toners forming the plural toner images. Incidentally, in this invention, it is made a desirable condition that, when an electrostatic latent image formed on a photoreceptor is developed by using a flattened toner of this invention to form a toner image, said toner image is formed by the particles of the flattened toner deposited in a state where the particles are laid down with their flattened surface kept in contact with the surface of the photoreceptor, and said toner image is transferred onto a transfer material or is transferred through an intermediate transfer member to a transfer material with the state kept as it is. As described in the above, for forming a toner image in a state where the particles are laid down on the surface of the photoreceptor, and transferring it onto a transfer material or an intermediate transfer member with the state kept as it is, it is necessary to use a toner composed of particles with the surface charged uniformly by frictional charging; for that purpose, it is desirable that a flattened toner of this invention is composed of particles which are excellent in roundness to be described later.

In the following, concrete examples of the structure of a flattened toner and an image forming method of this invention will be explained in this order.

Structure of a Flattened Toner of Present Invention

A flattened toner of present invention has the following characteristics.

The equivalent circle diameter d (μm) as viewed from the direction to make the projection area maximum of a toner is to satisfy the following relation:

$$5 \leqq d \leqq 10,$$

the thickness t (μm) is to satisfy the following relation:

$$1 \leqq t \leqq 4,$$

and the flattening ratio d/t represented by the ratio of the equivalent circle diameter d to the thickness t is to satisfy the following relation:

$$2 \leqq d/t \leqq 8.$$

If the above-mentioned equivalent circle diameter d (μm) of the toner is smaller than 5, there is a possible risk of an operator suffering from a disease such as pneumoconiosis, and if it exceeds 10, there is posed a problem that a sharp image cannot be obtained. If the above-mentioned thickness t (μm) of the toner is smaller than 1, toner particles become easy to be broken, to make background smudging tend to occur owing to the broken fine particles, and if it exceeds 5, each of the toner layers becomes bulky, which poses a problem that the toner layer is leveled down at the time of development or transfer, or a toner image is spread at the time of fixing, which causes a high-quality image to become difficult to obtain.

If the above-mentioned flattening ratio d/t of the toner represented by the ratio of the equivalent circle diameter d (μm) to the thickness t (μm) is smaller than 2, because the toner particles are not deposited layer-wise, the stacked toner layers tend to be leveled down to produce scattering during development or transfer, and if it exceeds 8, there is posed a problem that the toner particles are easy to be broken during being stirred in the developing device, pressure transfer, cleaning, etc. to cause background smudging to tend to be produced. In present invention, by not only using a flattened toner of present invention having the above-mentioned characteristics for Y, M, and C toners, but also specifying the relationship concerning the shape between the color toners and the black toner for a case where superposed toner images are formed to be described later, the advantages that poor cleaning and production of a hollow image defect never occur, that it can be obtained an image having a good gradation characteristic for an area of picture image and an excellent resolution and sharpness for an area of letter image, and that the efficiency of heat fixing is excellent which enables high-speed processing; and in particular, in the case of forming an image composed of toner images superposed, no toner scattering or production of background smudging occurs, and a sharp image can be obtained.

FIG. 1 shows the plan and a side view of a flattened toner particle of present invention; P1 represents a flattened toner particle of present invention, P2 represents a circle having the same area as the projection area of the toner particle as viewed from the direction to make it maximum, d denotes the diameter of said circle P2 (equivalent circle diameter) (μm), and t denotes the maximum thickness of the flattened toner particle as viewed from the direction perpendicular to the projection direction of the flattened toner particle P1 (μm). Besides, in present invention, the reason for representing the size of a flattened toner particle by the equivalent circle diameter d (μm) on a projection plane as viewed from the direction to make the projection area of the flattened toner particle maximum is that the measurement of the cross-sectional area is performed in a state where the flattened toner particle is laid down on the measuring surface.

Manufacturing Method of Toner

For manufacturing a flattened toner of present invention, it is appropriate to employ a method in which a resin particles obtained by a conventional pulverization granulating method (containing a coloring agent etc. as occasion demands) are made spherical by a spray-dry method for example, and the resin particles made spherical are given heat and a mechanical shearing force to be subjected to a flattening process. However, because resin particles obtained by the above-mentioned pulverization granulating method have a broad particle diameter distribution, and an irregular shape, which makes it necessary to eliminate a large amount of inappropriate particles by a classification operation, there is a problem that the productivity is poor;

therefore, it is desirable to manufacture the toner by a polymerization granulating method to be described below.

That is, it is desirable that a flattened toner of present invention is manufactured by using resin particles obtained by fuse-bonding fine resin particles prepared by an emulsion polymerization method or a suspension polymerization method in an aqueous medium, or by directly using resin particles prepared by a suspension polymerization method, further making these particles spherical by heat treatment, and applying a flattening process by giving heat and a shearing force to the resin particles having been made spherical.

The above-mentioned resin particles (the former ones) obtained by fuse-bonding the fine resin particles prepared by an emulsion polymerization method or a suspension polymerization method in an aqueous medium have a uniform surface, and flattened toner particles obtained from said resin particles have an advantage that they have also a uniform surface. Further, because the resin particles directly prepared by a suspension polymerization method (the latter ones) are also spherical, also in the case where flattened toner particles are obtained by applying a flattening process to said resin particles, the surface shape is smooth. However, because the former ones that are resin particles obtained by fuse-bonding fine resin particles have a sharp particle diameter distribution as compared to the latter ones which are resin particles directly obtained by a suspension polymerization method, it is desirable to use the former ones that are resin particles obtained by fuse-bonding fine resin particles in an aqueous medium.

In the following, as regards the manufacturing method of a flattened toner of present invention, it will be explained a manufacturing method using the former ones that are resin particles obtained by fuse-bonding fine resin particles in an aqueous medium.

Polymerizable Monomer

As regards the polymerizable monomer as the material of a flattened toner of present invention, the main constituent is a radical-polymerizable monomer and a bridging agent is added as occasion demands. Besides, it is appropriate that the material contains, in addition to the above-mentioned, at least one kind of a radical-polymerizable monomer having an acidic radical or a radical-polymerizable monomer having a basic radical.

(1) The Radical-Polymerizable Monomer

As regards the radical-polymerizable monomer, there is no particular limitation, and any one of radical-polymerizable monomers known to public can be used. Further, it is possible to use a combination of two or more kinds of them so as to make the resin have required properties.

To state it concretely, an aromatic vinyl monomer, a (meth)acrylic ester monomer, a vinyl ester monomer, vinylether monomer, a mono-olefin monomer, a di-olefin monomer, an olefin halide monomer, etc. can be used.

For the aromatic vinyl monomer, for example, styrene monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene, and derivatives of them can be cited.

For the (meth)acrylic ester monomer, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, diethylaminoethyl methacrylate, etc. can be cited.

For the vinyl ester monomer, vinyl acetate, vinyl propionate, vinyl benzoate, etc. can be cited.

For the vinylether monomer, vinylmethyl ether, vinylethyl ether, vinylisobutyl ether, vinylphenyl ether, etc, can be cited.

For the mono-olefin monomer, ethylene, propylene, isobutylene, 1-butene, 1-pentene, 4-methyl-1-pentene, etc. can be cited.

For the di-olefin monomer, butadiene, isoprene, chloroprene, etc. can be cited.

For the olefin halide monomer, vinyl chloride, vinylidene chloride, vinyl bromide, etc. can be cited.

(2) Bridging Agent

For a bridging agent to be added for the purpose of improving the properties of a toner, a radical-polymerizable bridging agent is used. For the radical-polymerizable bridging agent, one that has two or more unsaturated bonds such as divinyl benzene, divinyl naphthalene, divinyl ether, diethyleneglycol methacrylate, ethyleneglycol dimethacrylate, polyethyleneglycol dimethacrylate, diaryl phthalate, etc. can be cited.

As regards the radical-polymerizable bridging agent, it is desirable to use them within a range of 0.1 to 10% by weight to the total radical-polymerizable monomer, although it depends on the property.

(3) The Radical-Polymerizable Monomer Having an Acidic Radical or the Radical-Polymerizable Monomer Having a Basic Radical For the radical-polymerizable monomer having an acidic radical or the radical-polymerizable monomer having a basic radical, for example, a monomer containing a carboxyl radical, a monomer containing a sulfonic radical, and amine compounds such as primary amine, secondary amine, tertiary amine, and a quaternary ammonium salt can be used.

For the radical-polymerizable monomer having an acidic radical, for example, a monomer containing a carboxyl radical, a monomer containing a sulfonic radical, etc. can be used. For the monomer containing a carboxyl radical, acrylic acid, methacrylic acid, fumaric acid, maleic acid, itaconic acid, cinnamic acid, maleic mono-butyl ester, maleic mono-octyl ester, etc. can be cited. For the monomer containing a sulfonic radical, styrene sulfonate, arylsulfosuccinic acid, octyl arylsulfosuccinate, etc. can be cited. It is appropriate that these have a structure of a salt of an alkaline metal such as sodium or potassium or of an alkaline earth metal such as calcium.

For the radical-polymerizable monomer having a basic radical, for example, amine compounds such as primary amine, secondary amine, tertiary amine, and a quaternary ammonium salt can be used. To state it concretely, dimethylaminoethyl acrylate, dimethylaminoethyl methacrylate, diethylaminoethyl acrylate, diethylaminoethyl methacrylate, a quaternary ammonium salt of these four kinds of compounds, 3-dimethylaminophenyl acrylate, a 2-hydroxy-3-methacryloxypropyltrimethyl ammonium salt, acryl amide N-butylacryl amide, N,N-dibutylacryl amide, piperidylacryl amide, methacryl amide, N-butylmethacryl amide, N-octadecylacryl amide, vinyl pyridine, vinyl pyrrolidone, vinyl N-methylpyridinium chloride, vinyl N-ethylpyridinium chloride, N,N-diarylmethyl ammonium chloride, N,N-diarylethyl ammonium chloride, etc. can be cited. It is desirable that the radical-polymerizable monomer having an acidic radical or the radical-polymerizable monomer having a basic radical is used within a range of 0.1 to 15% by weight to the total radical-polymerizable monomer.

Chain-Transfer Agent

For the purpose of adjusting the molecular weight, it is possible to use a chain-transfer agent which is generally used. As regards the chain-transfer agent, there is no particular limitation, and for example, mercaptans such as octylmercaptan, dodecylmercaptan, and tert-dodecylmercaptan, and a styrene dimer are used.

Polimerization Initiator, Dispersion Stabilizer, Surface Active Agent

In the case where, after fine resin particles are prepared by what is called an emulsion polymerization method, the fine resin particles are salted out and fused to be bonded to one another to form resin particles as toner particles, a water soluble radical polymerization initiator is used. For the water soluble radical polymerization initiator, for example, persulfate salts (potassium persulfate, ammonium persulfate, etc.), azo compounds (4,4'-azobis-4-cyanovaleric acid and its salt, 2,2'-azobis(2-amidinopropane) salt, etc.), peroxide compounds, etc. can be cited. It is possible to make these radical polymerization initiator a redox initiator by combining it with a reduction agent as occasion demands. By using a redox initiator, polymerization activity is improved which makes the polymerization temperature lowered, and further, the shortening of polymerization time can be expected.

The quantity of the polymerization initiator to be added is determined by the molecular weight of the resin to become a final toner, and it is generally 0.1 to 10% by weight to the radical polymerizable monomer, and desirably 0.2 to 5% by weight. Further, as regards the polymerization temperature, it is possible to select any temperature so long as it is not lower than the lowest radical generation temperature of the polymerization initiator; for example, a temperature falling within a range of 50° C. to 90° C. is used. However, by using a polymerization initiator starting at normal temperature, for example, a combination of hydrogen peroxide with a reducing agent (ascorbic acid, etc.), it becomes possible to make polymerization at room temperature or at a temperature a little higher than it.

As regards the surface active agent which can be used in emulsion polymerization, there is no particular limitation; however, because it is necessary to disperse the above-mentioned radical-polymerizable monomer as oil drops in an aqueous medium, an ionic surface active agent can be cited as an example of suitable one. For the ionic surface active agent, salts of sulfonic acids (sodium dodecylbenzenesulfonate, sodium arylalkylpolyethersulfonate, sodium 3,3-disulfonicdiphenylurea-4,4-diazo-bis-amino-8-naphthol-6-sulfonate, ortho-carboxibenzene-azo-dimethylaniline, sodium 2,2,5,5-tetramethyl-triphenylmethane-4,4-diazo-bis-β-naphthol-6-sulfonate, etc.), salts of sulfuric ester (sodium dodecylsulfate, sodium tetradecylsulfate, sodium pentadecylsulfate, sodium octylsulfate, etc.), salts of fatty acid (sodium oleate, sodium laurate, sodium caprate, sodium caprylate, sodium capronate, potassium stearate, calcium oleate, etc.), etc. can be cited. Further, in addition to the above, a nonionic surface active agent can be used. To state it concretely, polyethylene oxide, polypropylene oxide, a combination of polypropylene oxide and polyethylene oxide, ester of polyethylene glycol and higher fatty acid, alkylphenolpolyethylene oxide, ester of higher fatty acid and polyethylene glycol, ester of higher fatty acid and polypropyrene oxide, sorbitan ester, etc. can be cited.

Further, these surface active agents are used mainly at the time of emulsion polymerization, but they may be used in some other processes or for other purposes.

In the case where resin particles as the parent particles of a toner are manufactured by salting out and fuse-bonding the fine resin particles which have been prepared by what is called a suspension polymerization method, it is desirable to use an oil soluble radical polymerization initiator. For the oil soluble radical polymerization initiator, to state it concretely, peroxides such as benzoyl peroxide, lauroyl peroxide, cumene hydroperoxide, t-butylhydroperoxide, dicumyl peroxide, acetyl peroxide, and propionyl peroxide, azobis polymerization initiators such as 2,2'-azobisisobutylonitrile, 2,2'-azobis(2,4-valeronitrile), 2,2'-azobis-2-methylvaleronitrile, and 2,2'-azobis-2,4-dimethylvaleronitrile, etc. can be cited. The quantity of polymerization initiator to be added is determined by the molecular weight of the resin to become a toner finally; it is generally 0.1 to 10% by weight to the radical-polymerizable monomer, and desirably 0.2 to 5% by weight.

In a suspension polymerization method, a dispersion stabilizing agent is used as it is dispersed in an aqueous medium. For the dispersion stabilizing agent, it is desirable such one that can be easily removed finally at the stage of filtration and washing, and in particular, a hardly water soluble inorganic dispersion stabilizing agent is desirably used. To state it concretely, calcium carbonate, calcium tertiary phosphate, aluminum oxide, barium carbonate, magnesium carbonate, barium sulfate, aluminum hydroxide, titanium oxide, silicon oxide, iron hydroxide, etc. can be cited, and a particularly desirable dispersion stabilizing agent is calcium tertiary phosphate. Besides, also it is appropriate to use a little amount of surface active agent as a dispersion assisting agent in addition to this hardly water soluble inorganic dispersion stabilizing agent. In this case, any one of nonionic, anionic, cationic, ampholytic surface active agents can be used, but desirable one is an anionic surface active agent.

As regards the dispersion stabilizing agent, it is desirable to use it of a quantity of about 1 to 10% by weight to the oil phase component to be dispersed. If it is less than this range, the stability of dispersion is lowered and flocculation of particles occurs, and if it is more than this range, dispersion is promoted to produce too excessive smaller diameter components. Further, it is desirable that the surface active agent is added with an amount of 0.05 to 1% by weight to the inorganic dispersion stabilizing agent. If it is less than this range, it cannot exhibit the effect of improving dispersion stabilization, and if it is used with an amount exceeding this range, it is posed a problem that emulsification of radical-polymerizable monomer occurs, and so called latex particles are produced in the system, while there is also a problem that the removal of the surface active agent is difficult to do to cause the adsorption of water to occur.

Coloring Agent

For a coloring agent, any one of inorganic pigments, organic pigments, and dyes known to public can be used.

To state concrete examples of the inorganic pigments, as regards black pigments, for example, carbon blacks such as furnace black, channel black, acetylene black, thermal black, lampblack, etc. can be used, and magnetic particles of magnetite, ferrite, etc. can be used.

To state concrete examples of the organic pigments, for magenta or red pigments, for example, C. I. pigment-red 3, C. I. pigment-red 5, C. I. pigment-red 6, C. I. pigment-red 7, C. I. pigment-red 15, C. I. pigment-red 16, C. I. pigment-red 48:1, C. I. pigment-red 53:1, C. I. pigment-red 57:1, C. I. pigment-red 122, C. I. pigment-red 123, C. I. pigment-red 139, C. I. pigment-red 144, C. I. pigment-red 149, C. I. pigment-red 166, C. I. pigment-red 177, C. I. pigment-red 178, C. I. pigment-red 222, etc. can be cited. Further, for orange or yellow pigments, C. I. pigment-orange 31, C. I. pigment-orange 43, C. I. pigment-yellow 12, C. I. pigment-yellow 13, C. I. pigment-yellow 14, C. I. pigment-yellow 15, C. I. pigment-yellow 17, C. I. pigment-yellow 93, C. I. pigment-yellow 94, C. I. pigment-yellow 138, etc. can be cited. For green or cyan pigments, C. I. pigment-blue 15, C. I. pigment-blue 15:2, C. I. pigment-blue 15:3, C. I. pigment-blue 16, C. I. pigment-blue 60, C. I. pigment-green 7, etc. can be cited.

To state concrete examples of dyes, C. I. solvent-red 1, C. I. solvent-red 49, C. I. solvent-red 52, C. I. solvent-red 58, C. I. solvent-red 63, C. I. solvent-red 111, C. I. solvent-red 122, C. I. solvent-yellow 19, C. I. solvent-yellow 44, C. I. solvent-yellow 77, C. I. solvent-yellow 79, C. I. solvent-yellow 81, C. I. solvent-yellow 82, C. I. solvent-yellow 93, C. I. solvent-yellow 98, C. I. solvent-yellow 103, C. I. solvent-yellow 104, C. I. solvent-yellow 112, C. I. solvent-yellow 162, C. I. solvent-blue 25, C. I. solvent-blue 36, solvent-blue 60, C. I. solvent-blue 70, solvent-blue 93, C. I. solvent-blue 95, etc. can be cited.

As regards these inorganic pigments, organic pigments, and dyes, it is possible to select one or a plurality of them together for use as occasion demands. Further, the quantity of a pigment to be added is 2 to 20% by weight to the polymer, and desirably, 3 to 15% by weight is selected. In the case where the toner is used as a magnetic toner, usually the above-mentioned magnetite is added; in this case, from the viewpoint of the specified magnetic properties to be given, it is desirable to add an amount of 20 to 60% by weight in the toner.

It is also possible to use a coloring agent with its surface reformed. For the surface reforming agent, any one known to public can be used; to state it concretely, a silane coupling agent, a titanium coupling agent, an aluminum coupling agent, etc. can be desirably used.

Other Internal Additives

It is possible to add a constituent other than a coloring agent such as a releasing agent or a charge controlling agent. For the releasing agent, various kinds of ones known to public can be used; for example, olefin wax such as low molecular weight polypropylene or polyethylene, and a modification of these, natural wax such as carnauba wax, or hydrogenated rice wax, amide wax such as fatty acid bisamide, etc. can be cited. In the same way, as regards the charge controlling agent too, various kinds of ones known to public can be used; for example, a Nigrosine dye, a metal salt of naphthenic acid, or higher fatty acid, alkoxyamine, a quaternary ammonium salt compound, azo metallic complex, a metallic salt of salicilic acid or its metallic complex, etc. can be cited. It is desirable to make the particles of these releasing agent and charge controlling agent have a number-average primary particle diameter of about 10 to 500 nm.

External Additives

It is possible to use what is called an external additive to be added in a toner of present invention for the purpose of improving fluidity or raising the cleaning performance. As regards this external additive, there is no particular limitation, and various kinds of inorganic fine particles, organic fine particles, and a smoothing agent can be used.

For the inorganic fine particles, those of any kind known to public can be used. To state it concretely, fine particles of silica, titania, aluminum, etc. can be desirably used. For these fine particles, hydrophobic ones are desirable. To state it concretely, as for the silica fine particles, for example, products on the market produced by Nihon Aerosil Co., Ltd. R-805, R-976, R-974, R-972, R-812, and R-809, products produced by Hoechst GmbH HVK-2150 and H-200, products on the market produced by Cabot Corp. TS-720, TS-530, TS-610, H-5, and MS-5, etc. can be cited. For the titania fine particles, for example, products on the market produced by Nihon Aerosil Co., Ltd. T-805 and T-604, products on the market produced by TAYCA Corp. MT-100S, MT-100B, MT-500BS, MT-600, MT-600SS, and JA-1, products on the market produced by Fuji Titanium Industry Corp. TA-300SI, TA-500, TAF-130, TAF-510, and TAF-510T, products on the market produced by Idemitsu Kosan Co., Ltd. IT-S, IT-OA, IT-OB, and IT-OC, etc. can be cited. For the alumina fine particles, for example, products on the market produced by Nihon Aerosil Co., Ltd. RFY-C and C-604, a product on the market produced by Ishihara Sangyo Kaisha, Ltd. TO-55, etc. can be cited.

For the organic fine particles, it is possible to use spherical organic fine particles having a number-average primary particle diameter of about 10 to 2000 nm. To state it concretely, fine particles of a homopolymer of styrene, methyl methacrylate, etc. or a copolymer of these can be used.

As regards the smoothing agent, for example, metallic salts of higher fatty acids such as stearic acid salts of metals such as zinc, aluminum, copper, magnesium, and calcium, oleic acid salts of metals such as zinc, manganese, iron, copper, and magnesium, palmitic acid salts of metals such as zinc, copper, magnesium, and calcium, linoleic acid salts of metals such as zinc and calcium, and ricinoleic acid salts of metals such as zinc and calcium can be cited.

It is desirable that the quantity of these external additives to be added is about 0.01 to 5% by weight to the toner.

Manufacturing Process

The manufacturing process of a flattened toner to be used in present invention is composed of a process to manufacture the resin particles as the parent particles of a toner, a process to make said resin particles spherical, a process to apply flattening processing to said resin particles having been made spherical, and a process to add an external additive to said particles having be subjected to flattening processing.

Manufacturing Process of Resin Particles

As described in the above, for manufacturing resin particles as parent particles of a toner, it is desirably used a method in which resin particles prepared by a polymerization method based on emulsion polymerization, suspension polymerization, or the like are fused to be bonded to one another in an aqueous medium.

The manufacturing process in the case where resin particles to become parent particles of a toner are manufactured by fusing and bonding fine resin particles to one another, which are prepared by a polymerization method based on emulsion polymerization, suspension polymerization, or the like, in an aqueous medium, is composed of a polymerization process for preparing fine resin particles by a polymerization method based on emulsion polymerization, suspension polymerization, or the like, a process to obtain resin particles by fusing and bonding fine resin particles to one another in an aqueous medium using the dispersion liquid of the obtained fine resin particles, a process to make spherical the resin particles having been obtained by fuse-bonding in an aqueous medium through raising the temperature, and a washing process for removing the surface active agent etc. by filtering out the obtained particles from the aqueous medium. In the above description, an aqueous medium means one that is mainly composed of water, whose content is not less than 50% by weight. For a medium other than water, an organic solvent which is soluble in water can be cited; for example, methanol, ethanol, isopropanol, butanol, acetone, methylethylketone, tetrahydrofuran, etc. can be cited. It is desirable alcoholic organic solvent such as methanol, ethanol, isopropanol, or butanol which is an organic solvent not dissolving resin.

In the resin particle as the parent body of a toner particle, a coloring agent, a releasing agent, a charge controlling agent, etc. are contained as constituents as occasion demands. As regards these constituents of a toner, it is appropriate to employ either a method in which they are contained in the fine resin particles in the polymerization process for preparing the fine resin particles, or a method in which they are made to be contained in the resin particles by it that, after fine resin particles not containing these constituents of a toner are prepared, liquid in which the coloring agent, releasing agent, charge controlling agent, etc. are dispersed or dissolved is added to dispersion liquid of said fine resin particles, to fuse those fine resin particles to be bonded to one another; however, it is desirable that the releasing agent is made to be contained in the polymerization process, and the coloring agent is made to be contained in the process for fusing and bonding fine resin particles to one another.

For the polymerization process for preparing fine resin particles, it can be cited, for example, a method in which a solution composed of a releasing agent etc. dissolved in a polymerizable monomer is dispersed as oil drops by mechanical energy in an aqueous medium in which a surface active agent of not higher than the critical micelle concentration is dissolved, and a water soluble polymerization initiator is added to this dispersion liquid, to make radical polymerization. In this case, also it is appropriate to use an oil soluble polymerization initiator by adding it in the monomer. As regards a dispersion machine to practice this oil drop dispersion, there is no particular limitation; for example, a Clearmix, an ultrasonic dispersing machine, a mechanical homogenizer, a Mantongorlin, a pressure-type homogenizer, etc. can be cited.

For the method of fusing and bonding particles to one another, it is desirably used a method in which fine resin particles produced by a polymerization process and coloring agent particles are fused together to be bonded to one another while being salted out in an aqueous medium.

The process for practicing this salting out/fuse-bonding is a process in which salting out is made to proceed at the same time while fuse-bonding is carried out by it that a salting out agent composed of an alkaline metal salt, an alkaline earth metal salt, etc. is added as a flocculating agent of not lower than the critical flocculation concentration in water where the fine resin particles and the coloring agent particles are present, and subsequently, it is heated to a temperature not lower than the glass transition temperature of the fine resin particles. In this process, also it is possible to use a method to carry out the fuse-bonding effectively by adding an organic solvent which can be dissolved infinitely in water to lower substantially the glass transition temperature of the fine resin particles.

Now, to state concretely the alkaline metal salt and the alkaline earth metal salt as a salting out agent, for the alkaline metal, lithium, potassium, sodium, etc. can be cited, and for the alkaline earth metal, magnesium, calcium, strontium, barium, etc. can be cited; desirably, potassium, sodium, magnesium, calcium, and barium should be used. Further, for the constituent substance of the salts, a chloride salt, a bromide salt, an iodide salt, a carbonate salt, a sulfate salt, etc. can be cited. Besides, as regards the above-mentioned organic solvent which can be infinitely dissolved in water, methanol, ethanol, 1-propanol, 2-propanol, ethyleneglycol, glycerin, acetone, etc. can be cited; among them, methanol, ethanol, 1-propanol, and 2-propanol, which are alcohol with three or less carbon atoms, are desirable, and especially, 2-propanol is desirable.

Further, the coloring agent particles are prepared by dispersing the coloring agent in an aqueous medium in which a surface active agent is contained with a concentration not lower than the critical micelle concentration (CMC). As regards the dispersing machine for dispersing the coloring agent, there is no particular limitation; desirably, pressure applying dispersion machines such as an ultrasonic dispersion machine, a mechanical homogenizer, a Mantongorlin, and a pressure-type homogenizer, and a medium-type dispersion machine such as a sand grinder, a Getzmann mill, and a diamond fine mill can be cited. Further, also it is possible to use coloring agent particles with their surface reformed; in this case, after a surface reforming agent is added in a dispersion liquid having coloring agent particles dispersed, the temperature is raised to carry out the reaction, and after the completion of the reaction, filtration, washing, and drying are carried out, to give pigment particles treated by the surface reforming agent.

In the case where fuse-bonding is carried out in a salting-out/fuse-bonding process, it is desirable to make it as short as possible the time to leave the dispersion liquid as it is after the salting-out agent is added. Although the reason for this is not definitely clear, the state of flocculation of the particles varies depending on the time of leaving the dispersion liquid as it is, which poses the problem that the particle diameter distribution becomes unstable, and the surface property of the resin particles fused and bonded together varies. Further, if the temperature at which the salting-out agent is added is not lower than the glass transition temperature of the fine resin particles, although the salting-out/fuse-bonding proceeds fast, the control of particle diameter cannot be done, which sometimes causes particles having a large diameter to be produced. For the range of this temperature of addition, a temperature not higher than the glass transition temperature is appropriate, and generally speaking, a range of 5° C. to 55° C., or desirably a range of 10° C. to 45° C. is appropriate.

After the salting-out agent is added at a temperature not higher than the glass transition temperature of the fine resin particles, it is desirable to employ a method in which the fine resin particles are heated to their glass transition temperature or higher by raising the temperature as fast as possible. As regards the temperature raising speed at this time, 1° C./min. or higher is desirable; the time to reach the target temperature is desirably shorter than thirty minutes, and the time shorter than ten minutes is especially desirable. The upper limit of the temperature raising speed is not particularly definite, but from the viewpoint of suppressing the generation of coarse big particles owing to a rapid progress of salting-out/fuse-bonding, a speed of 15° C./min. or slower is desirable. As an especially desirable mode of practice, if salting-out/fuse-bonding is continued to proceed even at the time when the temperature reaches or exceeds the glass transition temperature, fuse-bonding can be made to effectively proceed accompanied by the growth of the particles.

Subsequently, it is desirable that, in the process of making salting out/fuse-bonding proceed continuously, while the size of the resin particles which are growing through fuse-bonding is being monitored, the resin particles are made spherical by raising the temperature further at the timing when they have come to the desired size. Besides, by this spheroidizing, the roundness (to be described later) of flattened toner particles to be obtained by the flattening processing (to be described later) is made larger, and it becomes easy to occur that the toner particles in an image on a photoreceptor surface adhere to the surface of said photoreceptor in such a way that they are laid down laterally.

It is desirable that the resin particles obtained in this way have a volume-average particle diameter of 3 to 9 μm. The volume-average particle diameter of the resin particles can be measured by means of a COULTER COUNTER TA-II, COUNTER MULTISIZER, an SLAD1100 (manufactured by Shimazu Corp.: a particle diameter measuring apparatus of a laser diffraction type), etc., and in the case where a COULTER COUNTER TA-II or a COUNTER MULTISIZER is used, it is shown a volume-average particle diameter which is measured by using an aperture having a diameter of 100 μm and a particle diameter distribution falling within a range of 2.0 to 40 μm.

As regards the amount of fine particles existing among the resin particles, it is desirable the amount of fine particles having a diameter of not greater than 3.0 μm is not more than 20% by number to the total as counted in the particle number distribution, and it is more desirable that the fine particles having a diameter of not greater than 2.0 μm is not more than 10% by number to the total. This amount of fine particles can be measured by means of an electrophoresis light scattering photometer ELS-800 manufactured by Ohtsuka Denshi Co., Ltd. For the adjustment to make the particle diameter distribution fall within this range, it is effective to practice a control to make the speed of temperature raise fast in the stage of salting out/fuse-bonding; to state it concretely, the time required for raising the temperature should be made shorter than 30 minutes, desirably shorter than 10 minutes, and the temperature raising speed should be made to be 1 to 15° C./min.

Further, as regards the shape of the particles obtained by fuse-bonding and spheroidizing, it is desirable that the average value of the coefficient of shape (average roundness) expressed by the following equation is 0.95 to 1.00.

shape of coefficient=(circumferential length of a circle obtained from an equivalent circle diameter)/(circumferential length of a projection image of a particle).

Further, it is desirable that the distribution of the coefficient of shape is sharp, and it is desirable that the standard deviation of the roundness is not greater than 0.10, and the CV value of the coefficient of shape calculated from the following equation is smaller than 10%.

CV value=(standard deviation of roundness)/(average roundness)×100.

Further, the above-mentioned coefficient of shape can be calculated by it that an enlarged photograph of each of 500 resin particles is taken by means of a scanning electron microscope of 500 magnifications, roundness is measured through the analysis of the photographic image using an image analyzing apparatus "SCANNING IMAGE ANALYZER" (manufactured by JEOL, Ltd.), and the arithmetic mean value is obtained. Further, as regards a simple measurement method, it can be measured by means of an apparatus "FPIA-1000" (manufactured by Toa Iyo Denshi Corp.).

The dispersion liquid is cooled at the stage when particles having the desired particle diameter and shape has been obtained, and the obtained particles are filtered from the aqueous medium, and washed, to give resin particles being in a state like a wet cake.

Flattening Processing

The flattening processing of resin particles can be carried out by applying heat and a shearing force to the liquid having resin particles dispersed. To state it concretely, it is desirably employed a method in which the resin particles being a state like a wet cake obtained in the above-mentioned way are again dispersed in an aqueous medium, comparatively coarser synthetic resin particles composed of polyethylene, polymethylmethacrylate, polytetrafluoroethylene, polystyrene, styrene-acrylonitrile copolymer, or the like, glass beads, zirconia beads, or the like having a particle diameter of about 100 μm to 2000 μm are added as a medium to this dispersion liquid, and then, the dispersion liquid is stirred while it is heated to keep a temperature not lower than the glass transition temperature of the resin particles. At this time, it is also appropriate to raise the viscosity of the resin particle dispersion liquid by adding a thickening agent such as methylcellulose in the dispersion liquid of the resin particles, or also it is possible to add an antifoaming agent as occasion demands.

For an apparatus for heating and stirring resin particle dispersion liquid, a conventional dispersion machine known to public can be used; to state it concretely, a dispersion machine of a medium type such as a sand grinder, a Getsmann mill, or a diamond fine mill can be cited.

It is necessary that the temperature of the dispersion liquid is not lower than the glass transition temperature of the resin particles, and further, it is desirable that the upper limit of the temperature is not higher than the processing temperature when the fine resin particles are salted out and fused to be bonded in the manufacturing process of said resin particles, or not higher than the melting point of the releasing agent contained in the resin particles; for the flattening processing temperature, for example, a temperature range from the glass transition temperature of the resin particles to the temperature higher than the glass transition temperature by +20° C. is desirably used. If the flattening processing temperature is too low, flattening processing of the resin particle cannot be sufficiently performed, and if it is too high, the resin particles are flocculated, or the releasing agent contained in the resin particles are melted out from the inside of the resin particles. The flattening processing time of the resin particles is usually from 10 minutes to 10 hours, although it depends on the temperature of the resin particle dispersion liquid, the particle diameter and specific weight of the medium used, the stirring speed, and the shape of the stirring tank.

The flattening processing is applied to the resin particles in the dispersion liquid through the above-mentioned heating and stirring processing; also it is appropriate, in order to make smooth the surface of the resin particles having been subjected to the flattening processing, to heat and stir the resin particle dispersion liquid subsequently after the medium particles are separated from the dispersion liquid by using a sieve or the like. It is desirable that the heating temperature in this case is within the same range as the above-mentioned flattening processing temperature.

After the completion of flattening processing, the dispersion liquid of the resin particles is cooled; then, after the resin particles, which have been processed to become flattened, are filtered and washed, they are dried to give flattened toner particles. The shape of the obtained flattened toner particles is such one that the equivalent circle diameter d as viewed from the direction to make the projection area maximum is 5 to 10 (μm), the thickness t is 1 to 4 (μm)m, and the flattening ratio of the toner d/t represented by the ratio of the above-mentioned equivalent circle diameter d to the above-mentioned thickness t is 2 to 8.

Besides, the equivalent circle diameter d (μm) as viewed from the direction to make maximum the projection area and the thickness t (μm) of a flattened toner particle defined in present invention can be measured by the following method, for example. That is, the equivalent circle diameter d (μm) and the thickness t (μm) can be obtained by it that said flattened toner particles are uniformly dispersed and deposited on a smooth measurement surface as laid down, and for 500 particles out of said flattened toner particles observed under a color laser microscope "VK-8500" (manufactured by Keyence Corp.) with 500 magnifications, the equivalent circle diameter d (μm) and the maximum height (thickness) t (μm) of said 500 toner particles are measured, to give the respective arithmetic mean values.

Further, for the flattened toner of present invention, it is desirable that the shape of the toner particle as viewed from the direction to make the projection area maximum (hereinafter referred to as the shape of the flattened surface) is such one that the average value (average roundness) of the coefficient of shape shown by the following equation is 0.95 to 1.00, and it is more desirable that average value of the coefficient of the shape is 0.98 to 1.00.

coefficient of shape=(circumferential length of a circle obtained from an equivalent circle diameter)/(circumferential length of a projection image of a particle).

Further, it is desirable that the distribution of the coefficient of shape is sharp, and it is desirable that the standard deviation of roundness is not greater than 0.10, and the CV value of the coefficient of shape calculated from the following equation is smaller than 10%.

CV value=(standard deviation of roundness)/(average roundness)×100.

Besides, the shape of the toner particles of present invention is almost uniquely determined by the particle diameter and shape of the resin particles as the parent particles of the toner prior to flattening processing and the degree of flattening in the succeeding flattening processing, and the degree of flattening can be easily controlled by varying the time of flattening processing.

Figure 3:
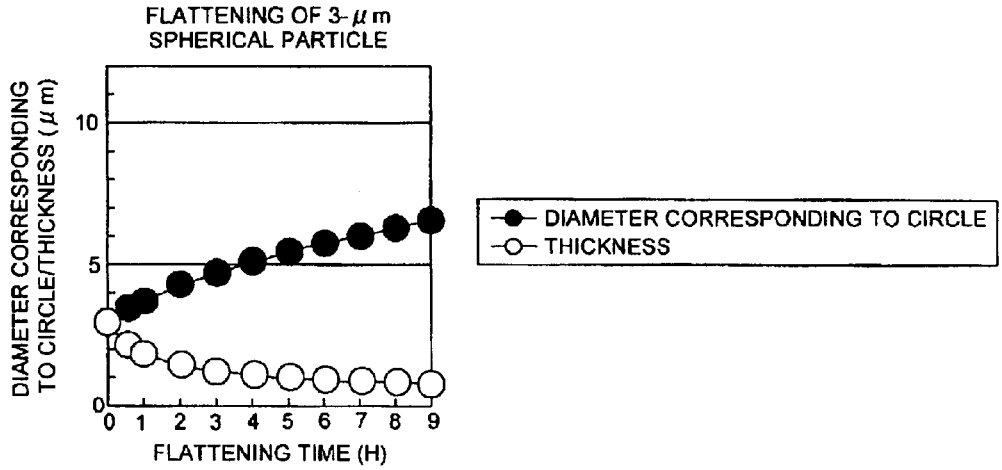
FIG. 3(*a*), FIG. 3(*b*), and FIG. 3(*c*) are graphs showing the relationships between the flattening processing time and the shape of a flattened toner particle.
Figure 3:
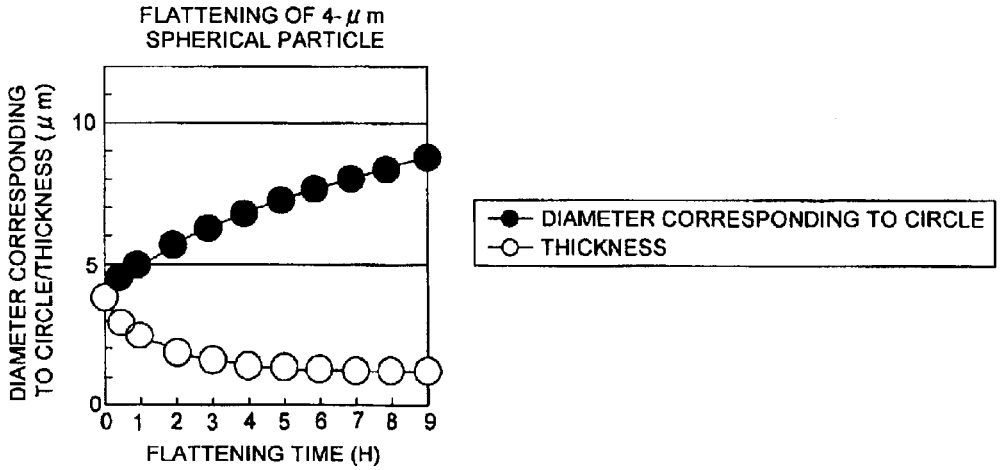
Figure 3:
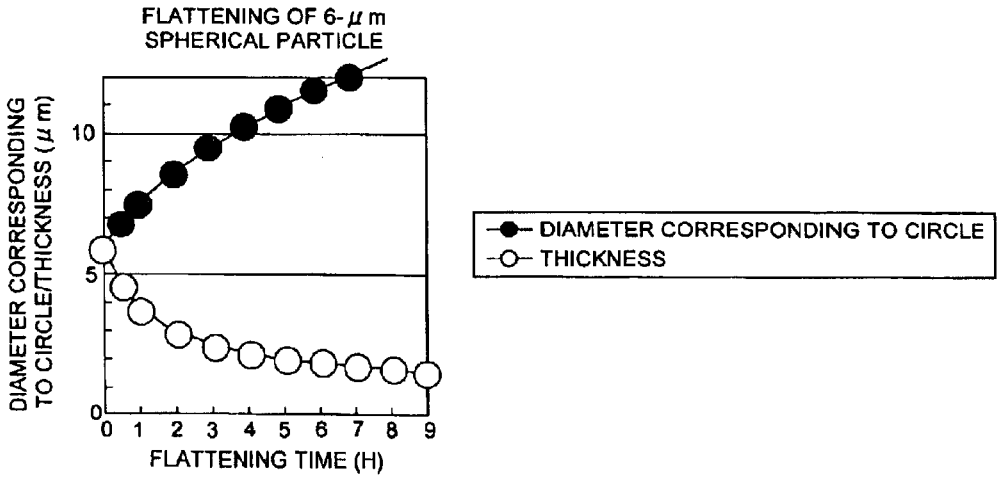

FIG. 3(*a*) to FIG. 3(*c*) are drawings showing examples of the relationship between flattening processing time and shape of a toner particle; FIG. 3(*a*), FIG. 3(*b*), and FIG. 3(*c*) are drawings each showing the variation of equivalent circle diameter and thickness against flattening processing time in the case where flattening processing is carried out using a spherical particle having a diameter of 3.0 μm, 4.0 μm, or 6.0 μm as a parent particle of a toner. For example, in the case where a spherical particle having a diameter of 3.0 μm is used as a parent particle of the toner, as shown in FIG. 3(*a*), the equivalent circle diameter d and thickness t vary with flattening processing time as (3.4 μm, 2.3 μm), (3.8 μm, 1.9 μm), (4.3 μm, 1.4 μm), (4.8 μm, 1.2 μm), . . . , in the case where a spherical particle having a diameter of 4.0 μm is used as a parent particle of the toner, as shown in FIG. 3(*b*), they vary as (4.6 μm, 3.1 μm), (5.0 μm, 2.5 μm), (5.8 μm, 1.9 μm), (6.3 μm, 1.6 μm), (6.8 μm, 1.4 μm), (7.3 μm, 1.2 μm), . . . , and in the case where a spherical particle having a diameter of 6.0 μm is used as a parent particle of the toner, as shown in FIG. 3(*c*), they vary as (6.9 μm, 4.6 μm), (7.6 μm, 3.8 μm), (8.7 μm, 2.9 μm), (9.5 μm, 2.4 μm), (10.3 μm, 2.1 μm), (10.9 μm, 1.8 μm), . . . .

External Additive Treatment Process

The flattened toner particles obtained in the above-mentioned way may be used as they are, but for example, for the purpose of improving fluidity, charging characteristic, and cleaning performance, also it is appropriate to add the above-mentioned external additive. As regards the method of adding an external additive, various kinds of mixing apparatus known to public such as a turbular mixer, a Henscel mixer, a nouter mixer, and a V-type mixing machine can be used.

Developer

A flattened toner of present invention can be used as it is as a non-magnetic or magnetic single-component developer, but it is desirable to use it by mixing with a carrier as a two-component developer.

As regards the particles to be used for a carrier, magnetic particles heretofore known to public such as particles of metals such as iron, and its alloys with aluminum, cobalt, nickel, manganese, etc., and oxides of iron such as ferrite and magnetite can be used, and in particular, ferrite is desirably used. It is appropriate that the above-mentioned magnetic particles have volume-average particle diameter of 15 to 100 μm, and desirably 25 to 60 μm. The volume-average particle diameter of a carrier can be measured representatively by a laser-diffraction-type particle diameter distribution measuring apparatus equipped with a wet-type dispersion machine "HELOS" (manufactured by SYMPATEC Corp.). For a carrier, the above-mentioned magnetic particles can be used as they are; however, ones coated by resin, or what is called resin-dispersion-type carrier particles which are composed of fine magnetic particles dispersed in resin are desirable. As regards the resin for coating, there is no particular limitation; for example, olefin resin, styrene resin, styrene/acrylic resin, silicone resin, ester resin, fluorine-contained polymer resin, etc. can be used. Further, for resin to compose resin-dispersion-type carrier particles, there is no particular limitation and any one known to public can be used; for example, styrene/acrylic resin, polyester resin, fluorine-contained resin, phenol resin, etc. can be used.

Embodiment of Image Forming Method of Present Invention

In the following, the embodiment of an image forming method of present invention will be concretely explained by using FIG. 4, FIG. 5, and FIG. 6.

Figure 4:
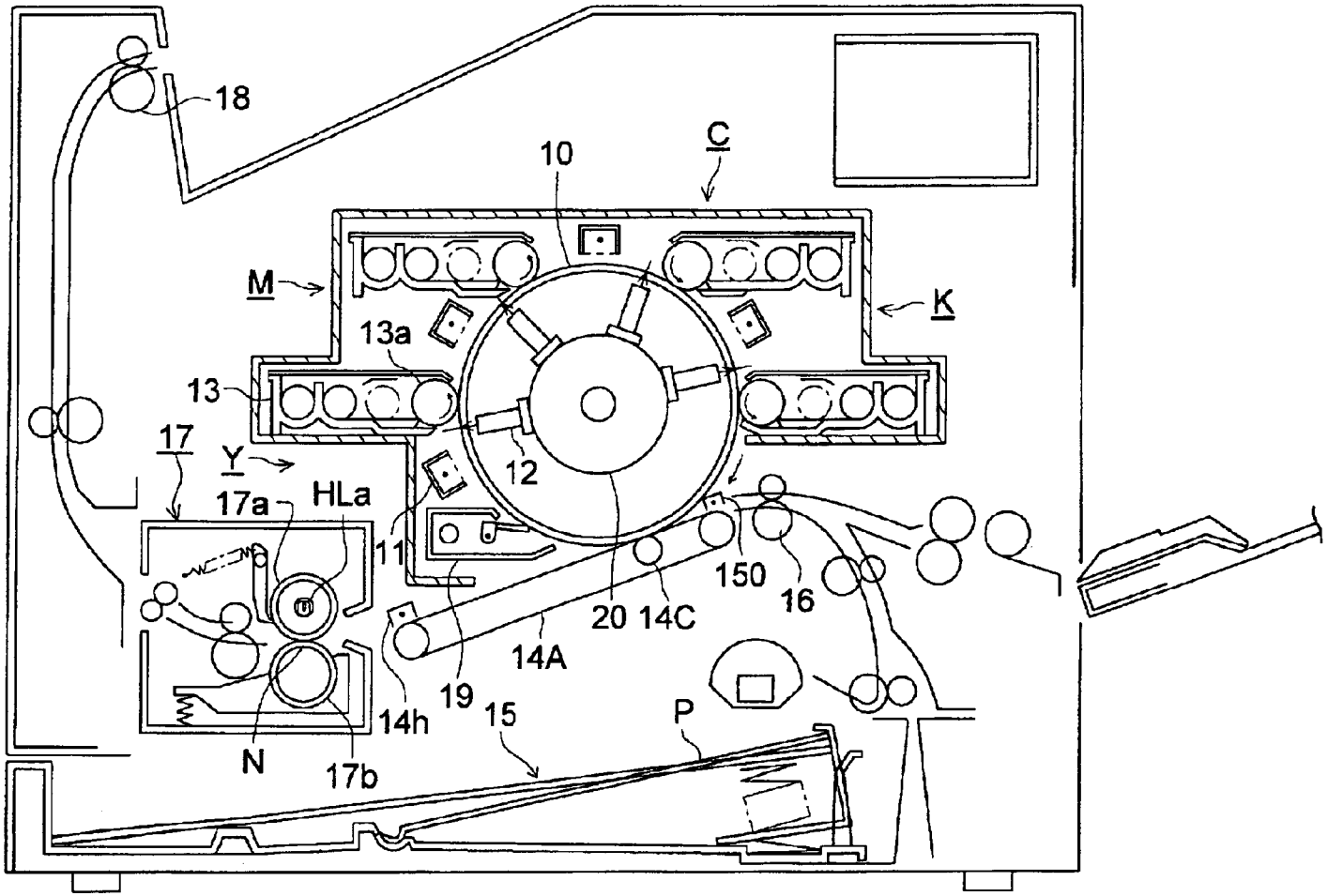
FIG. 4 is a cross-sectional view of the structure of a color image forming apparatus of the first example of the embodiment.
Figure 5:
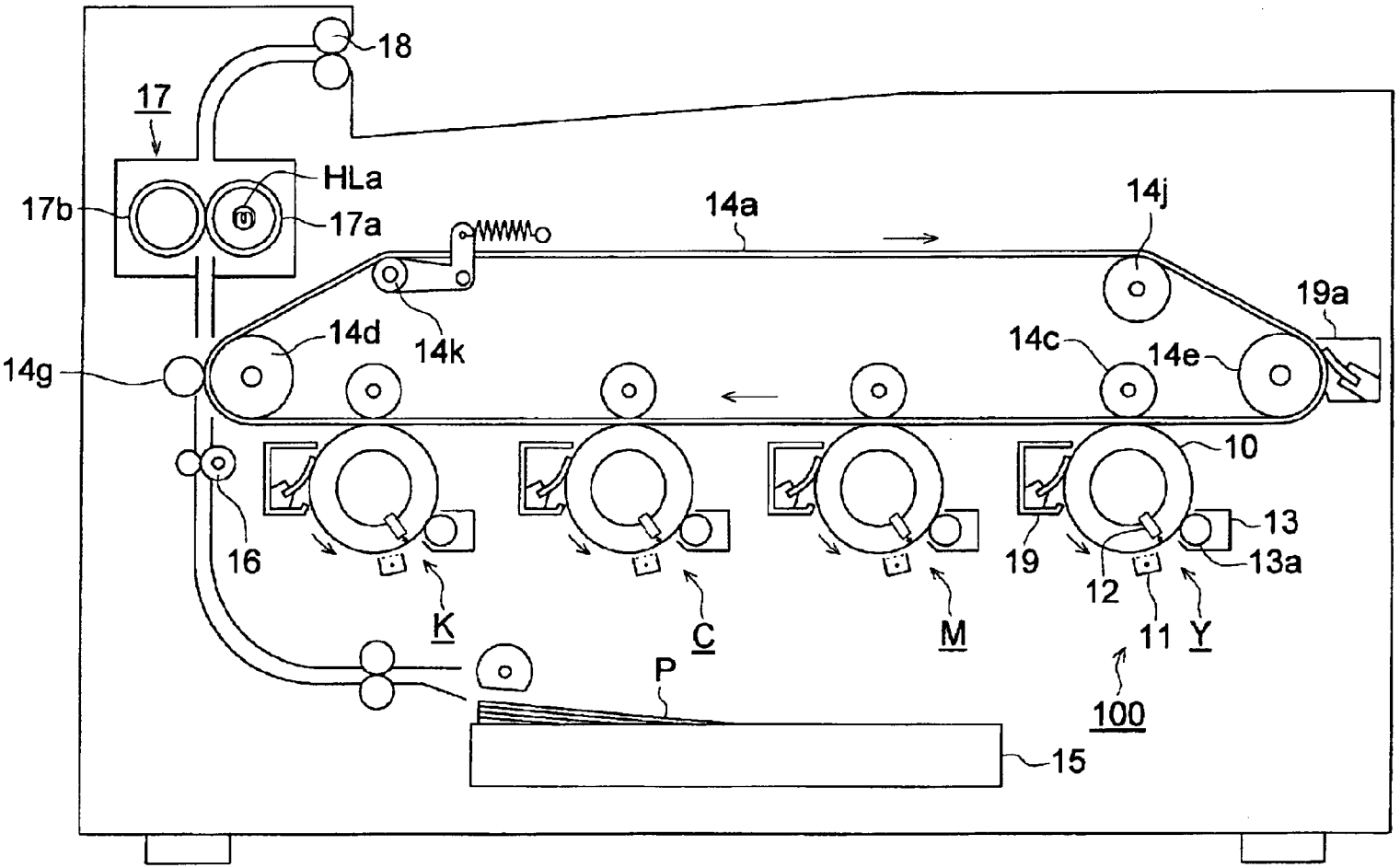
FIG. 5 is a cross-sectional view of the structure of a color image forming apparatus of the second example of the embodiment.
Figure 6:
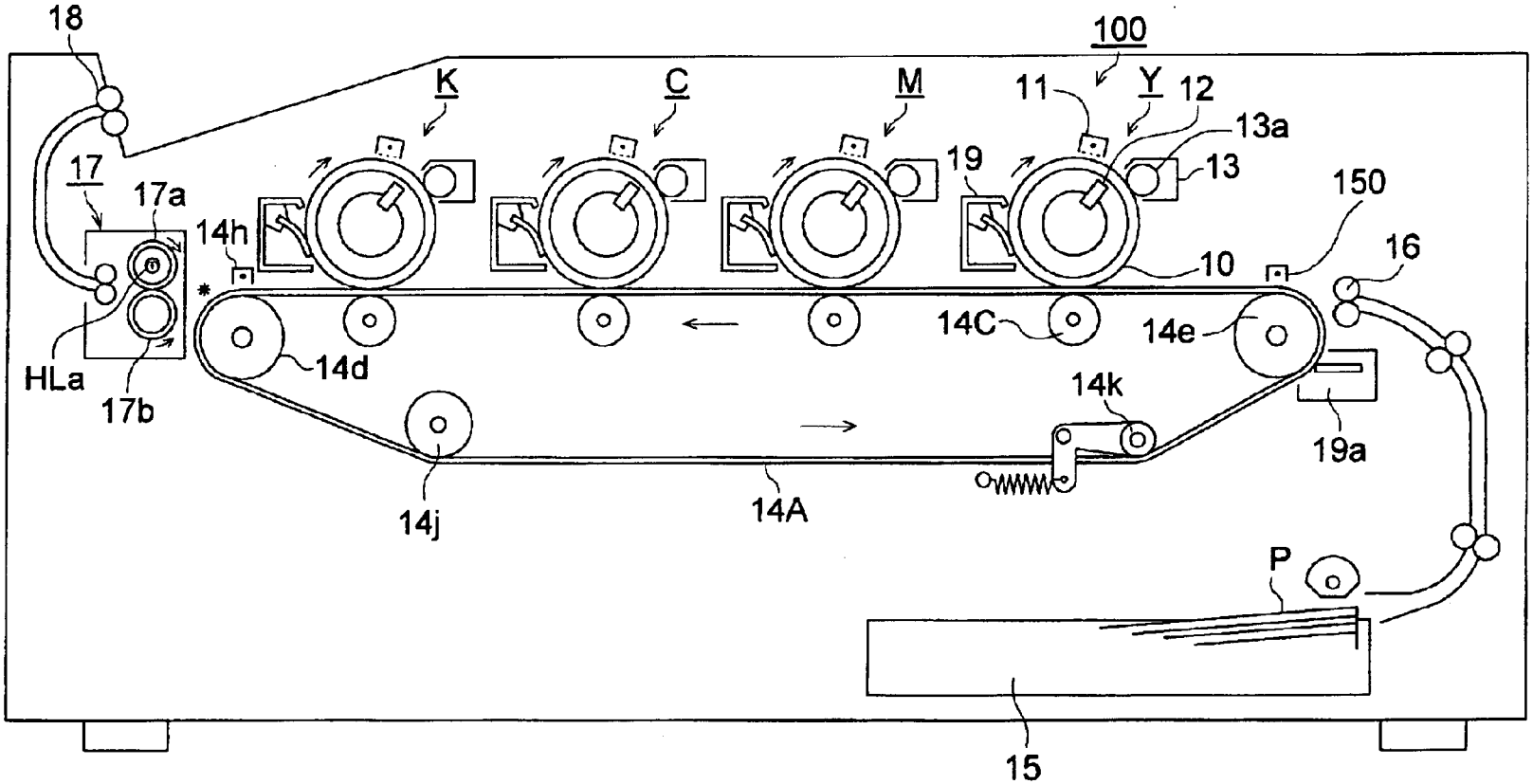
FIG. 6 is a cross-sectional view of the structure of a color image forming apparatus of the third example of the embodiment.
Figure 7:
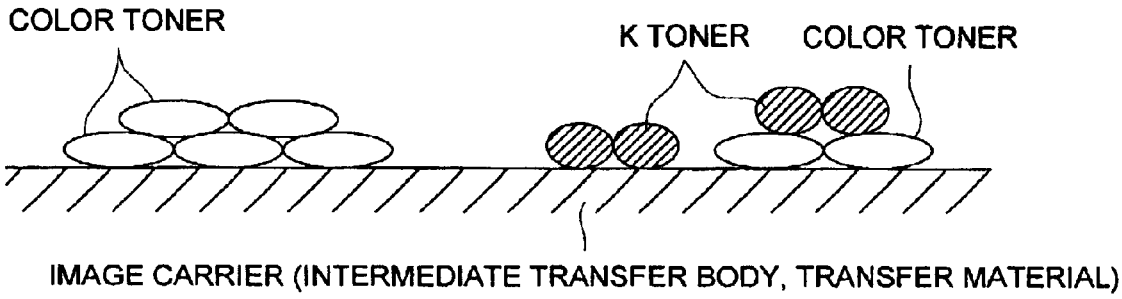
FIG. 7 is a schematic drawing showing a state of deposition of toner particles of this invention.

FIG. 4 is a cross-sectional view of the structure of a color image forming apparatus showing a first example of the embodiment of an image forming apparatus using a flattened toner of present invention, FIG. 5 is a cross-sectional view of the structure of a color image forming apparatus showing a second example of the embodiment of an image forming apparatus using a flattened toner of present invention, and FIG. 6 is a cross-sectional view of the structure of a color image forming apparatus showing a third example of the embodiment of an image forming apparatus using a flattened toner of present invention.

Color Image Forming Apparatus of First Example of Embodiment

In the image forming apparatus shown in FIG. 4, the photoreceptor drum 10 as an image forming member is composed of a light transmitting conductive layer and a photoconductive layer of an organic photosensitive layer (OPC) formed on the outer circumference of a cylindrical base member formed of a light transmitting material such as glass, transparent acrylic resin, or the like.

The photoreceptor drum 10 is rotated in the clockwise direction shown by the arrow mark in FIG. 4 by a driving force from a drive source (not shown in the drawing) with the light transmitting conductive layer grounded.

In present invention, only it is necessary that the exposure beam for image writing has a light quantity and a wavelength which are able to give a suitable contrast in accordance with the photo-decay characteristic (carrier generation by light) of the photoconductive layer positioned at the image forming point of the beam on the photoreceptor drum 10. Hence, it is unnecessary that the transmittance of the light transmitting base member of the photoreceptor drum in this example of the embodiment is 100%, and it is possible that the base member has such a characteristic as to absorb a certain degree of light quantity when the exposure beam passes it. Only it is essential that a suitable contrast can be obtained. For the material of the light transmitting base member, acrylic resin, in particular, one obtained by polymerizing methylmethacrylic acid monomer, is excellent in light transmitting characteristic, mechanical strength, precision in working, surface property, etc. and can be desirably used; various kinds of other light transmitting materials such as acrylic resin, fluorine-contained resin, polyester resin, polycarbonate resin, and polyethyleneterephthalate resin can be used. Further, it may be colored so long as it has a light transmitting property. For the light transmitting conductive layer, indium-tin oxide (ITO), tin oxide, lead oxide, indium oxide, copper iodide, and a metallic thin film keeping light transmitting capability composed of Au, Ag, Ni, Al, etc. can be used, and as regards the film forming method, a vacuum evaporation coating method, a reactive evaporation method, various kinds of sputtering methods, various kinds of CVD methods, a dip coating method, a spray coating method, etc. can be utilized. Further, for the photoconductive layer, various kinds of organic photoconductor (OPC) layer can be used.

The organic photosensitive layer as a photosensitive layer of a photoconductive layer is composed of two layers, which are a charge generating layer (CGL) composed mainly of a charge generating material (CGM) and a charge transporting layer (CTL) composed mainly of a charge transporting material, by the both of which the above-mentioned functions of the photoconductor are separately owned. An organic photosensitive layer of two-layer structure has a high durability as an organic photosensitive layer owing to its CTL being thick, and is suitable for present invention. In addition, the organic photosensitive layer may be composed of a single layer including a charge generating material (CGM) and a charge transporting material (CTM) in it; in the photosensitive layer composed of said single layer or the above-mentioned two layers, usually binder resin is contained.

A scorotron charging device 11 as a charging means, an exposure optical system 12 as an image writing means, and a developing device 13 as a developing means to be explained below are prepared for an image forming process for each of colors yellow (Y), magenta (M), cyan (C), and black (K); in this example of the embodiment, they are arranged in the order of Y, M, C, and K with respect to the rotating direction of the photoreceptor drum 10 shown by the arrow mark in FIG. 4.

The scorotron charging device 11 is mounted with its longitudinal direction made perpendicular to the moving direction of the photoreceptor drum 10 (perpendicular to the plane of paper surface in FIG. 4) facing, close to the photoreceptor drum 10, and by means of a control grid which is kept at a specified electric potential with respect to the above-mentioned conductive layer of the photoreceptor drum 10 and a discharging wire for example as a corona discharging electrode, it practices charging action by corona discharging of the same polarity as the toners (negative charging in this example of the embodiment), to give a uniform electric potential to the surface of the organic photosensitive layer of the photoreceptor drum 10. For the corona discharging electrode, also it is possible to use a sawtooth-shaped electrode or a needle-shaped electrode instead of the above-mentioned one.

Each exposure optical system 12 has a structure as a unit for exposure comprising a linear-shaped exposure device composed of a plurality of LED's (light emitting diodes) as light emitting elements for image exposure arranged in an array parallel to the axis of the photoreceptor drum 10, and a SELFOC lens as an image forming element of 1/1 magnification fitted to a holder. The exposure optical system 12 for each of the colors is fitted on the columnar holding body 20 as a holding member for the exposure system 12 and housed inside the base member of the photoreceptor drum 10. For the exposure device, a linear-shaped one composed of a plurality of light emitting elements such as FL (electroluminescense) elements, PL (plasma discharging) elements arranged in an array instead of the above-mentioned LED elements can be used.

The exposure optical system 12 is disposed inside the photoreceptor drum 10 with its exposure position on the photoreceptor drum 10 set at a position between the scorotron charging device 11 and the developing device 13 in the upstream side of the developing device 13 with respect to the rotating direction of the photoreceptor drum 10.

The exposure optical system 12 applies image exposure (image writing) to the uniformly charged photoreceptor drum 10 on the basis of the image data which have been transmitted from an external computer (not shown in the drawing), memorized in a memory, and subjected to an image processing, to form a latent image on the photoreceptor drum 10. For the wavelength of the emitted light from the light emitting device used in this example of the embodiment, one falling within a range of 680 to 900 nm, which is usually enough transmitted by the toners of Y, M, and C, is satisfactory; however, because image exposure (image writing) is practiced from the rear side, a wavelength shorter than this, which is not sufficiently transmitted by the color toners, may be used.

The developing device 13 contains inside a two-component (single-component is also possible) developer comprising a toner of yellow (Y), magenta (M), cyan (C), or black (K), and forms a toner image using a flattened toner composed of particles having an equivalent circle diameter d as viewed from the direction to make the projection area maximum of 5 to 10 ($\mu$m), a thickness t of 1 to 4 ($\mu$m), and a flattening ratio d/t represented by the ratio of the equivalent circle diameter d to the thickness t of 2 to 8 for the color toners of the developers of the three colors Y, M, and C, and the K toner of the developer of K; each developing device is equipped with a developing roller 13*a* as a cylindrical-shaped developer carrying member formed of a non-magnetic stainless steel or aluminum material having a thickness of 0.5 to 1.0 mm and an outer diameter of 15 to 25 mm.

In the developing region, the developing roller 13*a* is kept in non-contact with the photoreceptor drum 10 with a specified spacing of, for example 100 to 1000 $\mu$m, put in between by means of a rolling spacer (not shown in the drawing), and is rotated in the direction such that it moves with the photoreceptor drum 10 at the closest point; at the time of development, by applying a developing bias voltage composed of a direct current voltage of the same polarity as the toners (negative in this example of the embodiment) or a direct current voltage with an alternate current voltage superposed to the developing roller 13*a*, non-contact reverse development is carried out to deposit toner particles on the exposed area of the photoreceptor drum 10. As regards the precision of the developing spacing at this time, it is necessary to keep the variation of the spacing not greater than 20 $\mu$m or so in order to prevent uneven developing.

As explained in the above, the developing device 13 reversely develops a latent image on the photoreceptor drum 10 formed by the charging by means of the scorotron charging device 11 and the image exposure (image writing) by means of the exposure optical system 12, in a non-contact state, with a toner of the same polarity as the polarity of the charge on the photoreceptor drum 10 (Because the photoreceptor is charged negatively in this example of the embodiment, the toners have a negative polarity.).

In the following, the process of a color image forming method will be explained.

On the start of image formation, the photoreceptor drum 10 is rotated in the clockwise direction shown by the arrow mark in FIG. 4 by the starting of an image forming member driving motor (not shown in the drawing), and at the same time, the charging of the surface of the photoreceptor drum 10 to make it have a specified electric potential is started by the charging action of the scorotron charging device 11 for Y. After the surface of the photoreceptor drum 10 has obtained the specified electric potential, it is started in the exposure optical system for Y, the exposure (image writing) based on the electrical signal corresponding to the first color signal, that is, the image data of Y, and by the scanning rotation of the photoreceptor drum 10, an electrostatic latent image corresponding to the image of yellow (Y) of the original image is formed on the photosensitive layer lying on the surface of the photoreceptor drum 10. This latent image is reversely developed in a non-contact state by means of the developing device 13 for Y, and a toner image composed of yellow (Y) flattened toner particles is formed on the photoreceptor drum 10.

Next, after the photoreceptor drum 10 is given electric charge on the above-mentioned yellow (Y) toner image to have a specified surface potential by the charging action of the scorotron device 11 for M, it is carried out in the exposure system 12 for M, exposure (image writing) based on the electrical signal corresponding to the second color signal, that is, the image data of magenta (M), and a toner image composed of magenta (M) flattened toner particles is formed as superposed on the above-mentioned toner image composed of yellow (Y) flattened toner particles by non-contact reverse development by means of the developing device 13 for M.

By the similar process, by means of the scorotron charging device 11 for C, the exposure optical system 12 for C, and the developing device 13 for C, further a toner image composed of cyan (C) flattened toner particles corresponding to the third color signal, and by means of the scorotron charging device 11 for K, the exposure optical system 12 for K, and the developing device 13 for K, a toner image composed of black (K) flattened toner particles corresponding to the fourth color signal are formed sequentially as superposed on the others; thus, within one rotation of the photoreceptor drum 10, a color toner image with component color toner images composed of flattened toner particles superposed is formed on its circumferential surface. Now, on the photoreceptor drum 10, there exists a color toner image composed of flattened toner particles of Y, M, C, and K.

In this way, in this example of the embodiment, the exposure for the organic photosensitive layer of the photoreceptor drum 10 by means of each of the exposure optical systems 12 for Y, M, C, and K is carried out from the inside of the photoreceptor drum 10 through the light transmitting base member. Hence, it is possible that image exposure corresponding to each of the second, third, fourth color signals is not intercepted by the toner images which have been formed before, to form an electrostatic latent image. However, exposure may be carried out from the outside of the photoreceptor drum 10, although it is done from the inside of the photoreceptor drum 10 in this example of the embodiment.

On the other hand, a recording paper sheet P, which is used as a transfer material (recording material), is conveyed out from a paper feed cassette 15 as a transfer material containing means by a conveying-out roller, is conveyed by conveyance rollers to be fed to the timing rollers 16 as a transfer material feeding means.

The recording paper sheet P is synchronized with the color toner image having component color toner images composed of flattened toner particles superposed carried on the photoreceptor drum 10, by the driving of the timing rollers 16, and is fed to the transfer region as it is attracted to the conveyance belt 14A by the charging by means of the paper charging device 150 as a transfer material charging means. The recording paper sheet P, which has been conveyed by the conveyance belt 14A as sticking fast to it, accepts the component color toner images composed of flattened toner particles superposed which are transferred from on the photoreceptor drum 10 in the transfer region all at a time by means of a transfer roller 14C as a transfer means, to which a voltage of the reverse polarity to the toners (positive polarity in this embodiment) is applied. Now, on the recording paper sheet P, there is present a color toner image composed of flattened toner particles of K, C, M, and Y. At this time, the K toner particles lying in the uppermost layer on the photoreceptor drum 10 are transferred onto the recording paper sheet P with a highest transfer efficiency.

The recording paper sheet P, having superposed component color toner images composed of flattened toner particles transferred on it, is subjected to charge eliminating process by an AC charge eliminating device for paper separation 14*h* as a transfer material separating means, and is separated from the conveyance belt 14A, to be fed to a fixing device 17.

The fixing device 17 is composed of a fixing roller 17*a* as a fixing roller member (a roller member which is provided at the side to face a toner image on the transfer material) for fixing the superposed component color toner images composed of flattened toner particles, and a pressing roller 17*b* as a pressing roller member (a roller member which is provided at the side to face the transfer material surface having no toner image) provided opposite to the fixing roller 17*a*, and at the central part of the inside of the fixing roller 17*a*, there is provided a halogen lamp HLa as a heating means having a heat generating filament (with no sign attached in the drawing) as a heat generating source.

The recording paper sheet P is gripped by the nip portion N which is formed between the fixing roller 17*a* and the pressing roller 17*b*, and by the application of heat and pressure, the superposed component color toner images composed of flattened toner particles are fixed; then, the recording paper sheet P is conveyed by discharging rollers 18, to be discharged onto a tray provided on the upper side of the apparatus.

Toner particles, which remain on the circumferential surface of the photoreceptor drum 10 after transfer processing, are removed by a cleaning blade provided in the photoreceptor cleaning device 19 as an image forming member cleaning means. The photoreceptor drum 10, which has been cleaned by the removal of the residual toner particles, is uniformly charged by the scorotron charging device 11, and enters the next cycle.

The image forming method described in any one of the structures (1) to (6) uses a flattened toner which comes within the purview of the condition (1) or (2) described below concerning the relation between the K toner particles in the upper layer and the color toner particles of Y, M, and C in the lower layers when a color toner image composed of Y, M, C, and K toner layers superposed is formed on the photoreceptor drum 10 as an image forming member in the color image forming apparatus shown in FIG. 4:

(1) The thickness t of the color toner particles is smaller than the thickness $t_K$ of the K toner particles.

(2) The flattening ratio d/t of the color toner particles is larger than the flattening ratio $d_K/t_K$ of the K toner particles.

By using color toners and a K toner satisfying the condition $t<t_K$, a toner layer is formed to have a small thickness mainly in respect of a picture image area where the color toner particles are deposited as superposed; therefore, a high-quality image like an image produced by printing can be obtained. On the other hand, in respect of letter image area where the K toner is used, because a certain degree of thickness can be secured, a letter image having an excellent sharpness is to be formed.

By using color toners and a K toner satisfying the condition $d/t>d_K/t_K$, toner particles are deposited layer-wise as laid down mainly in respect of a picture image area where the color toner particles are deposited as superposed; therefore, the surface of a transfer material can be covered with a small amount of toner, color reproducibility is excellent, and toner consumption can be reduced. On the other hand, in respect of a letter image area where the K toner is used, because a toner layer piled up to some extent is formed, a letter image having an excellent sharpness is to be formed.

The image forming method described in any one of the structures (7) to (12) uses a flattened toner which comes within the purview of the condition (1) or (2) described below concerning the relation between the K toner particles in the upper layer and the color toner particles of Y, M, and C in the lower layers when a color toner image composed of Y, M, C, and K toner layers superposed is formed on the photoreceptor drum 10 as an image forming member in the color image forming apparatus shown in FIG. 4:

(1) The equivalent circle diameter d of the color toner particles is larger than the equivalent circle diameter $d_K$ of the K toner particles.

(2) The equivalent circle diameter d of the color toner particles is larger than the equivalent circle diameter $d_K$ of the K toner particles, and the thickness t of the color toner particles is smaller than the thickness $t_K$ of the K toner particles.

By using color toners and a K toner satisfying the condition $d>d_K$, mainly in respect of a picture image area where the color toner particles are deposited as superposed, developing performance is stabilized even in a highlight area where toner deposition amount is small; therefore, a high-quality color image like an image produced by printing having an excellent gradation characteristic can be obtained. Further, in respect of a letter image area where the K toner is mainly used, because a toner image having a sharp edge and a high fidelity to the latent image is formed, a letter image having an excellent resolution and sharpness is to be formed.

By using color toners and a K toner satisfying the conditions $d>d_K$, and $t<t_K$, toner particles are deposited layer-wise as laid down mainly in respect of a picture image area where the color toner particles are deposited as superposed; therefore, the surface of a transfer material can be covered with a small amount of toner, color reproducibility is excellent, and toner consumption can be reduced. On the other hand, in respect of a letter image area where the K toner is used, because a toner layer piled up to some extent is formed, a letter image having an excellent sharpness is to be formed.

Color Image Forming Apparatus of Second Example of Embodiment

The image forming apparatus shown in FIG. 5 is a color image forming apparatus of a tandem type using a transfer belt 14*a* as an intermediate transfer member. Its structure is as follows: Around the transfer belt 14*a* as an intermediate transfer member, there are provided four sets of process units 100 composed of yellow (Y), magenta (M), cyan (C), and black (K) units in the above-mentioned order from the upstream side in the rotating direction of the transfer belt 14*a*, and in each of the process units 100, a toner image of Y, M, C, or K using a flattened toner is formed; the toner images using such flattened toners are transferred onto the transfer belt 14*a* as superposed on one another, and the transferred superposed color toner images are further transferred onto a recording paper sheet P as a transfer material all at a time, to be fixed on the recording paper sheet P, which is then discharged to the outside of the apparatus.

The four sets of process units, each of which is composed of a photoreceptor drum 10 as an image forming member, a scorotron charging device 11 as a charging means, an exposure optical system 12 as an image writing means, a developing device 13 as a developing means for forming a toner image using a flattened toner composed of particles having an equivalent circle diameter d as viewed from the direction to make the projection area maximum of 5 to 10 ($\mu$m), a thickness t of 1 to 4 ($\mu$m), and a flattening ratio d/t represented by the ratio of the equivalent circle diameter d to the thickness t of 2 to 8, for the color toners of the developers of the three colors Y, M, and C, and desirably for the K toner of the developer of K, and a photoreceptor cleaning device 19 as an image forming member cleaning means, all have a common structure; therefore, one set of them will be explained.

The photoreceptor drum 10 as an image forming member has a conductive layer and a photoconductive layer of an organic photosensitive layer (OPC) formed on the outer circumference of a cylindrical base member formed of a light transmitting member such as glass or transparent acrylic resin.

The photoreceptor drum 10 is rotated in the counter-clockwise direction shown by the arrow mark by a driving force from a driving source (not shown in the drawing) or in compliance with the motion of the transfer belt 14*a*, with the light transmitting conductive layer grounded.

11 denotes a scorotron charging device as a charging means, and is mounted facing, close to the photoreceptor drum 10 with its lengthwise side directed towards the direction perpendicular to the moving direction of the photoreceptor drum 10, and makes the surface of the photoreceptor drum 10 have a uniform electric potential by the corona discharging of the same polarity as the toners.

12 denotes an exposure optical system as an image writing means for carrying out image exposure (image writing) for Y, M, C, or K on the basis of image data of the corresponding color, has a structure of an exposure unit having a linear exposure device made up of, for example, a plurality of LED's (light emitting diodes) arranged in an array parallel to the axis of the photoreceptor drum 10 and a SELFOC lens as an image forming element of 1/1 magnification mounted on a holder, is disposed inside the photoreceptor drum 10, and is a scanning optical system which carries out scanning parallel to the rotary axis of the photoreceptor drum 10. A latent image is formed through an image exposure (image writing) applied to the uniformly charged surface of the photoreceptor drum 10 by the exposure optical system 12.

Near the circumference of the photoreceptor drum 10, there is provided the developing device 13 containing a single-component developer using a negatively charged toner of present invention or a two-component developer composed of a toner of present invention and a magnetic carrier inside, and carries out reverse development by means of a developing roller 13*a* as a developer carrying member rotating with the developer held on it.

A layer of a single-component developer composed of a toner only, or a layer of a two-component developer composed of carrier beads composed of a ferrite core coated with insulating resin and toner particles mixed together is regulated to have a layer thickness of 0.1 to 0.6 mm on the developer roller 13*a* and is conveyed to the developing region.

The spacing between the developing roller 13*a* and the photoreceptor drum 10 is made to be 0.2 mm to 1.0 mm, which is larger than the layer thickness of the developer, and a developing bias voltage composed of a direct current voltage with an alternate current voltage superposed is applied between the developing roller 13*a* and the photoreceptor drum 10. Because the charge of the toner is of the same polarity as the direct current voltage (negative), flattened toner particles which are given a chance to leave the developing roller 13*a* by the alternate current voltage are not deposited on the unexposed area having an absolute value of electric potential larger than the absolute value of the direct current voltage, but on the exposed area having a low absolute value of electric potential, toner particles of an amount in accordance with the potential difference are deposited to make the latent image visible (form a toner image composed of flattened toner particles). In addition, also it is appropriate to apply only a direct current voltage between the developing roller 13*a* and the photoreceptor drum 10, and there is no trouble in doing the development in a contact way. This toner image composed of flattened toner particles is transferred onto the transfer belt 14*a* to be explained later at the primary transfer site.

The photoreceptor cleaning device 19 as an image forming member cleaning means is provided at the downstream side of the primary transfer site to be described later with respect to the rotating direction of the photoreceptor drum 10, and removes the residual toner particles after primary transfer on the photoreceptor drum 10 by a cleaning blade.

The transfer belt 14*a*, which the four process units 100 for the respective colors Y, M, C, and K are arranged side by side facing, is an endless belt having a volume resistivity of $10^8$–$10^{15}$ Ω·cm and a sheet resistance of $10^8$–$10^{15}$ Ω/square; it is a seamless belt of two-layer structure composed of a semi-conductive film base member having a thickness of 0.1 to 0.5 mm formed of a conductive substance dispersed in an engineering plastic material such as modified polyimide, thermosetting polyimide, copolymer of ethylene and tetrafluoroethylene, polyvinylidene fluoride, or a nylon alloy and a toner filming preventing layer of fluorine-contained resin having a thickness of 5 to 50 μm coated on the outer surface of the above-mentioned semi-conductive film desirably. For the base member of the transfer belt 14*a*, instead of the above-mentioned, a semi-conductive rubber belt having a thickness of 0.5 to 2.0 mm, which is composed of silicone rubber, urethane rubber, or the like and a conductive material dispersed in it, can be also used. The transfer belt 14*a* is entrained about a driving roller 14*d*, a driven roller 14*e*, a backup roller 14*j*, and a tension roller 14*k*, and during image formation, the driving roller 14*d* is rotated by the driving force of a drive motor (not shown in the drawing); at the transfer site for each of the colors, the transfer belt 14*a* is pressed to the photoreceptor drum 10 by a primary transfer roller 14*c* as a primary transfer means, and the transfer belt 14*a* is rotated in the direction shown by the arrow mark in the drawing.

The primary transfer roller 14*c* made up of a roller member as a primary transfer means for each color is provided opposite to the photoreceptor drum 10 with the transfer belt 14*a* held in between, to form a transfer region for each color between the transfer belt 14*a* and the photoreceptor drum 10 for each color. By applying a direct current voltage of the reverse polarity to the toners (positive polarity in this example of the embodiment) to the primary transfer roller 14*c* for each color, to form a transfer electric field in the transfer region, the toner image on the photoreceptor drum 10 for each color is transferred onto the transfer belt 14*a*.

In the following, the process of a color image forming method will be explained.

On the start of the image recording, the driving roller 14*d* is rotated by the starting of an intermediate transfer member driving motor (not shown in the drawing), and the transfer belt 14*a* is rotated in the direction shown by the arrow mark in the drawing. Further, the photoreceptor drum 10 of the process unit 100 for yellow (Y) is rotated in the direction shown by the arrow mark in the drawing by the starting of a photoreceptor drum driving motor (not shown in the drawing), and at the same time, by the charging action of the scorotron charging device 11 for Y, the charging to make the photoreceptor drum 10 for Y have a specified electric potential is started.

After the photoreceptor drum 10 for Y has obtained the specified surface potential, image writing based on the electrical signal corresponding to the image data of Y outputted from the control section is started by the exposure optical system 12 for Y, and an electrostatic latent image corresponding to the image of Y is formed on the surface of the photoreceptor drum 10 for Y.

The above-mentioned latent image of Y is developed reversely in a contact or non-contact state by the developing device 13 for Y, and a toner image composed of flattened toner particles of Y is formed in response to the rotation of the photoreceptor drum 10 for Y.

The toner image composed of flattened toner particles of Y formed on the photoreceptor drum 10 for Y as an image forming member by the above-mentioned image forming process is transferred onto the transfer belt 14*a* in the transfer region for Y by the primary transfer roller 14*c* for Y.

At the same time as or a little later than the starting of the process unit 100 for Y, the photoreceptor drum 10 of the process unit 100 for magenta (M) is rotated in the direction shown by the arrow mark in the drawing, and at the same time, the charging to make the surface of the photoreceptor drum 10 for M have a specified electric potential is started by the charging action of the scorotron charging device 11 for M.

After the photoreceptor drum 10 for M has obtained the specified surface potential, image writing based on the electrical signal corresponding to the image data of M is started in synchronism with the toner image of Y by the exposure optical system 12 for M, and an electrostatic latent image corresponding to the image of M is formed on the surface of the photoreceptor drum 10 for M.

The above-mentioned latent image of M is reversely developed in a contact or non-contact state by the developing device 13 for M, and in response to the rotation of the photoreceptor drum 10 for M, a toner image of M composed of the flattened toner particles of M is formed.

The toner image composed of the flattened toner particles of M, which has been formed on the photoreceptor drum 10 for M as an image forming member by the above-mentioned image forming process, is transferred onto the toner image composed of the flattened toner particles of Y on the transfer belt 14*a* in the transfer region for M by the primary transfer roller 14*c* for M.

Next, on the transfer belt 14*a*, the toner image composed of the flattened toner particles of C corresponding to the image data of C, which has been formed on the photoreceptor drum 10 for C in synchronism with the superposed toner images of Y and M by the process unit 100 for magenta (C), is transferred onto the superposed toner images respectively composed of the flattened toner particles of Y and M in the transfer region for C by the primary transfer roller 14*c* for C, to form superposed toner images.

In the same way, the toner image of K composed of the flattened toner particles of K corresponding to the image data of K, which has been formed on the photoreceptor drum 10 for K in synchronism with the superposed toner images of Y, M, and C by the process unit 100 using the flattened toner of black (K), is transferred onto the above-mentioned superposed toner images respectively composed of the flattened toner particles of Y, M, and C in the transfer region for K by the primary transfer roller 14*c* for K, to form superposed toner images; now, superposed color toner images, which are composed of the flattened toner particles of Y, M, C, and K respectively, are present on the transfer belt 14*a*.

The residual toner particles remaining on the circumferential surface of the photoreceptor drum 10 for each color after transfer are removed by the cleaning blade of the photoreceptor cleaning device 19 as an image forming member cleaning means for each color.

In synchronism with the formation of the superposed color toner images on the transfer belt 14*a*, a recording paper sheet P as a transfer material is conveyed from a paper feed cassette 15 as a transfer material containing means, through a timing roller 16 as a transfer material feeding means, to the transfer region of a secondary transfer roller 14*g* as a second transfer means; then, by the secondary transfer roller 14*g* to which a direct current voltage of the reverse polarity to the toners is applied, the superposed color toner images composed of the flattened toner particles on the transfer belt 14*a* are transferred onto the recording paper sheet P all at a time. Now, superposed color toner images, which are respectively composed of the flattened toner particles of K, C, M, and Y, are present on the recording paper sheet P. At this time, the K toner image is transferred onto the recording paper sheet P with a highest transfer efficiency.

The recording paper sheet P, to which superposed color toner images composed of the flattened toner particles have been transferred, is separated from the transfer belt 14*a*, and is conveyed to a fixing device 17.

The fixing device 17 is composed of a fixing roller 17*a* as a fixing roller member (a roller member which is provided at the side to face a toner image on the transfer material) for fixing superposed color toner images, and a pressing roller 17*b* as a pressing roller member (a roller member which is provided at the side to face the surface of the transfer material having no toner image) provided opposite to the fixing roller 17*a*. At the central part of the inside of the fixing roller 17*a*, there is provided a halogen lamp HLa as a heating means having a heat generating filament as a heat generating source.

The superposed color toner images composed of the flattened toner particles are fixed between the fixing roller 17*a* and the pressing roller 17*b* by the application of heat and pressure; then, the recording paper sheet P is conveyed by discharging rollers 18, to be discharged onto a tray provided on the upper side of the apparatus.

Residual toner particles, which remain on the circumferential surface of the transfer belt 14*a* after transfer processing, are removed by an intermediate transfer member cleaning device 19*a* as an intermediate transfer member cleaning means provided opposite to the driven roller 14*e* with the transfer belt 14*a* held in between.

The image forming method described in any one of the structures (1) to (6) uses a flattened toner which comes within the purview of the condition (1) or (2) described below concerning the relation between the K toner particles in the upper layer and the color toner particles of Y, M, and C in the lower layers, when a color toner image composed of Y, M, C, and K toner layers superposed is formed on the transfer belt 14*a* as an intermediate transfer member in the color image forming apparatus shown in FIG. 5:

(1) The thickness t of the color toner particles is smaller than the thickness $t_K$ of the K toner particles.

(2) The flattening ratio d/t of the color toner particles is larger than the flattening ratio $d_K/t_K$ of the K toner particles.

By using color toners and a K toner satisfying the condition $t<t_K$, a toner layer is formed to have a small thickness mainly in respect of a picture image area where the color toner particles are deposited as superposed; therefore, a high-quality image like an image produced by printing can be obtained. On the other hand, in respect of letter image area where the K toner is used, because a certain degree of thickness can be secured, a letter image having an excellent sharpness is to be formed.

By using color toners and a K toner satisfying the condition $d/t>d_K/t_K$, toner particles are deposited layer-wise as laid down mainly in respect of a picture image area where the color toner particles are deposited as superposed; therefore, the surface of a transfer material can be covered with a small amount of toner, color reproducibility is excellent, and toner consumption can be reduced. On the other hand, in respect of a letter image area where the K toner is used, because a toner layer piled up to some extent is formed, a letter image having an excellent sharpness is to be formed.

The image forming method described in any one of the structures (7) to (12) uses a flattened toner which comes within the purview of the condition (1) or (2) described below concerning the relation between the K toner particles in the upper layer and the color toner particles of Y, M, and C in the lower layers, when a color toner image composed of Y, M, C, and K toner layers superposed is formed on the transfer belt 14*a* as an intermediate transfer member in the color image forming apparatus shown in FIG. 5:

(1) The equivalent circle diameter d of the color toner particles is larger than the equivalent circle diameter $d_K$ of the K toner particles.

(2) The equivalent circle diameter d of the color toner particles is larger than the equivalent circle diameter $d_K$ of the K toner particles, and the thickness t of the color toner particles is smaller than the thickness $t_K$ of the K toner particles.

By using color toners and a K toner satisfying the condition $d>d_K$, mainly in respect of a picture image area where the color toner particles are deposited as superposed, developing performance is stabilized even in a highlight area where toner deposition amount is small; therefore, a high-quality color image like an image produced by printing having an excellent gradation characteristic can be obtained. Further, in respect of a letter image area where the K toner is mainly used, because a toner image having a sharp edge and a high fidelity to the latent image is formed, a letter image having an excellent resolution and sharpness is to be formed.

By using color toners and a K toner satisfying the conditions $d>d_K$, and $t<t_K$, toner particles are deposited layer-wise as laid down mainly in respect of a picture image area where the color toner particles are deposited as superposed; therefore, the surface of a transfer material can be covered with a small amount of toner, color reproducibility is excellent, and toner consumption can be reduced. On the other hand, in respect of a letter image area where the K toner is used, because a toner layer piled up to some extent is formed, a letter image having an excellent sharpness is to be formed.

Color Image Forming Apparatus of Third Example of Embodiment

The image forming apparatus shown in FIG. 6 is a color image forming apparatus of a tandem type using a conveyance belt 14A as a conveying means for a transfer material. Its structure is as follows: Around the conveyance belt 14A, there are provided four sets of process units 100 composed of yellow (Y), magenta (M), cyan (C), and black (K) units in the above-mentioned order from the upstream side in the rotating direction of the conveyance belt 14A, and in each of the process units 100, a toner image of Y, M, C, or K using a flattened toner is formed; the toner images composed of the respective flattened toners are successively transferred onto a recording paper sheet P, which is being conveyed as attracted onto the conveyance belt 14A, to become superposed on one another, and the superposed color toner images on the recording paper sheet P are fixed and the sheet is discharged to the outside of the apparatus.

The four sets of process units, each of which is composed of a photoreceptor drum 10 as an image forming member, a scorotron charging device 11 as a charging means, an exposure optical system 12 as an image writing means, a developing device 13 as a developing means for forming a toner image using a flattened toner composed of particles having an equivalent circle diameter d as viewed from the direction to make the projection area maximum of 5 to 10 ($\mu$m), a thickness t of 1 to 4 ($\mu$m), and a flattening ratio d/t represented by the ratio of the equivalent circle diameter d to the thickness t of 2 to 8, for the color toners of the developers of the three colors Y, M, and C, and desirably for the K toner of the developer of K, and a photoreceptor cleaning device 19 as an image forming member cleaning means, all have a common structure; therefore, one set of them will be explained.

The photoreceptor drum 10 as an image forming member has a light transmitting conductive layer and a photoconductive layer of an organic photosensitive layer (OPC) formed on the outer circumference of a cylindrical base member formed of a light transmitting member such as glass or transparent acrylic resin.

The photoreceptor drum 10 is rotated in the counter-clockwise direction shown by the arrow mark, by a driving force from a driving source (not shown in the drawing), or in compliance with the motion of the transfer belt 14*a*, with the light transmitting conductive layer grounded.

Numeral 11 denotes a scorotron charging device as a charging means, and is mounted facing, close to the photoreceptor drum 10 with its lengthwise side directed towards the direction perpendicular to the moving direction of the photoreceptor drum 10, and charges the surface of the photoreceptor drum 10 to make it have a uniform electric potential by the corona discharging of the same polarity as the toners.

Numeral 12 denotes an exposure optical system as an image writing means for carrying out image exposure (image writing) for K, C, M, or Y on the basis of image data of the corresponding color, has a structure of an exposure unit having a linear exposure device made up of, for example, a plurality of LED's (light emitting diodes) arranged in an array parallel to the axis of the photoreceptor drum 10 and a SELFOC lens as an image forming element of 1/1 magnification mounted on a holder, is disposed inside the photoreceptor drum 10, and is a scanning optical system which carries out scanning parallel to the rotary axis of the photoreceptor drum 10. A latent image is formed through an image exposure (image writing) applied to the uniformly charged photoreceptor drum 10 by the exposure optical system 12.

Near the circumference of the photoreceptor drum 10, there is provided the developing device 13 containing a single-component developer using a negatively charged flattened toner of present invention or a two-component developer composed of a flattened toner of present invention and a magnetic carrier inside, and carries out reverse development by means of a developing roller 13*a* as a developer carrying member rotating with the developer held on it.

A layer of a single-component developer composed of toner particles only or a layer of a two-component developer composed of carrier beads composed of a ferrite core coated with insulating resin and toner particles mixed together is regulated to have a layer thickness of 0.1 to 0.6 mm on the developer roller 13*a* and is conveyed to the developing region.

The spacing between the developing roller 13*a* and the photoreceptor drum 10 in the development region is made to be 0.2 mm to 1.0 mm, which is larger than the layer thickness of the developer, and a developing bias voltage composed of a direct current voltage with an alternate current voltage superposed is applied between the developing roller 13*a* and the photoreceptor drum 10. Because the charge of the toner is of the same polarity as the direct current voltage (negative), flattened toner particles which are given a chance to leave the developing roller 13*a* by the alternate current voltage are not deposited on the unexposed area having an absolute value of electric potential larger than the absolute value of the direct current voltage, but on the exposed area having a low absolute value of electric potential, toner particles of an amount in accordance with the potential difference are deposited to make the latent image visible (to form a toner image composed of flattened toner particles). In addition, also it is appropriate to apply only a direct current voltage between the developing roller 13*a* and the photoreceptor drum 10, and there is no trouble in doing the development in a contact manner. This toner image composed of flattened toner particles is transferred onto a sheet of recording paper P at a transfer site to be described later.

The photoreceptor cleaning device 19 as an image forming member cleaning means is provided at the downstream side of the transfer site with respect to the rotating direction of the photoreceptor drum 10, and removes the residual toner particles after transfer on the photoreceptor drum 10 by a cleaning blade.

The conveyance belt 14A, which the four process units 100 for the respective colors Y, M, C, and K are arranged side by side facing, is an endless belt having a volume resistivity of $10^8$–$10^{15}$ Ω·cm and a sheet resistance of $10^8$–$10^{15}$ Ω/square; it is a seamless belt of two-layer structure composed of a semi-conductive film base member having a thickness of 0.1 to 0.5 mm formed of a conductive substance dispersed in an engineering plastic material such as modified polyimide, thermosetting polyimide, copolymer of ethylene and tetrafluoroethylene, polyvinylidene fluoride, or a nylon alloy and a toner filming preventing layer of fluorine-contained resin having a thickness of 5 to 50 μm coated on the outer surface of the above-mentioned semi-conductive film desirably. For the base member of the conveyance belt 14A, instead of the above-mentioned, a semi-conductive rubber belt having a thickness of 0.5 to 2.0 mm, which is composed of silicone rubber, urethane rubber, or the like and a conductive material dispersed in it, can be also used. The conveyance belt 14A is entrained about a driving roller 14*d*, a driven roller 14*e*, a backup roller 14*j*, and a tension roller 14*k*, and during image formation, the driving roller 14*d* is rotated by the driving force of a drive motor (not shown in the drawing); at the transfer site for each of the colors, the conveyance belt 14A is pressed to the photoreceptor drum 10 by a transfer roller 14C as a transfer means, and the conveyance belt 14A is rotated in the direction shown by the arrow mark in the drawing.

The transfer rollers 14C, which are respectively transfer means for Y, M, C, and K, are provided opposite to the photoreceptor drums 10 with the conveyance belt 14A held in between, and between the conveyance belt 14A and each of the photoreceptor drums 10, each transfer region (with no sign attached in the drawing) is formed. By the application of a direct current voltage of the polarity reverse to the toners (positive in this example of the embodiment) to each transfer roller 14C to form a transfer electric field in the transfer region, toner images on the photoreceptor drums for Y, M, C, and K are transferred onto a recording paper sheet P.

In the following, the process of a color image forming method will be explained.

On the start of the image recording, the driving roller 14*d* is rotated by the starting of a driving motor (not shown in the drawing), and the conveyance belt 14A is rotated in the direction shown by the arrow mark in the drawing. Further, the photoreceptor drum 10 of the process unit 100 for yellow (Y) is rotated in the direction shown by the arrow mark in the drawing by the starting of a photoreceptor drum driving motor (not shown in the drawing), and at the same time, by the charging action of the scorotron charging device 11 for Y, the charging to make the surface of the photoreceptor drum 10 for Y have a specified electric potential is started.

After the photoreceptor drum 10 for Y has obtained the specified surface potential, image writing based on the electrical signal corresponding to the image data of Y outputted from the control section is started by the exposure optical system 12 for Y, and an electrostatic latent image corresponding to the image of Y is formed on the surface of the photoreceptor drum 10 for Y.

The above-mentioned latent image of Y is developed reversely in a contact or non-contact state by the developing device 13 for Y, and a toner image composed of flattened toner particles of Y is formed in response to the rotation of the photoreceptor drum 10 for Y.

Simultaneously with the formation of a toner image composed of flattened toner particles on the photoreceptor drum 10 for Y, a recording paper sheet P as a transfer material is conveyed out by a conveying-out roller from a paper feed cassette 15 as a transfer material containing means, is conveyed through conveyance rollers to a timing roller 16 as a transfer material feeding means, and by the driving of the timing roller 16, it is fed to the transfer region for Y in synchronism with the toner image composed of the flattened toner particles of Y to be formed on the photoreceptor drum 10 for Y as it is attracted to the conveyance belt 14A by the charging means of the paper charging device 150 as a transfer material charging means.

The toner image of Y formed on the photoreceptor drum 10 for Y is transferred onto the recording paper sheet P in the transfer region for Y by the transfer roller 14C for Y.

A little later than the starting of the process unit 100 for Y, the photoreceptor drum 10 of the process unit 100 for magenta (M) is rotated in the direction shown by the arrow mark in the drawing, and at the same time, the charging to make the surface of the photoreceptor drum 10 for M have a specified electric potential is started by the charging action of the scorotron charging device 11 for M.

After the photoreceptor drum 10 for M has obtained the specified surface potential, image writing based on the electrical signal corresponding to the image data of M is started in synchronism with the toner image of Y by the exposure optical system 12 for M, and an electrostatic latent image corresponding to the image of M of the original image is formed on the surface of the photoreceptor drum 10 for M.

The above-mentioned latent image of M is reversely developed in a contact or non-contact state by the developing device 13 for M, and in response to the rotation of the photoreceptor drum 10 for M, a toner image of M composed of the flattened toner particles of M is formed.

The toner image composed of the flattened toner particles of M, which has been formed on the photoreceptor drum 10 for M, is transferred onto the toner image composed of the flattened toner particles of Y on the recording paper sheet P to become superposed on it in the transfer region for M by the transfer roller 14M for M.

Next, on the conveyance belt 14A, the toner image composed of the flattened toner particles of C corresponding to the image data of C, which has been formed on the photoreceptor drum 10 for C in synchronism with the superposed toner images of Y and M by the process unit 100 for magenta (C), is transferred onto the superposed toner images respectively composed of the flattened toner particles of Y and M in the transfer region for C by the transfer roller 14C for C, to form superposed toner images.

In the same way, the toner image of K composed of the flattened toner particles of K corresponding to the image data of K, which has been formed on the photoreceptor drum 10 for K in synchronism with the superposed toner images of Y, M, and C by the process unit 100 using the flattened toner of black (K), is transferred onto the above-mentioned superposed toner images respectively composed of the flattened toner particles of Y, M, and C on the above-mentioned recording paper sheet P, in the transfer region for K by the transfer roller 14K for K, to form superposed toner images; now, superposed color toner images, which are composed of the flattened toner particles of Y, M, C, and K respectively, are present on the recording paper sheet P.

The residual toner particles remaining on the circumferential surface of the photoreceptor drum 10 for each color after transfer are removed by the cleaning blade of the photoreceptor cleaning device 19 as an image forming member cleaning means for each color.

The recording paper sheet P, having color toner images composed of the flattened toner particles formed on the surface, with its charge eliminated by the charge eliminating device for paper separation 14*h*, is separated from the conveyance bet 14A, and is conveyed to a fixing device 17 as a fixing means.

The fixing device 17 is composed of a fixing roller 17*a* as a fixing roller member (a roller member which is provided at the side to face a toner image on the transfer material) for fixing superposed color toner images, and a pressing roller 17*b* as a pressing roller member (a roller member which is provided at the side to face the surface of the transfer material having no toner image) provided opposite to the fixing roller 17*a*. At the central part of the inside of the fixing roller 17*a*, there is provided a halogen lamp HLa as a heating means having a heat generating filament as a heat generating source.

The superposed color toner images composed of the flattened toner particles are fixed between the fixing roller 17*a* and the pressing roller 17*b* by the application of heat and pressure; then, the recording paper sheet P is conveyed by discharging rollers 18, to be discharged onto a tray provided on the upper side of the apparatus.

Residual toner particles, which have been transferred onto the conveyance belt 14A as occasion demands or unnecessarily and remain on the circumferential surface of the conveyance belt 14A after the transfer processing to the recording paper sheet P, are removed by a cleaning blade provided in a belt cleaning device 19*a* as a cleaning means for the conveyance belt 14A provided opposite to the driven roller 14*e* with the conveyance belt 14A held in between.

The image forming method described in any one of the structures (1) to (6) uses a flattened toner which comes within the purview of the condition (1) or (2) described below concerning the relation between the K toner particles in the upper layer and the color toner particles of Y, M, and C in the lower layers, when a color toner image composed of Y, M, C, and K toner layers superposed is formed on a recording paper sheet P as a transfer material in the color image forming apparatus shown in FIG. 6:

(1) The thickness t of the color toner particles is smaller than the thickness $t_K$ of the K toner particles.

(2) The flattening ratio d/t of the color toner particles is larger than the flattening ratio $d_K/t_K$ of the K toner particles.

By using color toners and a K toner satisfying the condition $t<t_K$, a toner layer is formed to have a small thickness mainly in respect of a picture image area where the color toner particles are deposited as superposed; therefore, a high-quality image like an image produced by printing can be obtained. On the other hand, in respect of letter image area where the K toner is used, because a certain degree of thickness can be secured, a letter image having an excellent sharpness is to be formed.

By using color toners and a K toner satisfying the condition $d/t>d_K/t_K$, toner particles are deposited layer-wise as laid down mainly in respect of a picture image area where the color toner particles are deposited as superposed; therefore, the surface of a transfer material can be covered with a small amount of toner, color reproducibility is excellent, and toner consumption can be reduced. On the other hand, in respect of a letter image area where the K toner is used, because a toner layer piled up to some extent is formed, a letter image having an excellent sharpness is to be formed.

The image forming method described in any one of the structures (7) to (12) uses a flattened toner which comes within the purview of the condition (1) or (2) described below concerning the relation between the K toner particles in the upper layer and the color toner particles of Y, M, and C in the lower layers, when a color toner image composed of Y, M, C, and K toner layers superposed is formed on a recording paper sheet P as a transfer material in the color image forming apparatus shown in FIG. 6:

(1) The equivalent circle diameter d of the color toner particles is larger than the equivalent circle diameter $d_K$ of the K toner particles.

(2) The equivalent circle diameter d of the color toner particles is larger than the equivalent circle diameter $d_K$ of the K toner particles, and the thickness t of the color toner particles is smaller than the thickness $t_K$ of the K toner particles.

By using color toners and a K toner satisfying the condition $d>d_K$, mainly in respect of a picture image area where the color toner particles are deposited as superposed, developing performance is stabilized even in a highlight area where toner deposition amount is small; therefore, a high-quality color image like an image produced by printing having an excellent gradation characteristic can be obtained. Further, in respect of a letter image area where the K toner is mainly used, because a toner image having a sharp edge and a high fidelity to the latent image is formed, a letter image having an excellent resolution and sharpness is to be formed.

By using color toners and a K toner satisfying the conditions $d>d_K$, and $t<t_K$, toner particles are deposited layer-wise as laid down mainly in respect of a picture image area where the color toner particles are deposited as superposed; therefore, the surface of a transfer material can be covered with a small amount of toner, color reproducibility is excellent, and toner consumption can be reduced. On the other hand, in respect of a letter image area where the K toner is used, because a toner layer piled up to some extent is formed, a letter image having an excellent sharpness is to be formed.

EXAMPLES OF PRACTICE

Present invention will be concretely explained on the basis of examples of practice, but the embodiment of present invention should not be limited to these examples.

{MANUFACTURING OF TONER AND DEVELOPER}

Flattened Black Toner

Some 0.90 kg of sodium n-dodecilsulfate was put in 10.0 L of pure water and stirred to dissolve. In this solution, 1.20 kg of carbon black REGAL 330R (manufactured by Cabot Corp.) was added gradually, and after it was stirred well for an hour, using a sand grinder (a medium-type dispersion machine), dispersion process was carried out continuously for 20 hours. This is referred to as "coloring agent dispersion liquid 1". Further, a solution composed of 0.055 kg of sodium dodecylbenzenesulfonate and 4.0 L of ion-exchange water was prepared and this is referred to as "anion surfactant solution A".

A solution composed of 0.014 kg of an addition product of 10 mol polyethylene oxide to nonylphenol and 4.0 L of ion-exchange water was prepared and this is referred to as "nonion surfactant solution B". A solution composed of 223.8 g of potassium persulfate dissolved in 12.0 L of ion-exchange water was prepared and this is referred to as "initiator solution C".

Some 3.41 kg of WAX emulsion (polypropylene emulsion having a number-average molecular weight of 3000:

number-average primary particle diameter=120 nm, concentration of solid constituent=29.9%), the whole amount of the "anion surfactant solution A", and the whole amount of the "nonion surfactant solution B were put in a glass-lined (GL) reaction pot having a capacity of 100 L equipped with a temperature sensor, a cooling tube, and a nitrogen introducing device, and stirring was started. Subsequently, 44.0 L of ion-exchange water was added.

Next, heating was started, and when the temperature of the liquid became 75° C., the whole amount of the "initiator solution C" was dropped down. After that, while the temperature was controlled at 75±1° C., a solution previously prepared by mixing 12.1 kg of styrene, 2.88 kg of n-butylacrylate, 1.04 kg of methacrylic acid, and 548 g of t-dodecylmercaptan was dropped down. After the completion of dropping, the liquid temperature was raised to 80±1° C., and by heating and stirring the liquid for 6 hours, polymerization was completed. Subsequently, the liquid temperature was lowered to 40° C. or under, stirring was stopped, and the liquid was filtered by a pole-filter to give a material, which is referred to as "latex 1-A".

Besides, the glass transition temperature of the resin particles in the "latex 1-A" was 57° C., the softening point was 121° C., the weight-average molecular weight was 12.7 thousands, and the weight-average particle diameter was 120 nm.

Further, a solution composed of 0.055 kg of sodium dodecylbenzenesufonate dissolved in 4.0 L of ion-exchange pure water was prepared, to be referred to as "anion surfactant solution D". Further, a solution composed of 0.014 kg of an addition product of 10 mol nonylphenol polyethylene oxide dissolved in 4.0 L of ion-exchange water was prepared, to be referred to as "nonion surfactant solution E".

A solution composed of 200.7 g of potassium persulfate (manufactured by Kanto Chemical Co., Ltd.) dissolved in 12.0 L of ion-exchange water was prepared, to be referred to as "initiator solution F".

Some 3.41 kg of WAX emulsion (polypropylene emulsion having a number-average molecular weight of 3000: number-average primary particle diameter=120 nm, concentration of solid constituent=29.9%), the whole amount of the "anion surfactant solution D", and the whole amount of the "nonion surfactant solution E were put in a glass-lined (GL) reaction pot having a capacity of 100 L equipped with a temperature sensor, a cooling tube, a nitrogen introducing device, and a comb-shaped baffle, and stirring was started. Subsequently, 44.0 L of ion-exchange water was added. Heating was started, and when the temperature rose to 70° C., the "initiator solution F" was added. Next, a solution prepared by previously mixing 11.0 kg of styrene, 4.00 kg of n-butylacrylate, 1.04 kg of methacrylic acid, and 9.02 g of t-dodecylmercaptan was dropped down. After the completion of dropping, heating and stirring were carried out for 6 hours with the liquid temperature controlled at 72° C.±2° C.; then, the liquid temperature was raised to 80° C.±2° C., and the liquid was heated and stirred for 12 hours, to complete polymerization. Subsequently, the liquid temperature was lowered to 40° C. or under and stirring was stopped, and the liquid was filtered by a pore-filter to give a material to be referred to as "latex 1-B".

Besides, the glass transition temperature of the resin particles in the "latex 1-B" was 58° C., the softening point was 132° C., the weight-average molecular weight was 245 thousands, and the weight-average particle diameter was 110 nm.

A solution composed of 5.36 kg of sodium chloride as a salting-out agent dissolved in 20.0 L of ion-exchange water was prepared, to be referred to as "sodium chloride solution G".

Some 20.0 kg of the "latex 1-A" and 5.2 kg of the "latex 1-B" which were prepared in the above-mentioned ways respectively, 0.4 kg of the "coloring agent dispersion liquid 1", and 20.0 kg of ion-exchange water were put in a SUS reaction pot having a capacity of 100 L equipped with a temperature sensor, a cooling tube, a nitrogen introducing device, and a device for monitoring the particle diameter and shape, and stirred.

The temperature raising was started after the liquid was left as it was for 10 minutes, the liquid temperature was raised to 85° C. in 60 minutes, the liquid was heated and stirred at 85° C.±2° C. to make the particles grow as they were salting out and fused to be bonded to one another, and at the timing when the average particle diameter became 4.0 μm, the "sodium chloride solution G" was added to stop the growth of the particles. This liquid is referred to as "fuse-bonded particle dispersion liquid 1".

Further, in the same way, a liquid in which fuse-bonded particles were made to grow to have an average particle diameter of 6.0 μm was prepared, to be referred to as "fuse-bonded particle dispersion liquid 2".

Subsequently, each of the above-mentioned "fuse-bonded particle dispersion liquid 1" and "fuse-bonded particle dispersion liquid 2", the quantity being 5.0 kg each, was put in a reaction vessel having a capacity of 5 L equipped with a temperature sensor and a cooling tube, and heating and stirring were carried out at the liquid temperature 92° C.±2° C. while the variation of the shape of the fuse-bonded particles was observed, until the average value of the coefficient of shape became 0.98 or higher; thus, the processing for making the fuse-bonded particles spherical was done. These are referred to as "spherical particle dispersion liquid 1" (average particle diameter 4.0 μm), and as "spherical particle dispersion liquid 2" (average particle diameter 6.0 μm) respectively.

Next, each of the "spherical particle dispersion liquid 1" and the "spherical particle dispersion liquid 2", the quantity being 1 kg each, mixed with 1 kg of glass beads having an average diameter of 0.6 mm was put in a sand grinder (a medium-type dispersion machine: inner diameter 200 mm, stirring disk diameter 180 mm), and stirred continuously for 0 to 9 hours at a speed of 500 rpm, to be subjected to flattening processing. After processing for a specified time was done, the liquid was cooled to 40° C. or under, stirring was stopped, and after the glass beads were removed through a sieve having openings of 200 meshes per inch, flattened black particles in a state like a wet cake were obtained by filtration by means of a Buchner funnel. After washing and filtration with ion-exchange water were carried out three times, the flattened black particles in a state like a wet cake were preliminarily dried at a suction air temperature of 50° C. by means of a flush jet dryer; further, they were dried at a temperature of 55° C. by means of a fluidized-bed drier, and "flattened black particles" were produced.

Fine particles of hydrophobic silica were externally added to the obtained "flattened black particles" and mixed together by a Henschel mixer, and flattened black toners K6, K8, K16, and K18 were produced.

Flattened Color Toners

Some 0.90 kg of sodium n-dodecylsulfate was put in 10.0 L of pure water and dissolved. After any one of the coloring agents for the respective colors was gradually added into this solution and stirred well for one hour, dispersion was continuously carried out for 20 hours by means of a sand grinder (a medium-type dispersion machine). This liquid is referred to as "coloring agent dispersion solution 2". Further, a solution composed of 0.055 kg of sodium dodecylbenzenesulfonate and 4.0 L of ion-exchange water was prepared, to be referred to as "anion surfactant solution J".

A solution composed of 0.014 kg of an addition product of 10 mol nonylphenol polyethylene oxide and 4.0 L of ion-exchange water was prepared, to be referred to as "nonion surfactant solution K". A solution composed of 223.8 g of potassium persulfate dissolved in 12.0 L of ion-exchange water was prepared, to be referred to as "initiator solution L".

Some 3.41 kg of WAX emulsion (polypropylene emulsion having a number-average molecular weight of 3000: number-average primary particle diameter=120 nm, concentration of solid constituent=29.9%), the whole amount of the "anion surfactant solution J", and the whole amount of the "nonion surfactant solution K were put in a glass-lined (GL) reaction pot having a capacity of 100 L equipped with a temperature sensor, a cooling tube, and a nitrogen introducing device, and stirring was started. Subsequently, 44.0 L of ion-exchange water was added.

Next, heating was started, and when the temperature of the liquid became 75° C., the whole amount of the "initiator solution L" was dropped down. After that, while the temperature was controlled at 75±1° C., a solution prepared by previously mixing 12.1 kg of styrene, 2.88 kg of n-butylacrylate, 1.04 kg of methacrylic acid, and 548 g of t-dodecylmercaptan was dropped down. After the completion of dropping, the liquid temperature was raised to 80±1° C., and by heating and stirring the liquid for 6 hours, polymerization was completed. Subsequently, the liquid temperature was lowered to 40° C. or under, stirring was stopped, and the liquid was filtered by a pore-filter to give a material, which is referred to as "latex 1-D".

Besides, the glass transition temperature of the resin particles in the "latex 1-D" was 57° C., the softening point was 121° C., the weight-average molecular weight was 12.7 thousands, and the weight-average particle diameter was 120 nm.

Further, a solution composed of 0.055 kg of sodium dodecylbenzenesufonate dissolved in 4.0 L of ion-exchange pure water was prepared, to be referred to as "anion surfactant solution Q". Further, a solution composed of 0.014 kg of an addition product of 10 mol nonylphenol polyethylene oxide dissolved in 4.0 L of ion-exchange water was prepared, to be referred to as "nonion surfactant solution R".

A solution composed of 200.7 g of potassium persulfate (manufactured by Kanto Chemical Co., Ltd.) dissolved in 12.0 L of ion-exchange water was prepared, to be referred to as "initiator solution S".

Some 3.41 kg of WAX emulsion (polypropylene emulsion having a number-average molecular weight of 3000: number-average primary particle diameter=120 nm, concentration of solid constituent=29.9%), the whole amount of the "anion surfactant solution Q", and the whole amount of the "nonion surfactant solution R" were put in a glass-lined (GL) reaction pot having a capacity of 100 L equipped with a temperature sensor, a cooling tube, a nitrogen introducing device, and a comb-shaped baffle, and stirring was started. Subsequently, 44.0 L of ion-exchange water was added. Heating was started, and when the temperature became 70° C., the "initiator solution S" was added. Next, a solution prepared by previously mixing 11.0 kg of styrene, 4.00 kg of n-butylacrylate, 1.04 kg of methacrylic acid, and 9.02 g of t-dodecylmercaptan was dropped down. After the completion of dropping, heating and stirring were carried out for 6 hours with the liquid temperature controlled at 72° C.±2° C.; then, the liquid temperature was raised to 80° C.±2° C., and the liquid was heated and stirred for 12 hours, to complete polymerization. Subsequently, the liquid temperature was lowered to 40° C. or under and stirring was stopped, and the liquid was filtered by a pore-filter to give a material to be referred to as "latex 1-E".

Besides, the glass transition temperature of the resin particles in the "latex 1-E" was 58° C., the softening point was 132° C., the weight-average molecular weight was 245 thousands, and the weight-average particle diameter was 110 nm.

A solution composed of 5.36 kg of sodium chloride as a salting-out agent dissolved in 20.0 L of ion-exchange water was prepared, to be referred to as "sodium chloride solution T".

Some 20.0 kg of the "latex 1-D" and 5.2 kg of the "latex 1-E" which were prepared in the above-mentioned ways respectively, 0.4 kg of the "coloring agent dispersion liquid 2", and 20.0 kg of ion-exchange water were put in a SUS reaction pot having a capacity of 100 L equipped with a temperature sensor, a cooling tube, a nitrogen introducing device, and a device for monitoring the particle diameter and shape, and stirred.

The temperature raising was started after the liquid was left as it was for 10 minutes, the liquid temperature was raised to 85° C. in 60 minutes, the liquid was heated and stirred at 85° C.±2° C. to make the particles grow as they were salting out and fused to be bonded to one another, and at the timing when the average particle diameter became 3.0 μm, the "sodium chloride solution T" was added to stop the growth of the particles. This liquid is referred to as "fuse-bonded particle dispersion liquid 3".

Further, in the same way, liquids in which fuse-bonded particles were made to grow to have an average particle diameter of 4.0 μm and 6.0 μm respectively were prepared, to be referred to as "fuse-bonded particle dispersion liquid 4" and as "fuse-bonded particle dispersion liquid 5" respectively.

Subsequently, each of the above-mentioned "fuse-bonded particle dispersion liquid 3" to "fuse-bonded particle dispersion liquid 5", the quantity being 5.0 kg each, was put in a reaction vessel having a capacity of 5 L equipped with a temperature sensor and a cooling tube, and heating and stirring were carried out at the liquid temperature 92° C.±2° C. while the variation of the shape of the particles was observed, until the average value of the coefficient of shape became 0.98 or higher; thus, the processing for making the fuse-bonded particles spherical was done. These are referred to as "spherical particle dispersion liquid 1" (average particle diameter 4.0 μm) and as "spherical particle dispersion liquid 2" (average particle diameter 6.0 μm) respectively.

Next, each of the "spherical particle dispersion liquid 3" to the "spherical particle dispersion liquid 5", the quantity being 1 kg each, mixed with 1 kg of glass beads having an average diameter of 0.6 mm was put in a sand grinder (a medium-type dispersion machine: inner diameter 200 mm, stirring disk diameter 180 mm), and stirred continuously for 0 to 9 hours at a speed of 500 rpm, to be subjected to flattening processing. After processing for a specified time was done, the liquid was cooled to 40° C. or under, stirring was stopped, and after the glass beads were removed through a sieve having openings of 200 meshes per inch, flattened color particles in a state like a wet cake were obtained by filtration by means of a Buchner funnel. After washing and filtration with ion-exchange water were carried out three times, the flattened color particles in a state like a wet cake were preliminarily dried at a suction air temperature of 50° C. by means of a flush jet dryer; further, they were dried at a temperature of 55° C. by means of a fluidized-bed drier, and "flattened color particles" were produced.

Fine particles of hydrophobic silica were externally added to the obtained "flattened color particles" and mixed together by a Henschel mixer, and "flattened color toners 1 to 21" were produced.

Flattened yellow toner: by using 1.05 kg of C. I. pigment yellow 17 for the yellow coloring agent, "flattened yellow toners 1 to 21" were produced.

Flattened magenta toner: by using 1.2 kg of C. I. pigment red 122 for the magenta coloring agent, "flattened magenta toners 1 to 21" were produced.

Flattened cyan toner: by using 0.6 kg of C. I. pigment blue 15:3 for the cyan coloring agent, "flattened cyan toners 1 to 21" were produced.

Shape of Toner Particles etc.

For the toners including the flattened K toners, flattened color toners 1 to 21, and the pulverization toner, quantities concerning the shape and particle diameter (d, t, d/t, and roundness), and the treatment amount of the external additive are shown in Table 1.

As regards the equivalent circle diameter d or $d_K$ of the toners as viewed from the direction to make the projection area maximum, and the thickness t or $t_K$, toner particles were uniformly dispersed and deposited on a smooth plane, and the equivalent circle diameter and the maximum height were measured for 500 toner particles by observing them from the upper direction by means of a laser microscope with an enlargement of 500 magnifications, and the arithmetic mean values were calculated.

In addition, the measured values of the K toners are the same as the corresponding measured values of the color toners of yellow, magenta, and cyan shown in Table 1.

The treatment quantity of the external additive in the table is the addition quantity (weight %) of the additive to be added to the toner, under the condition that the quantity of the external additive per unit surface area of the toner particles is made the same for all the toners.

Further, the toner concentration in the table is the quantity of toner particles (weight %) added to the carrier particles when the developer (to be described later) is manufactured, under the condition that coverage ratio of the toner particles, that is, the sum of the projection areas of the toner particles adhering to a unit surface area of a carrier particle is made the same for all the toners.

Preparation of Developer

Toner particles of each of the flattened color toners and the pulverization toner 1 to 22 were mixed with the particles of a ferrite carrier having a diameter of 65 μm coated with silicone resin, with a concentration to make the toner coverage ratio constant as shown in Table 1, to prepare developers 1 to 22 for each of the black toner and color toners of yellow, magenta, and cyan. The toner charge quantity of any one of the developers was −20 to −25 μc/g.

EXAMPLE 1

By using the color image forming apparatus of the first embodiment shown in FIG. 4, an image of a solid black patch was monochromatically developed with a C toner only, the reflection density of the patch image formed on a recording paper sheet P was measured, and the quantity of toner particles deposited on the photoreceptor to be required for obtaining the image density 1.2 was measured by col

TABLE 1

| Toner No. | Parent particle diameter | Processing time | Equivalent circle diameter | Thickness | Flattening ratio | Roundness | Treatment quantity of external additive | Toner concentration | Remarks |
|---|---|---|---|---|---|---|---|---|---|
| 1 | 3.0 | 0 | 3.0 | 3.0 | 1 | ≧0.98 | 1.6 | 10.0 | Comp. |
| 2 | | 1 | 3.8 | 1.9 | 2 | ≧0.98 | 1.8 | 6.3 | Comp. |
| 3 | | 4 | 5.1 | 1.0 | 5 | ≧0.98 | 2.6 | 3.4 | Inv. |
| 4 | | 7 | 6.0 | 0.8 | 8 | ≧0.98 | 3.3 | 2.5 | Comp. |
| 5 | | 8 | 6.2 | 0.7 | 9 | ≧0.98 | 3.6 | 2.3 | Comp. |
| 6 | 4.0 | 0 | 4.0 | 4.0 | 1 | ≧0.98 | 1.2 | 13.3 | Comp. |
| 7 | | 0.5 | 4.6 | 3.1 | 1.5 | ≧0.98 | 1.2 | 10.2 | Comp. |
| 8 | | 1 | 5.0 | 2.5 | 2 | ≧0.98 | 1.3 | 8.4 | Inv. |
| 9 | | 2 | 5.8 | 1.9 | 3 | ≧0.98 | 1.5 | 6.4 | Inv. |
| 10 | | 3 | 6.3 | 1.6 | 4 | ≧0.98 | 1.7 | 5.3 | Inv. |
| 11 | | 4 | 6.8 | 1.4 | 5 | ≧0.98 | 1.9 | 4.6 | Inv. |
| 12 | | 5 | 7.3 | 1.2 | 6 | ≧0.98 | 2.1 | 4.0 | Inv. |
| 13 | | 6 | 7.7 | 1.1 | 7 | ≧0.98 | 2.3 | 3.6 | Inv. |
| 14 | | 7 | 8.0 | 1.0 | 8 | ≧0.98 | 2.5 | 3.3 | Inv. |
| 15 | | 8 | 8.3 | 0.9 | 9 | ≧0.98 | 2.7 | 3.1 | Comp. |
| 16 | 6.0 | 0 | 6.0 | 6.0 | 1 | ≧0.98 | 0.8 | 20.0 | Comp. |
| 17 | | 0.5 | 6.9 | 4.6 | 1.5 | ≧0.98 | 0.8 | 15.3 | Comp. |
| 18 | | 1 | 7.6 | 3.8 | 2 | ≧0.98 | 0.9 | 12.6 | Inv. |
| 19 | | 3 | 9.5 | 2.4 | 4 | ≧0.98 | 1.1 | 7.9 | Inv. |
| 20 | | 5 | 10.9 | 1.8 | 6 | ≧0.98 | 1.4 | 6.1 | Comp. |
| 21 | | 7 | 12.0 | 1.5 | 8 | ≧0.98 | 1.7 | 5.0 | Comp. |
| 22 | Pulverization toner | | 6.1 | 5.9 | 1 | 0.98 | 0.8 | 20.0 | Comp. |

Comp.: Comparative example
Inv.: Present invention lecting said toner particles deposited and measuring the weight; the result is shown in Table 2.

TABLE 2

| Test No. | Toner No. | Toner deposition quantity required | Remarks |
|---|---|---|---|
| 1 | C1 | 0.33 | *1 |
| 2 | C2 | 0.21 | |
| 3 | C3 | 0.11 | |
| 4 | C4 | 0.08 | |
| 5 | C5 | 0.08 | |
| 6 | C6 | 0.44 | |
| 7 | C7 | 0.33 | |
| 8 | C8 | 0.27 | |
| 9 | C9 | 0.21 | |
| 10 | C10 | 0.17 | |
| 11 | C11 | 0.15 | |
| 12 | C12 | 0.13 | |
| 13 | C13 | 0.12 | |
| 14 | C14 | 0.11 | |
| 15 | C15 | 0.10 | |
| 16 | C16 | 0.65 | |
| 17 | C17 | 0.50 | |
| 18 | C18 | 0.41 | |
| 19 | C19 | 0.26 | |
| 20 | C20 | 0.20 | |

TABLE 2-continued

| Test No. | Toner No. | Toner deposition quantity required | Remarks |
|---|---|---|---|
| 21 | C21 | 0.16 | |
| 22 | C22 | 0.65 | |

*1: Poor cleaning occurs.
The unit of toner deposition quantity is mg/cm$^2$.

For the test Nos. 1, 6, and 16, spherical toners of 3 $\mu$m, 4 $\mu$m, and 6 $\mu$m were used respectively; this table shows that the toner deposition quantity required for obtaining the same image density is more for the spherical toners as compared to the flattened toners, and that the toner deposition quantity required for obtaining the same image density is less for the toners having a smaller particle diameter as compared to the toners having a larger particle diameter. Further, it is shown that there is a tendency that the toner deposition quantity required for obtaining the same image density becomes less in accordance with the flattening ratio becoming larger.

EXAMPLE 2

By using the color image forming apparatus of the first embodiment shown in FIG. 4, image formation using three color toners of Y, M, and C only was carried out through developments of Y, M, and C done in this order on the photoreceptor drum 10 to form toner images superposed. The developments for the respective three colors of Y, M, and C were carried out using the toners/developers of the same number for the three colors Y, M, and C shown in Table 1 respectively to perform image formation, and evaluation was performed for the formed images of the Test Nos. 31 to 51. Besides, the toner deposition quantity shown in Table 3 is the value calculated on the basis of the result of the measurement in the Example 1.

TABLE 3

| Test No. | Y toner, Y developer | M toner, M developer | C toner, C developer | Maximum toner deposition quantity | Result of evaluation 1 | Result of evaluation 2 | Result of evaluation 3 | Others | Remarks |
|---|---|---|---|---|---|---|---|---|---|
| 31 | Y2 | M2 | C2 | 0.2–0.25 | B | B | B | *2 | Comp. |
| 32 | Y3 | M3 | C3 | 0.1–0.15 | B | B | B | | Inv. |
| 33 | Y4 | M4 | C4 | 0.1–0.15 | B | C | B | | Comp. |
| 34 | Y5 | M5 | C5 | 0.1–0.15 | B | D | B | | Comp. |
| 35 | Y6 | M6 | C6 | 0.4–0.5 | C | B | D | | Comp. |
| 36 | Y7 | M7 | C7 | 0.3–0.35 | C | B | C | | Comp. |
| 37 | Y8 | M8 | C8 | 0.25–0.3 | B | B | B | | Inv. |
| 38 | Y9 | M9 | C9 | 0.2–0.25 | B | B | B | | Inv. |
| 39 | Y10 | M10 | C10 | 0.15–0.2 | B | B | B | | Inv. |
| 40 | Y11 | M11 | C11 | 0.15–0.2 | B | B | B | | Inv. |
| 41 | Y12 | M12 | C12 | 0.1–0.15 | B | B | B | | Inv. |
| 42 | Y13 | M13 | C13 | 0.1–0.15 | B | B | B | | Inv. |
| 43 | Y14 | M14 | C14 | 0.1–0.15 | B | B | B | | Inv. |
| 44 | Y15 | M15 | C15 | 0.1–0.15 | B | D | B | | Comp. |
| 45 | Y16 | M16 | C16 | 0.6–0.7 | D | B | D | | Comp. |
| 46 | Y17 | M17 | C17 | 0.5–0.6 | C | B | D | | Comp. |
| 47 | Y18 | M18 | C18 | 0.4–0.5 | B | B | B | | Inv. |
| 48 | Y19 | M19 | C19 | 0.25–0.3 | B | B | B | | Inv. |
| 49 | Y20 | M20 | C20 | 0.2–0.25 | C | B | B | | Comp. |
| 50 | Y21 | M21 | C21 | 0.15–0.2 | D | B | B | | Comp. |
| 51 | Y22 | M22 | C22 | 0.6–0.7 | D | C | D | | Comp. |

Comp.: Comparative example
Inv.: Present invention
*2) There is a problem of safety and sanitation (possible risk of pneumoconiosis).
The unit of toner deposition quantity is mg/cm$^2$.

As regards the image evaluation based on the three color developments of Y, M, and C, a colored letter image and a half-tone image were formed for the primary colors (Y, M, and C), the secondary colors (B, G, and R), and the tertiary color (process black), and image evaluation was performed for the evaluation items 1 to 3 on the basis of the 500 sheets printed.

Evaluation item 1: scattering and spreading of color letters (blurring), hollow image defect Evaluation item 2: background smudging (background density)

Evaluation item 3: uniformity of the gradation pattern (in particular, granularity in highlight areas)

The evaluations are performed visually on the basis of the following references of evaluation:

A: extremely excellent

B: excellent and acceptable for practical use

C: having a practical problem

D: not good

From the result of evaluations shown in Table 3, it has been made clear that the flattened toners were evaluated as excellent, and among the flattened toners, in the case where a flattened toner satisfying the condition that the equivalent circle diameter d is 5 to 10 ($\mu$m), the thickness is 1 to 4 ($\mu$m), and the flattening ratio d/t is 2 to 8 was used, an evaluation as more excellent was obtained.

EXAMPLE 3

By using the color image forming apparatus of the first embodiment shown in FIG. 4, image formation using four color toners of Y, M, C, and K were carried out on the photoreceptor drum 10. For the three color toners of Y, M, and C, the corresponding color toners/developers of the same number shown in Table 1 were used respectively; a toner/developer of a different number from the corresponding color toners was used for the K toner, and evaluation was performed for the formed images of the Test Nos. 60 to 73.

TABLE 4

| Test No. | Y, M, C developer | Maximum deposition quantity of Y, M, C toner | K toner, K developer | Maximum deposition quantity of K toner | Result of evaluation 4 | Result of evaluation 5 | Result of evaluation 6 | Others | Remarks |
|---|---|---|---|---|---|---|---|---|---|
| 60 | 6 | 0.4–0.5 | K6 | 0.4–0.5 | D | B | D | | Comp. |
| 61 | 8 | 0.25–0.3 | | | B | B | A | | Inv. |
| 62 | 11 | 0.15–0.2 | | | B | B | A | | Inv. |
| 63 | 14 | 0.1–0.15 | | | B | B | B | | Inv. |
| 64 | 6 | 0.4–0.5 | K8 | 0.25–0.3 | D | B | C | | Comp. |
| 65 | 8 | 0.25–0.3 | | | B | B | C | | Comp. |
| 66 | 11 | 0.15–0.2 | | | B | B | A | | Inv. |
| 67 | 14 | 0.1–0.15 | | | B | B | A | | Inv. |
| 68 | 16 | 0.6–0.7 | K16 | 0.6–0.7 | D | B | D | | Comp. |
| 69 | 18 | 0.4–0.5 | | | B | B | A | | Inv. |
| 70 | 19 | 0.25–0.3 | | | B | B | A | | Inv. |
| 71 | 16 | 0.6–0.7 | K18 | 0.4–0.5 | D | B | D | | Comp. |
| 72 | 18 | 0.4–0.5 | | | B | B | C | | Comp. |
| 73 | 19 | 0.25–0.3 | | | B | B | B | | Inv. |

Comp.: Comparative example
Inv.: Present invention
The unit of toner deposition quantity is mg/cm$^2$.

In performing image evaluation, a complex image composed of a gradation pattern image of each of the colors, an isolated black letter image, and a color gradation pattern image with a black letter superposed was formed, and evaluation was performed for the test items 4 to 6 described below on the basis of 500 sheets printed.

Evaluation item 4: image quality in a color picture area (gradation characteristic and granularity)

Evaluation item 5: sharpness of an isolated black letter (disturbance of image, scattering, and spreading (blurring))

Evaluation item 6: sharpness of a black letter in an area of color and black images superposed (disturbance of image, scattering, spreading (blurring), and hollow image defect)

Evaluation was carried out visually on the basis of the evaluation references used in the Example 2. The inventors have practiced the following analyses (a) and (b) on the basis of the result of image evaluations in Table 4.

(a) Table 5 shows the relation between the color toners and K toners in Table 4, with attention given to the thickness t of the flattened toners used, and the result of the synthetic evaluation was shown with the results of evaluation shown in Table 4 taken into account.

TABLE 5

| | Y, M, C toner | | K toner | | Result of | |
|---|---|---|---|---|---|---|
| Test No. | Toner No. | t | Toner No. | $T_K$ | synthetic evaluation | Remarks |
| 60 | 6 | 4.0 | K6 | 4.0 | D | Comp. |
| 61 | 8 | 2.5 | K6 | 4.0 | A | Inv. |
| 62 | 11 | 1.4 | K6 | 4.0 | A | Inv. |
| 63 | 14 | 1.0 | K6 | 4.0 | B | Inv. |
| 64 | 6 | 4.0 | K8 | 2.5 | D | Comp. |
| 65 | 8 | 2.5 | K8 | 2.5 | C | Comp. |
| 66 | 11 | 1.4 | K8 | 2.5 | A | Inv. |
| 67 | 14 | 1.0 | K8 | 2.5 | A | Inv. |
| 68 | 16 | 6.0 | K16 | 6.0 | D | Comp. |
| 69 | 18 | 3.8 | K16 | 6.0 | A | Inv. |
| 70 | 19 | 2.4 | K16 | 6.0 | A | Inv. |
| 71 | 16 | 6.0 | K18 | 3.8 | D | Comp. |

TABLE 5-continued

| | Y, M, C toner | | K toner | | Result of | |
|---|---|---|---|---|---|---|
| Test No. | Toner No. | t | Toner No. | $T_K$ | synthetic evaluation | Remarks |
| 72 | 18 | 3.8 | K18 | 3.8 | C | Comp. |
| 73 | 19 | 2.4 | K18 | 3.8 | B | Inv. |

Comp.: Comparative example
Inv.: Present invention
The unit of t and $t_K$ is $\mu$m.

It is clear from Table 5 that, owing to the relation $t_K$>t between the thickness $t_K$ of the K toner and the thickness t of the color toners superposed in such a way that the K toner layer comes to the upper side on the image forming member in the color image forming apparatus shown in FIG. 4, a high-quality color image which is excellent in graduation characteristic and granularity in a color picture area and excellent in sharpness in a black letter area can be obtained. Especially, it is now clear that, if there is the relation between the thickness t of the color toners and the thickness $t_K$ of the K toner $$t=(0.25 \text{ to } 0.7)t_K,$$

even in the case where a black letter is present in an area where a color image and a black image are superposed, an extremely high-quality color image without noticeable image disturbance and scattering can be obtained.

(b) Table 6 shows the relation between the flattening ratio d/t of the color toners and the flattening ratio $d_K/t_K$ of the K toners in Table 4, with attention given to the flattening ratio of the flattened toners used, and the result of the synthetic evaluation was shown in the table through synthesizing the results of evaluation 4 to 6 shown in Table 4.

TABLE 6

| | Y, M, C toner | | K toner | | Result of | |
|---|---|---|---|---|---|---|
| Test No. | Toner No. | d/t | Toner No. | $d_K/t_K$ | synthetic evaluation | Remarks |
| 60 | 6 | 1 | K6 | 1 | D | Comp. |
| 61 | 8 | 2 | K6 | 1 | A | Inv. |
| 62 | 11 | 5 | K6 | 1 | A | Inv. |
| 63 | 14 | 8 | K6 | 1 | B | Inv. |
| 64 | 6 | 1 | K8 | 2 | D | Comp. |
| 65 | 8 | 2 | K8 | 2 | C | Comp. |
| 66 | 11 | 5 | K8 | 2 | A | Inv. |
| 67 | 14 | 8 | K8 | 2 | A | Inv. |
| 68 | 16 | 1 | K16 | 1 | D | Comp. |
| 69 | 18 | 2 | K16 | 1 | A | Inv. |
| 70 | 19 | 4 | K16 | 1 | A | Inv. |
| 71 | 16 | 1 | K18 | 2 | D | Comp. |
| 72 | 18 | 2 | K18 | 2 | C | Comp. |
| 73 | 19 | 4 | K18 | 2 | B | Inv. |

Comp.: Comparative example
Inv.: Present invention
The unit of t and $t_K$ is $\mu$m.

It is clear from Table 6 that, owing to the relation $d_K/t_K<d/t$ between the flattening ratio of the K toner $d_K/t_K$ and the flattening ratio of the color toners d/t superposed in such a way that the K toner layer comes to the upper side on the image forming member in the color image forming apparatus shown in FIG. 4, a high-quality color image which is excellent in gradation characteristic and granularity in color picture area and excellent in sharpness in black letter area can be obtained. Especially, it is now clear that, if there is the relation between the flattening ratio of the color toners d/t and the flattening ratio of the K toner $d_K/t_K$ $$d/t=(2 \text{ to } 4)d_K/t_K,$$

even in the case where a black letter is present in an area where a color image and a black image are superposed, an extremely high-quality color image without noticeable image disturbance and scattering can be obtained.

Further, the inventors has practiced the following analyses (c) and (d) on the basis of the result of image evaluations shown in Table 4.

(c) Table 7 shows the relation between the color toners and the K toner with attention given to the equivalent circle diameter of the flattened toners used, and the result of the synthetic evaluation is shown with the results of evaluation 4 to 6 shown in Table 4 taken into account.

TABLE 7

| | Y, M, C toner | | K toner | | Result of | |
|---|---|---|---|---|---|---|
| Test No. | Toner No. | d | Toner No. | $d_k$ | synthetic evaluation | Remarks |
| 60 | 6 | 4.0 | K6 | 4.0 | D | Comp. |
| 61 | 8 | 5.0 | K6 | 4.0 | A | Inv. |
| 62 | 11 | 6.8 | K6 | 4.0 | A | Inv. |
| 63 | 14 | 8.0 | K6 | 4.0 | B | Inv. |
| 64 | 6 | 4.0 | K8 | 5.0 | D | Comp. |
| 65 | 8 | 5.0 | K8 | 5.0 | C | Comp. |
| 66 | 11 | 6.8 | K8 | 5.0 | A | Inv. |
| 67 | 14 | 8.0 | K8 | 5.0 | A | Inv. |
| 68 | 16 | 6.0 | K16 | 6.0 | D | Comp. |
| 69 | 18 | 7.6 | K16 | 6.0 | A | Inv. |
| 70 | 19 | 9.5 | K16 | 6.0 | A | Inv. |
| 71 | 16 | 6.0 | K18 | 7.6 | D | Comp. |
| 72 | 18 | 7.6 | K18 | 7.6 | C | Comp. |
| 73 | 19 | 9.5 | K18 | 7.6 | A | Inv. |

Comp.: Comparative example
Inv.: Present invention
The unit of d and $d_k$ is $\mu$m.

It is clear from Table 7 that, owing to the relation $d_K<d$ between the equivalent circle diameter $d_K$ of the K toner and the equivalent circle diameter of the color toners d superposed in such a way that the K toner layer comes to the upper side on the image forming member in the color image forming apparatus shown in FIG. 4, a high-quality color image which is excellent in gradation characteristic and granularity in a color picture area and excellent in sharpness in a black letter area can be obtained. Especially, it is now clear that, if there is the relation between the equivalent circle diameter d of the color toners and the equivalent circle diameter $d_K$ of the K toner $$d=(1.2 \text{ to } 2.0)d_K,$$

even in the case where a black letter is present in an area where a color image and a black image are superposed, an extremely high-quality color image without noticeable image disturbance and scattering can be obtained.

(d) Table 8 shows the relation between the equivalent circle diameter d and thickness t of the color toners and the equivalent circle diameter $d_K$ and thickness $t_K$ of the K toner with attention given to the equivalent circle diameter and the thickness of the flattened toners used, and the result of the synthetic evaluation is shown through synthesizing the results of evaluation 4 to 6 shown in Table 4.

TABLE 8

| | Y, M, C toner | | | K toner | | | Result of | |
|---|---|---|---|---|---|---|---|---|
| Test No. | Toner No. | d | t | Toner No. | $d_k$ | $t_k$ | synthetic evaluation | Remarks |
| 60 | 6 | 4.0 | 4.0 | K6 | 4.0 | 4.0 | D | Comp. |
| 61 | 8 | 5.0 | 2.5 | K6 | 4.0 | 4.0 | A | Inv. |
| 62 | 11 | 6.8 | 1.4 | K6 | 4.0 | 4.0 | A | Inv. |
| 63 | 14 | 8.0 | 1.0 | K6 | 4.0 | 4.0 | B | Inv. |
| 64 | 6 | 4.0 | 4.0 | K8 | 5.0 | 2.5 | D | Comp. |
| 65 | 8 | 5.0 | 2.5 | K8 | 5.0 | 2.5 | C | Comp. |
| 66 | 11 | 6.8 | 1.4 | K8 | 5.0 | 2.5 | A | Inv. |
| 67 | 14 | 8.0 | 1.0 | K8 | 5.0 | 2.5 | A | Inv. |
| 68 | 16 | 6.0 | 6.0 | K16 | 6.0 | 6.0 | D | Comp. |
| 69 | 18 | 7.6 | 3.8 | K16 | 6.0 | 6.0 | A | Inv. |

TABLE 8-continued

| Test No. | Y, M, C toner: Toner No. | d | t | K toner: Toner No. | $d_k$ | $t_k$ | Result of synthetic evaluation | Remarks |
|---|---|---|---|---|---|---|---|---|
| 70 | 19 | 9.5 | 2.4 | K16 | 6.0 | 6.0 | A | Inv. |
| 71 | 16 | 6.0 | 6.0 | K18 | 7.6 | 3.8 | D | Comp. |
| 72 | 18 | 7.6 | 3.8 | K18 | 7.6 | 3.8 | C | Comp. |
| 73 | 19 | 9.5 | 2.4 | K18 | 7.6 | 3.8 | A | Inv. |

Comp.: Comparative example
Inv.: Present invention
The unit of d, t, $d_k$ and $t_k$ is $\mu$m.

It is clear from Table 8 that, owing to the relations $d_K<d$ and $t_K>t$ between the equivalent circle diameter $d_K$ and thickness $t_K$ of the K toner and the equivalent circle diameter d and thickness t of the color toners superposed in such a way that the K toner layer comes to the upper side on the image forming member in the color image forming apparatus shown in FIG. 4, a high-quality color image which is excellent in gradation characteristic and granularity in color picture area and excellent in sharpness in black letter area can be obtained. Especially, it is now clear that, if there are the relations between the equivalent circle diameter d of the color toners and the equivalent circle diameter $d_K$ of the K toner, and between the thickness t of the color toners and the thickness $t_K$ of the K toner $$d=(1.2 \text{ to } 2.0)d_K, \text{ and}$$

$$t=(0.25 \text{ to } 0.7)t_K,$$

even in the case where a black letter is present in an area where a color image and a black image are superposed, an extremely high-quality color image without noticeable image disturbance and scattering can be obtained.

EXAMPLE 4

A maintenance operation was done for three units of the color image forming apparatus shown in FIG. 4; Y, M, C, and K developers in test numbers 62, 66, and 70 were loaded into the developing devices 13 of the three units of the color image forming apparatus, and preparation for the supply of toners was made; thus, a running test of ten thousands copies was carried out.

The test was done with a full color original for test having both of letter images and picture images used, and image quality evaluation was made for the 500 copies near the end of ten thousands copies. As regards the image quality evaluation, it is based on the above-mentioned evaluation items 4 to 6, and the evaluation was done with attention given particularly to the gradation characteristic of the color images, the sharpness of the letter images, and the background smudging. All the results of evaluation were satisfactory, and it has become clear that by employing a color image forming method of present invention, formation of a high-quality image can be secured over a long period of time without the damage of the performance in cleaning and fixing caused by the used toners. Further, also it has become clear that the toner consumption amount has been reduced and saved by 30 to 50% as compared to the case where conventional spherical toners were used.

EXAMPLE 5

By using the color image forming apparatus of the second embodiment shown in FIG. 5, an image of a solid black patch was monochromatically developed with a C toner only, the reflection density of the patch image formed on a recording paper sheet P was measured, and the quantity of toner particles deposited on the photoreceptor to be required for obtaining the image density 1.2 was measured by collecting said toner particles deposited and measuring the weight; the result is shown in Table 9.

TABLE 9

| Test No. | Toner No. | Toner deposition quantity required | Remarks |
|---|---|---|---|
| 101 | C1 | 0.33 | *1 |
| 102 | C2 | 0.21 | |
| 103 | C3 | 0.11 | |
| 104 | C4 | 0.08 | |
| 105 | C5 | 0.08 | |
| 106 | C6 | 0.44 | |
| 107 | C7 | 0.33 | |
| 108 | C8 | 0.27 | |
| 109 | C9 | 0.21 | |
| 110 | C10 | 0.17 | |
| 111 | C11 | 0.15 | |
| 112 | C12 | 0.13 | |
| 113 | C13 | 0.12 | |
| 114 | C14 | 0.11 | |
| 115 | C15 | 0.10 | |
| 116 | C16 | 0.65 | |
| 117 | C17 | 0.50 | |
| 118 | C18 | 0.41 | |
| 119 | C19 | 0.26 | |
| 120 | C20 | 0.20 | |
| 121 | C21 | 0.16 | |
| 122 | C22 | 0.65 | |

*1: Poor cleaning occurs.
The unit of toner deposition quantity is mg/cm$^2$.

For the test Nos. 101, 106, and 116, spherical toners of 3 $\mu$m, 4 $\mu$m, and 6 $\mu$m were used respectively; this table shows that the toner deposition quantity required for making the image density have the same specified value is more for the spherical toners as compared to the flattened toners, and that the toner deposition quantity required for making the image density have the same specified value is less for the toners having a smaller particle diameter as compared to the toners having a larger particle diameter. Further, it is shown that there is a tendency that the toner deposition quantity required for making the image density have the same specified value becomes less in accordance with the flattening ratio becoming larger.

EXAMPLE 6

By using the color image forming apparatus of the second embodiment shown in FIG. 5, images composed of three color toners of Y, M, and C only were formed on the respective photoreceptor drums 10, and the toner images were transferred onto the transfer belt 14*a* as an intermediate transfer member in the order of Y, M, and C to form toner images superposed. The developments for the respective three colors of Y, M, and C were carried out using the corresponding color toners/developers of the same number shown in Table 1 respectively to perform image formation, and evaluation was performed for the formed images of the Test Nos. 131 to 151. Besides, the toner deposition quantity shown in Table 10 is the value calculated on the basis of the result of the measurement in the Example 5.

TABLE 10

| Test No. | Y toner, Y developer | M toner, M developer | C toner, C developer | Maximum toner deposition quantity | Result of evaluation 1 | Result of evaluation 2 | Result of evaluation 3 | Others | Remarks |
|---|---|---|---|---|---|---|---|---|---|
| 131 | Y2 | M2 | C2 | 0.2–0.25 | B | B | B | *2 | Comp. |
| 132 | Y3 | M3 | C3 | 0.1–0.15 | B | B | B | | Inv. |
| 133 | Y4 | M4 | C4 | 0.1–0.15 | B | C | B | | Comp. |
| 134 | Y5 | M5 | C5 | 0.1–0.15 | B | D | B | | Comp. |
| 135 | Y6 | M6 | C6 | 0.4–0.5 | C | B | D | | Comp. |
| 136 | Y7 | M7 | C7 | 0.3–0.35 | C | B | C | | Comp. |
| 137 | Y8 | M8 | C8 | 0.25–0.3 | B | B | B | | Inv. |
| 138 | Y9 | M9 | C9 | 0.2–0.25 | B | B | B | | Inv. |
| 139 | Y10 | M10 | C10 | 0.15–0.2 | B | B | B | | Inv. |
| 140 | Y11 | M11 | C11 | 0.15–0.2 | B | B | B | | Inv. |
| 141 | Y12 | M12 | C12 | 0.1–0.15 | B | B | B | | Inv. |
| 142 | Y13 | M13 | C13 | 0.1–0.15 | B | B | B | | Inv. |
| 143 | Y14 | M14 | C14 | 0.1–0.15 | B | B | B | | Inv. |
| 144 | Y15 | M15 | C15 | 0.1–0.15 | B | D | B | | Comp. |
| 145 | Y16 | M16 | C16 | 0.6–0.7 | D | B | D | | Comp. |
| 146 | Y17 | M17 | C17 | 0.5–0.6 | C | B | D | | Comp. |
| 147 | Y18 | M18 | C18 | 0.4–0.5 | B | B | B | | Inv. |
| 148 | Y19 | M19 | C19 | 0.25–0.3 | B | B | B | | Inv. |
| 149 | Y20 | M20 | C20 | 0.2–0.25 | C | B | B | | Comp. |
| 150 | Y21 | M21 | C21 | 0.15–0.2 | D | B | B | | Comp. |
| 151 | Y22 | M22 | C22 | 0.6–0.7 | D | C | D | | Comp. |

Comp.: Comparative example
Inv.: Present invention
*2) There is a problem of safety and sanitation (possible risk of pneumoconiosis).
The unit of toner deposition quantity is $mg/cm^2$.

As regards the image evaluation based on the three color developments of Y, M, and C, a colored letter image and a half-tone image were formed for the primary colors (Y, M, and C), the secondary colors (B, G, and R), and the tertiary color (process black), and image evaluation was performed for the evaluation items 1 to 3 on the basis of the 500 sheets printed.

Evaluation item 1: scattering and spreading of color letters (blurring), and hollow image defect Evaluation item 2: background smudging (background density)

Evaluation item 3: uniformity of the gradation pattern (in particular, granularity in highlight areas)

The evaluations were performed visually on the basis of the following references of evaluation:

A: extremely excellent

B: excellent and acceptable for practical use

C: having a practical problem

D: not good

From the result of evaluations shown in Table 10, it has been made clear that the flattened toners were evaluated as excellent as compared to the spherical toners, and among the flattened toners, in the case where a flattened toner satisfying the condition that the equivalent circle diameter d is 5 to 10 ($\mu$m), the thickness is 1 to 4 ($\mu$m), and the flattening ratio d/t is 2 to 8 was used, an evaluation as more excellent was obtained.

EXAMPLE 7

By using the color image forming apparatus of the second embodiment shown in FIG. 5, images respectively composed of four color toners of Y, M, C, and K were formed on the four respective photoreceptor drums 10, and the toner images were transferred onto the transfer belt 14*a* to form superposed toner images. As regards the three color toners of Y, M, and C, the color toners/developers of the same number shown in Table 1 were used; a toner/developer of a different number from the corresponding color toners was used for the K toner, and evaluation was performed for the formed images of the Test Nos. 160 to 173.

TABLE 11

| Test No. | Y, M, C toner/ developer | Maximum deposition quantity of Y, M, C toner | K toner, K developer | Maximum deposition quantity of K toner | Result of evaluation 4 | Result of evaluation 5 | Result of evaluation 6 | Others | Remarks |
|---|---|---|---|---|---|---|---|---|---|
| 160 | 6 | 0.4–0.5 | K6 | 0.4–0.5 | D | B | D | | Comp. |
| 161 | 8 | 0.25–0.3 | | | B | B | B | | Inv. |
| 162 | 11 | 0.15–0.2 | | | B | B | B | | Inv. |
| 163 | 14 | 0.1–0.15 | | | B | B | B | | Inv. |
| 164 | 6 | 0.4–0.5 | K8 | 0.25–0.3 | D | B | C | | Comp. |
| 165 | 8 | 0.25–0.3 | | | B | B | C | | Comp. |
| 166 | 11 | 0.15–0.2 | | | B | B | B | | Inv. |
| 167 | 14 | 0.1–0.15 | | | B | B | B | | Inv. |

TABLE 11-continued

| Test No. | Y, M, C toner/ developer | Maximum deposition quantity of Y, M, C toner | K toner, K developer | Maximum deposition quantity of K toner | Result of evaluation 4 | Result of evaluation 5 | Result of evaluation 6 | Others | Remarks |
|---|---|---|---|---|---|---|---|---|---|
| 168 | 16 | 0.6–0.7 | K16 | 0.6–0.7 | D | B | D | | Comp. |
| 169 | 18 | 0.4–0.5 | | | B | B | B | | Inv. |
| 170 | 19 | 0.25–0.3 | | | B | B | B | | Inv. |
| 171 | 16 | 0.6–0.7 | K18 | 0.4–0.5 | D | B | D | | Comp. |
| 172 | 18 | 0.4–0.5 | | | B | B | C | | Comp. |
| 173 | 19 | 0.25–0.3 | | | B | B | B | | Inv. |

Comp.: Comparative example
Inv.: Present invention
The unit of toner deposition quantity is $mg/cm^2$.

In performing image evaluation, a complex image composed of a gradation pattern image of each of the colors, an isolated black letter image, and a color gradation pattern image with a black letter superposed was formed, and evaluation was performed for the test items 4 to 6 described below on the basis of 500 sheets printed.

Evaluation item 4: image quality in a color picture area (gradation characteristic and granularity)

Evaluation item 5: sharpness of an isolated black letter (disturbance of image, scattering, and spreading (blurring))

Evaluation item 6: sharpness of a black letter in an area of color and black images superposed (disturbance of image, scattering, spreading (blurring), and hollow image defect)

Evaluation was carried out visually on the basis of the evaluation references used in the Example 6. The inventors have practiced the following analyses (a) and (b) on the basis of the result of image evaluations in Table 11.

(a) Table 12 shows the relation between the color toners and K toners in Table 4, with attention given to the thickness t of the flattened toner particles used, and the result of the synthetic evaluation was shown with the results of evaluation shown in Table 11 taken into account.

TABLE 12

| Test No. | Y, M, C toner: Toner No. | Y, M, C toner: t | K toner: Toner No. | K toner: $t_k$ | Result of synthetic evaluation | Remarks |
|---|---|---|---|---|---|---|
| 160 | 6 | 4.0 | K6 | 4.0 | D | Comp. |
| 161 | 8 | 2.5 | K6 | 4.0 | A | Inv. |
| 162 | 11 | 1.4 | K6 | 4.0 | A | Inv. |
| 163 | 14 | 1.0 | K6 | 4.0 | B | Inv. |
| 164 | 6 | 4.0 | K8 | 2.5 | D | Comp. |
| 165 | 8 | 2.5 | K8 | 2.5 | C | Comp. |
| 166 | 11 | 1.4 | K8 | 2.5 | A | Inv. |
| 167 | 14 | 1.0 | K8 | 2.5 | A | Inv. |
| 168 | 16 | 6.0 | K16 | 6.0 | D | Comp. |
| 169 | 18 | 3.8 | K16 | 6.0 | A | Inv. |
| 170 | 19 | 2.4 | K16 | 6.0 | A | Inv. |
| 171 | 16 | 6.0 | K18 | 3.8 | D | Comp. |
| 172 | 18 | 3.8 | K18 | 3.8 | C | Comp. |
| 173 | 19 | 2.4 | K18 | 3.8 | B | Inv. |

Comp.: Comparative example
Inv.: Present invention
The unit of t or $t_k$ is $\mu$m.

It is clear from Table 12 that, owing to the relation $t_K > t$ between the thickness of the K toner $t_K$ and the thickness t of the color toners superposed in such a way that the K toner layer comes to the upper side on the image forming member in the color image forming apparatus shown in FIG. 5, a high-quality color image which is excellent in gradation characteristic and granularity in a color picture area and excellent in sharpness in a black letter area can be obtained. Especially, it is now clear that, if there is the relation between the thickness of the color toners t and the thickness of the K toner $t_K$ $$t=(0.25 \text{ to } 0.7)t_K,$$

even in the case where a black letter is present in an area where a color image and a black image are superposed, an extremely high-quality color image without noticeable image disturbance and scattering can be obtained.

(b) Table 13 shows the relation between the flattening ratio d/t of the color toners and the flattening ratio $d_K/t_K$ of the K toners in Table 11, with attention given to the flattening ratio of the flattened toners used, and the result of the synthetic evaluation was shown in the table through synthesizing the results of evaluation 4 to 6 shown in Table 11.

TABLE 13

| Test No. | Y, M, C toner: Toner No. | Y, M, C toner: d/t | K toner: Toner No. | K toner: $d_k/t_k$ | Result of synthetic evaluation | Remarks |
|---|---|---|---|---|---|---|
| 160 | 6 | 1 | K6 | 1 | D | Comp. |
| 161 | 8 | 2 | K6 | 1 | A | Inv. |
| 162 | 11 | 5 | K6 | 1 | A | Inv. |
| 163 | 14 | 8 | K6 | 1 | B | Inv. |
| 164 | 6 | 1 | K8 | 2 | D | Comp. |
| 165 | 8 | 2 | K8 | 2 | C | Comp. |
| 166 | 11 | 5 | K8 | 2 | A | Inv. |
| 167 | 14 | 8 | K8 | 2 | A | Inv. |
| 168 | 16 | 1 | K16 | 1 | D | Comp. |
| 169 | 18 | 2 | K16 | 1 | A | Inv. |
| 170 | 19 | 4 | K16 | 1 | A | Inv. |
| 171 | 16 | 1 | K18 | 2 | D | Comp. |
| 172 | 18 | 2 | K18 | 2 | C | Comp. |
| 173 | 19 | 4 | K18 | 2 | B | Inv. |

Comp.: Comparative example
Inv.: Present invention
The unit of t or $t_k$ is $\mu$m.

It is clear from Table 13 that, owing to the relation $d_K/t_K < d/t$ between the flattening ratio of the K toner $d_K/t_K$ and the flattening ratio of the color toners d/t superposed in such a way that the K toner layer comes to the upper side on the image forming member in the color image forming apparatus shown in FIG. 5, a high-quality color image which is excellent in gradation characteristic and granularity in a color picture area and excellent in sharpness in a black letter area can be obtained. Especially, it is now clear that, if there is the relation between the flattening ratio of the color toners d/t and the flattening ratio of the K toner $d_K/t_K$ $$d/t=(2 \text{ to } 4)d_K/t_K,$$

even in the case where a black letter is present in an area where a color image and a black image are superposed, an extremely high-quality color image without noticeable image disturbance and scattering can be obtained.

Further, the inventors have practiced the following analyses (c) and (d) on the basis of the result of image evaluations shown in Table 11.

(c) Table 14 shows the relation between the color toners and the K toners shown in Table 11, with attention given to the equivalent circle diameter of the flattened toners used, and the result of the synthetic evaluation is shown with the results of evaluation 4 to 6 shown in Table 11 taken into account.

TABLE 14

| | Y, M, C toner | | K toner | | Result of | |
|---|---|---|---|---|---|---|
| Test No. | Toner No. | d | Toner No. | $d_k$ | synthetic evaluation | Remarks |
| 160 | 6 | 4.0 | K6 | 4.0 | D | Comp. |
| 161 | 8 | 5.0 | K6 | 4.0 | A | Inv. |
| 162 | 11 | 6.8 | K6 | 4.0 | A | Inv. |
| 163 | 14 | 8.0 | K6 | 4.0 | B | Inv. |
| 164 | 6 | 4.0 | K8 | 5.0 | D | Comp. |
| 165 | 8 | 5.0 | K8 | 5.0 | C | Comp. |
| 166 | 11 | 6.8 | K8 | 5.0 | A | Inv. |
| 167 | 14 | 8.0 | K8 | 5.0 | A | Inv. |
| 168 | 16 | 6.0 | K16 | 6.0 | D | Comp. |
| 169 | 18 | 7.6 | K16 | 6.0 | A | Inv. |
| 170 | 19 | 9.5 | K16 | 6.0 | A | Inv. |
| 171 | 16 | 6.0 | K18 | 7.6 | D | Comp. |
| 172 | 18 | 7.6 | K18 | 7.6 | C | Comp. |
| 173 | 19 | 9.5 | K18 | 7.6 | A | Inv. |

Comp.: Comparative example
Inv.: Present invention
The unit of d or $d_k$ is $\mu$m.

It is clear from Table 14 that, owing to the relation $d_K<d$ between the equivalent circle diameter $d_K$ of the K toner and the equivalent circle diameter d of the color toners superposed in such a way that the K toner layer comes to the upper side on the image forming member in the color image forming apparatus shown in FIG. 5, a high-quality color image which is excellent in gradation characteristic and granularity in a color picture area and excellent in sharpness in a black letter area can be obtained. Especially, it is now clear that, if there is the relation between the equivalent circle diameter d of the color toners and the equivalent circle diameter $d_K$ of the K toner $$d=(1.2 \text{ to } 2.0)d_K,$$

even in the case where a black letter is present in an area where a color image and a black image are superposed, an extremely high-quality color image without noticeable image disturbance and scattering can be obtained.

(d) Table 15 shows the relation between the equivalent circle diameter d and thickness t of the color toners and the equivalent circle diameter $d_K$ and thickness $t_K$ of the K toner shown in Table 11, with attention given to the equivalent circle diameter and the thickness of the flattened toners used, and the result of the synthetic evaluation is shown through synthesizing the results of evaluation 4 to 6 shown in Table 11.

TABLE 15

| | Y, M, C toner | | | K toner | | | Result of | |
|---|---|---|---|---|---|---|---|---|
| Test No. | Toner No. | d | t | Toner No. | $d_k$ | $t_k$ | synthetic evaluation | Remarks |
| 160 | 6 | 4.0 | 4.0 | K6 | 4.0 | 4.0 | D | Comp. |
| 161 | 8 | 5.0 | 2.5 | K6 | 4.0 | 4.0 | A | Inv. |
| 162 | 11 | 6.8 | 1.4 | K6 | 4.0 | 4.0 | A | Inv. |
| 163 | 14 | 8.0 | 1.0 | K6 | 4.0 | 4.0 | B | Inv. |
| 164 | 6 | 4.0 | 4.0 | K8 | 5.0 | 2.5 | D | Comp. |
| 165 | 8 | 5.0 | 2.5 | K8 | 5.0 | 2.5 | C | Comp. |
| 166 | 11 | 6.8 | 1.4 | K8 | 5.0 | 2.5 | A | Inv. |
| 167 | 14 | 8.0 | 1.0 | K8 | 5.0 | 2.5 | A | Inv. |
| 168 | 16 | 6.0 | 6.0 | K16 | 6.0 | 6.0 | D | Comp. |
| 169 | 18 | 7.6 | 3.8 | K16 | 6.0 | 6.0 | A | Inv. |
| 170 | 19 | 9.5 | 2.4 | K16 | 6.0 | 6.0 | A | Inv. |
| 171 | 16 | 6.0 | 6.0 | K18 | 7.6 | 3.8 | D | Comp. |
| 172 | 18 | 7.6 | 3.8 | K18 | 7.6 | 3.8 | C | Comp. |
| 173 | 19 | 9.5 | 2.4 | K18 | 7.6 | 3.8 | A | Inv. |

Comp.: Comparative example
Inv.: Present invention
Each unit of d, t, $d_k$ and $t_k$ is $\mu$m.

It is clear from Table 15 that, owing to the relations $d_K<d$ and $t_K>t$ between the equivalent circle diameter $d_K$ and thickness $t_K$ of the K toner and the equivalent circle diameter d and thickness t of the color toners superposed in such a way that the K toner layer comes to the upper side on the image forming member in the color image forming apparatus shown in FIG. 5, a high-quality color image which is excellent in gradation characteristic and granularity in a color picture area and excellent in sharpness in a black letter area can be obtained. Especially, it is now clear that, if there are the relations between the equivalent circle diameter d of the color toners and the equivalent circle diameter $d_K$ of the K toner, and between the thickness t of the color toners and the thickness $t_K$ of the K toner $$d=(1.2 \text{ to } 2.0)d_K, \text{ and}$$

$$t=(0.25 \text{ to } 0.7)t_K,$$

even in the case where a black letter is present in an area where a color image and a black image are superposed, an extremely high-quality color image without noticeable image disturbance and scattering can be obtained.

EXAMPLE 8

A maintenance operation was done for three units of the color image forming apparatus shown in FIG. 5; Y, M, C, and K developers in test numbers 162, 166, and 170 were loaded into the respective developing devices 13 of the three units of the color image forming apparatus, and preparation for the supply of toners was made; thus, a running test of ten thousands copies was carried out.

The test was done with a full color original for test having both of letter images and picture images used, and image quality evaluation was made for the 500 copies near the end of ten thousands copies. As regards the image quality evaluation, it is based on the above-mentioned evaluation items 4 to 6, and the evaluation was done with attention given particularly to the gradation characteristic of the color images, the sharpness of the letter images, and the background smudging. All the results of evaluation were satisfactory, and it has become clear that by employing a color image forming method of present invention, formation of a high-quality image can be secured over a long period of time without the damage of the performance in cleaning and fixing caused by the used toners. Further, also it has become clear that the toner consumption amount has been reduced and saved by 30 to 50% as compared to the case where conventional spherical toners were used.

EXAMPLE 9

By using the color image forming apparatus of the third embodiment shown in FIG. 6, an image of a solid black patch was monochromatically developed with a C toner only, the reflection density of the patch image formed on a recording paper sheet P was measured, and the quantity of toner particles deposited on the photoreceptor to be required for obtaining the image density 1.2 was measured by collecting said toner particles deposited and measuring the weight; the result is shown in Table 16.

TABLE 16

| Test No. | Toner No. | Toner deposition quantity required | Remarks |
|---|---|---|---|
| 201 | C1 | 0.33 | *1 |
| 202 | C2 | 0.21 | |
| 203 | C3 | 0.11 | |
| 204 | C4 | 0.08 | |
| 205 | C5 | 0.08 | |
| 206 | C6 | 0.44 | |
| 207 | C7 | 0.33 | |
| 208 | C8 | 0.27 | |
| 209 | C9 | 0.21 | |
| 210 | C10 | 0.17 | |
| 211 | C11 | 0.15 | |
| 212 | C12 | 0.13 | |
| 213 | C13 | 0.12 | |
| 214 | C14 | 0.11 | |
| 215 | C15 | 0.10 | |
| 216 | C16 | 0.65 | |
| 217 | C17 | 0.50 | |
| 218 | C18 | 0.41 | |
| 219 | C19 | 0.26 | |
| 220 | C20 | 0.20 | |

TABLE 16-continued

| Test No. | Toner No. | Toner deposition quantity required | Remarks |
|---|---|---|---|
| 221 | C21 | 0.16 | |
| 222 | C22 | 0.65 | |

*1: Poor cleaning occurs.
The unit of toner deposition quantity is mg/cm$^2$.

For the test Nos. 201, 206, and 216, spherical toners of 3 $\mu$m, 4 $\mu$m, and 6 $\mu$m were used respectively; this table shows that the toner deposition quantity required for making the image density have the same specified value is more for the spherical toners as compared to the flattened toners, and that the toner deposition quantity required for making the image density have the same specified value is less for the toners having a smaller particle diameter as compared to the toners having a larger particle diameter. Further, it is shown that there is a tendency that the toner deposition quantity required for making the image density have the same specified value becomes less in accordance with the flattening ratio becoming larger.

EXAMPLE 10

By using the color image forming apparatus of the third embodiment shown in FIG. 6, images composed of three color toners of Y, M, and C only were formed on the respective photoreceptor drums 10, and the toner images were transferred onto a recording paper sheet P as a transfer material in the order of Y, M, and C to form toner images superposed. The developments using the respective three color toners of Y, M, and C were carried out using the corresponding color toners/developers of the same number shown in Table 1 respectively to perform image formation, and evaluation was performed for the formed images of the Test Nos. 231 to 251. Besides, the toner deposition quantity shown in Table 17 is the value calculated on the basis of the result of the measurement in the Example 9.

TABLE 17

| Test No. | Y toner, Y developer | M toner, M developer | C toner, C developer | Maximum toner deposition quantity | Result of evaluation 1 | Result of evaluation 2 | Result of evaluation 3 | Others | Remarks |
|---|---|---|---|---|---|---|---|---|---|
| 231 | Y2 | M2 | C2 | 0.2–0.25 | B | B | B | *2 | Comp. |
| 232 | Y3 | M3 | C3 | 0.1–0.15 | B | B | B | | Inv. |
| 233 | Y4 | M4 | C4 | 0.1–0.15 | B | C | B | | Comp. |
| 234 | Y5 | M5 | C5 | 0.1–0.15 | B | D | B | | Comp. |
| 235 | Y6 | M6 | C6 | 0.4–0.5 | C | B | D | | Comp. |
| 236 | Y7 | M7 | C7 | 0.3–0.35 | C | B | C | | Comp. |
| 237 | Y8 | M8 | C8 | 0.25–0.3 | B | B | B | | Inv. |
| 238 | Y9 | M9 | C9 | 0.2–0.25 | B | B | B | | Inv. |
| 239 | Y10 | M10 | C10 | 0.15–0.2 | B | B | B | | Inv. |
| 240 | Y11 | M11 | C11 | 0.15–0.2 | B | B | B | | Inv. |
| 241 | Y12 | M12 | C12 | 0.1–0.15 | B | B | B | | Inv. |
| 242 | Y13 | M13 | C13 | 0.1–0.15 | B | B | B | | Inv. |
| 243 | Y14 | M14 | C14 | 0.1–0.15 | B | B | B | | Inv. |
| 244 | Y15 | M15 | C15 | 0.1–0.15 | B | D | B | | Comp. |
| 245 | Y16 | M16 | C16 | 0.6–0.7 | D | B | D | | Comp. |
| 246 | Y17 | M17 | C17 | 0.5–0.6 | C | B | D | | Comp. |
| 247 | Y18 | M18 | C18 | 0.4–0.5 | B | B | B | | Inv. |
| 248 | Y19 | M19 | C19 | 0.25–0.3 | B | B | B | | Inv. |
| 249 | Y20 | M20 | C20 | 0.2–0.25 | C | B | B | | Comp. |
| 250 | Y21 | M21 | C21 | 0.15–0.2 | D | B | B | | Comp. |
| 251 | Y22 | M22 | C22 | 0.6–0.7 | D | C | D | | Comp. |

Comp.: Comparative example
Inv.: Present invention
*2) There is a problem of safety and sanitation (possible risk of pneumoconiosis).
The unit of toner deposition quantity is mg/cm$^2$.

As regards the image evaluation based on the three color developments of Y, M, and C, a colored letter image and a half-tone image were formed for the primary colors (Y, M, and C), the secondary colors (B, G, and R), and the tertiary color (process black), and image evaluation was performed for the evaluation items 1 to 3 on the basis of the 500 sheets printed.

Evaluation item 1: scattering and spreading of color letters (blurring), and hollow image defect Evaluation item 2: background smudging (background density)

Evaluation item 3: uniformity of the gradation pattern (in particular, granularity in highlight areas)

The evaluations were performed visually on the basis of the following references of evaluation:

A: extremely excellent

B: excellent and acceptable for practical use

C: having a practical problem

D: not good

From the result of evaluations shown in Table 17, it has been made clear that the flattened toners were evaluated as excellent as compared to the spherical toners, and among the flattened toners, in the case where a flattened toner satisfying the condition that the equivalent circle diameter d is 5 to 10 ($\mu$m), the thickness is 1 to 4 ($\mu$m), and the flattening ratio d/t is 2 to 8 was used, an evaluation as more excellent was obtained.

EXAMPLE 11

By using the color image forming apparatus of the third embodiment shown in FIG. 6, images respectively composed of four color toners of Y, M, C, and K were formed on the four respective photoreceptor drums 10, and the toner images were transferred onto a recording paper sheet as a transfer material to form superposed toner images. As regards the three color toners of Y, M, and C, the color toners/developers of the same number shown in Table 1 were used; a toner/developer of a different number from the corresponding color toners was used for the K toner, and evaluation was performed for the formed images of the Test Nos. 260 to 273.

In performing image evaluation, a complex image composed of a gradation pattern image of each of the colors, an isolated black letter image, and a color gradation pattern image with a black letter superposed was formed, and evaluation was performed for the test items 4 to 6 described below on the basis of 500 sheets printed.

Evaluation item 4: image quality in a color picture area (gradation characteristic and granularity)

Evaluation item 5: sharpness of an isolated black letter (disturbance of image, scattering, and spreading (blurring))

Evaluation item 6: sharpness of a black letter in an area of color and black images superposed (disturbance of image, scattering, spreading (blurring), and hollow image defect)

Evaluation was carried out visually on the basis of the evaluation references used in the Example 10. The inventors have practiced the following analyses (a) and (b) on the basis of the result of image evaluations in Table 18.

(a) Table 19 shows the relation between the color toners and K toners in Table 18, with attention given to the thickness t of the flattened toners used, and the result of the synthetic evaluation was shown with the results of evaluation shown in Table 18 taken into account.

TABLE 19

| | Y, M, C toner | | K toner | | Result of | |
|---|---|---|---|---|---|---|
| Test No. | Toner No. | t | Toner No. | $t_k$ | synthetic evaluation | Remarks |
| 260 | 6 | 4.0 | K6 | 4.0 | D | Comp. |
| 261 | 8 | 2.5 | K6 | 4.0 | A | Inv. |
| 262 | 11 | 1.4 | K6 | 4.0 | A | Inv. |
| 263 | 14 | 1.0 | K6 | 4.0 | B | Inv. |
| 264 | 6 | 4.0 | K8 | 2.5 | D | Comp. |
| 265 | 8 | 2.5 | K8 | 2.5 | C | Comp. |
| 266 | 11 | 1.4 | K8 | 2.5 | A | Inv. |
| 267 | 14 | 1.0 | K8 | 2.5 | A | Inv. |
| 268 | 16 | 6.0 | K16 | 6.0 | D | Comp. |
| 269 | 18 | 3.8 | K16 | 6.0 | A | Inv. |
| 270 | 19 | 2.4 | K16 | 6.0 | A | Inv. |
| 271 | 16 | 6.0 | K18 | 3.8 | D | Comp. |

TABLE 18

| Test No. | Y, M, C toner/ developer | Maximum deposition quantity of Y, M, C toner | K toner, K developer | Maximum deposition quantity of K toner | Result of evaluation 4 | Result of evaluation 5 | Result of evaluation 6 | Others | Remarks |
|---|---|---|---|---|---|---|---|---|---|
| 260 | 6 | 0.4–0.5 | K6 | 0.4–0.5 | D | B | D | | Comp. |
| 261 | 8 | 0.25–0.3 | | | B | B | B | | Inv. |
| 262 | 11 | 0.15–0.2 | | | B | B | B | | Inv. |
| 263 | 14 | 0.1–0.15 | | | B | B | B | | Inv. |
| 264 | 6 | 0.4–0.5 | K8 | 0.25–0.3 | D | B | C | | Comp. |
| 265 | 8 | 0.25–0.3 | | | B | B | C | | Comp. |
| 266 | 11 | 0.15–0.2 | | | B | B | B | | Inv. |
| 267 | 14 | 0.1–0.15 | | | B | B | B | | Inv. |
| 268 | 16 | 0.6–0.7 | K16 | 0.6–0.7 | D | B | D | | Comp. |
| 269 | 18 | 0.4–0.5 | | | B | B | B | | Inv. |
| 270 | 19 | 0.25–0.3 | | | B | B | B | | Inv. |
| 271 | 16 | 0.6–0.7 | K18 | 0.4–0.5 | D | B | D | | Comp. |
| 272 | 18 | 0.4–0.5 | | | B | B | C | | Comp. |
| 273 | 19 | 0.25–0.3 | | | B | B | B | | Inv. |

Comp.: Comparative example

Inv.: Present invention

The unit of toner deposition quantity is mg/cm$^2$.

TABLE 19-continued

| Test No. | Y, M, C toner Toner No. | t | K toner Toner No. | $t_k$ | Result of synthetic evaluation | Remarks |
|---|---|---|---|---|---|---|
| 272 | 18 | 3.8 | K18 | 3.8 | C | Comp. |
| 273 | 19 | 2.4 | K18 | 3.8 | B | Inv. |

Comp.: Comparative example
Inv.: Present invention
The unit of t or $t_k$ is $\mu$m.

It is clear from Table 19 that, owing to the relation $t_K>t$ between the thickness of the K toner $t_K$ and the thickness of the color toners t superposed in such a way that the K toner layer comes to the upper side on the image forming member in the color image forming apparatus shown in FIG. 6, a high-quality color image which is excellent in gradation characteristic and granularity in a color picture area and excellent in sharpness in a black letter area can be obtained. Especially, it is now clear that, if there is the relation between the thickness of the color toners t and the thickness of the K toner $t_K$ $$t=(0.25 \text{ to } 0.7)t_K,$$

even in the case where a black letter is present in an area where a color image and a black image are superposed, an extremely high-quality color image without noticeable image disturbance and scattering can be obtained.

(b) Table 20 shows the relation between the flattening ratio d/t of the color toners and the flattening ratio $d_K/t_K$ of the K toners in Table 18, with attention given to the flattening ratio of the flattened toners used, and the result of the synthetic evaluation was shown in the table through synthesizing the results of evaluation 4 to 6 shown in Table 18.

TABLE 20

| Test No. | Y, M, C toner Toner No. | d/t | K toner Toner No. | $d_k/t_k$ | Result of synthetic evaluation | Remarks |
|---|---|---|---|---|---|---|
| 260 | 6 | 1 | K6 | 1 | D | Comp. |
| 261 | 8 | 2 | K6 | 1 | A | Inv. |
| 262 | 11 | 5 | K6 | 1 | A | Inv. |
| 263 | 14 | 8 | K6 | 1 | B | Inv. |
| 264 | 6 | 1 | K8 | 2 | D | Comp. |
| 265 | 8 | 2 | K8 | 2 | C | Comp. |
| 266 | 11 | 5 | K8 | 2 | A | Inv. |
| 267 | 14 | 8 | K8 | 2 | A | Inv. |
| 268 | 16 | 1 | K16 | 1 | D | Comp. |
| 269 | 18 | 2 | K16 | 1 | A | Inv. |
| 270 | 19 | 4 | K16 | 1 | A | Inv. |
| 271 | 16 | 1 | K18 | 2 | D | Comp. |
| 272 | 18 | 2 | K18 | 2 | C | Comp. |
| 273 | 19 | 4 | K18 | 2 | B | Inv. |

Comp.: Comparative example
Inv.: Present invention
The unit of t or $t_k$ is $\mu$m.

It is clear from Table 20 that, owing to the relation $d_K/t_K<d/t$ between the flattening ratio of the K toner $d_K/t_K$ and the flattening ratio of the color toners d/t superposed in such a way that the K toner layer comes to the upper side on the image forming member in the color image forming apparatus shown in FIG. 6, a high-quality color image which is excellent in gradation characteristic and granularity in a color picture area and excellent in sharpness in a black letter area can be obtained. Especially, it is now clear that, if there is the relation between the flattening ratio of the color toners d/t and the flattening ratio of the K toner $d_K/t_K$ $$d/t=(2 \text{ to } 4)d_K/t_K,$$

even in the case where a black letter is present in an area where a color image and a black image are superposed, an extremely high-quality color image without noticeable image disturbance and scattering can be obtained.

Further, the inventors have practiced the following analyses (c) and (d) on the basis of the result of image evaluations shown in Table 18.

(c) Table 21 shows the relation between the color toner and the K toner shown in Table 18, with attention given to the equivalent circle diameter of the flattened toners used, and the result of the synthetic evaluation is shown with the results of evaluation 4 to 6 shown in Table 18 taken into account.

TABLE 21

| Test No. | Y, M, C toner Toner No. | d | K toner Toner No. | $d_k$ | Result of synthetic evaluation | Remarks |
|---|---|---|---|---|---|---|
| 260 | 6 | 4.0 | K6 | 4.0 | D | Comp. |
| 261 | 8 | 5.0 | K6 | 4.0 | A | Inv. |
| 262 | 11 | 6.8 | K6 | 4.0 | A | Inv. |
| 263 | 14 | 8.0 | K6 | 4.0 | B | Inv. |
| 264 | 6 | 4.0 | K8 | 5.0 | D | Comp. |
| 265 | 8 | 5.0 | K8 | 5.0 | C | Comp. |
| 266 | 11 | 6.8 | K8 | 5.0 | A | Inv. |
| 267 | 14 | 8.0 | K8 | 5.0 | A | Inv. |
| 268 | 16 | 6.0 | K16 | 6.0 | D | Comp. |
| 269 | 18 | 7.6 | K16 | 6.0 | A | Inv. |
| 270 | 19 | 9.5 | K16 | 6.0 | A | Inv. |
| 271 | 16 | 6.0 | K18 | 7.6 | D | Comp. |
| 272 | 18 | 7.6 | K18 | 7.6 | C | Comp. |
| 273 | 19 | 9.5 | K18 | 7.6 | A | Inv. |

Comp.: Comparative example
Inv.: Present invention
The unit of d or $d_k$ is $\mu$m.

It is clear from Table 21 that, owing to the relation $d_K<d$ between the equivalent circle diameter $d_K$ of the K toner and the equivalent circle diameter of the color toners d superposed in such a way that the K toner layer comes to the upper side on the image forming member in the color image forming apparatus shown in FIG. 6, a high-quality color image which is excellent in gradation characteristic and granularity in a color picture area and excellent in sharpness in a black letter area can be obtained. Especially, it is now clear that, if there is the relation between the equivalent circle diameter d of the color toners and the equivalent circle diameter $d_K$ of the K toner $$d=(1.2 \text{ to } 2.0)d_K,$$

even in the case where a black letter is present in an area where a color image and a black image are superposed, an extremely high-quality color image without noticeable image disturbance and scattering can be obtained.

(d) Table 22 shows the relation between the equivalent circle diameter d and thickness t of the color toners and the equivalent circle diameter $d_K$ and thickness $t_K$ of the K toner shown in Table 18, with attention given to the equivalent circle diameter and the thickness of the flattened toners used, and the result of the synthetic evaluation is shown through synthesizing the results of evaluation 4 to 6 shown in Table

18.

TABLE 22

| Test No. | Y, M, C toner Toner No. | d | t | K toner Toner No. | $d_k$ | $t_k$ | Result of synthetic evaluation | Remarks |
|---|---|---|---|---|---|---|---|---|
| 260 | 6 | 4.0 | 4.0 | K6 | 4.0 | 4.0 | D | Comp. |
| 261 | 8 | 5.0 | 2.5 | K6 | 4.0 | 4.0 | A | Inv. |
| 262 | 11 | 6.8 | 1.4 | K6 | 4.0 | 4.0 | A | Inv. |
| 263 | 14 | 8.0 | 1.0 | K6 | 4.0 | 4.0 | B | Inv. |
| 264 | 6 | 4.0 | 4.0 | K8 | 5.0 | 2.5 | D | Comp. |
| 265 | 8 | 5.0 | 2.5 | K8 | 5.0 | 2.5 | C | Comp. |
| 266 | 11 | 6.8 | 1.4 | K8 | 5.0 | 2.5 | A | Inv. |
| 267 | 14 | 8.0 | 1.0 | K8 | 5.0 | 2.5 | A | Inv. |
| 268 | 16 | 6.0 | 6.0 | K16 | 6.0 | 6.0 | D | Comp. |
| 269 | 18 | 7.6 | 3.8 | K16 | 6.0 | 6.0 | A | Inv. |
| 270 | 19 | 9.5 | 2.4 | K16 | 6.0 | 6.0 | A | Inv. |
| 271 | 16 | 6.0 | 6.0 | K18 | 7.6 | 3.8 | D | Comp. |
| 272 | 18 | 7.6 | 3.8 | K18 | 7.6 | 3.8 | C | Comp. |
| 273 | 19 | 9.5 | 2.4 | K18 | 7.6 | 3.8 | A | Inv. |

Comp.: Comparative example
Inv.: Present invention
Each unit of d, t, $d_k$ and $t_k$ is $\mu$m.

EXAMPLE 8

A maintenance operation was done for three units of the color image forming apparatus shown in FIG. 6; Y, M, C, and K developers in test numbers 262, 266, and 270 were loaded into the respective developing devices 13 of the three units of the color image forming apparatus, and preparation for the supply of toners was made; thus, running test of ten thousands copies was carried out.

The test was done with a full color original for test having both of letter images and picture images used, and image quality evaluation was made for the 500 copies near the end of ten thousands copies. As regards the image quality evaluation, it is based on the above-mentioned evaluation items 4 to 6, and the evaluation was done with attention given particularly to the gradation characteristic of the color images, the sharpness of the letter images, and the background smudging. All the results of evaluation were satisfactory, and it has become clear that by employing a color image forming method of present invention, formation of a high-quality image can be secured over a long period of time without the damage of the performance in cleaning and fixing caused by the used toners. Further, also it has become clear that the toner consumption amount has been reduced and saved by 30 to 50% as compared to the case where conventional spherical toners were used.

If present invention is used, in any one of the color image forming method in which a color toner image is formed on an image forming member through superposing the toner layers of a plurality of colors, and then said toner layers of the plurality of colors composing said color toner image are transferred all at a time onto a transfer material, the color image forming method in which toner images respectively composed of a plurality of color toners are formed on a plurality of image forming members respectively, and the toner images on said plurality of image forming members are successively transferred onto a transfer material to form a color toner image, and the color image forming method in which toner images respectively composed of a plurality of color toners are formed on a plurality of image forming members respectively, and the toner images on said plurality of image forming members are successively transferred onto an intermediate transfer member to form a color toner image, and then said toner images composing said color toner image are transferred all at a time onto a transfer material, an excellent effect that a high-quality image can be obtained with small amount of toner consumption, and the image quality of a full color image to be formed is excellent in sharpness in a letter image area without noticeable scattering and background smudging, and it is excellent in gradation characteristic with good granularity maintained in a picture image area.

What is claimed is:

1. A color image forming method for forming a color toner image, comprising the steps of:

forming toner images of three color toners of yellow, magenta, and cyan and a black toner; and superposing the toner images, thereby forming the color toner image, wherein each of said color toners is a flattened toner composed of particles each having an equivalent circle diameter d of 5 to 10 ($\mu$m) when viewed from a direction to make a projection area maximum, a thickness t of 1 to 4 ($\mu$m), and a flattening ratio d/t of 2 to 8 represented by a ratio of said equivalent circle diameter d to said thickness t, and wherein the flattening ratio d/t of the particles of each of said three color toners is larger than a flattening ratio $d_k/t_k$ of the particles of said black toner, where $d_k$ and $t_k$ represent an equivalent circle diameter and a thickness, respectively, of the particles of said black toner.

2. The color image forming method of claim 1, wherein the flattening ratio d/t of the particles of each of said three color toners is 2 to 4 times the flattening ratio $d_k/t_k$ of the particles of said black toner.

3. The color image forming method of claim 1, wherein the equivalent circle diameter d of the particles of each of said three color toners of yellow, magenta, and cyan is 1.2 to 2 times the equivalent circle diameter $d_k$ of the particles of said black toner.

4. The color image forming method of claim 3, wherein a shape of coefficient of each of said three color toners when viewed from a direction to make a projection area maximum, is 0.95 to 1.00, where the shape of coefficient=(a circumferential length of a circle obtained from an equivalent circle diameter)/(a circumferential length of a projection image of a particle).

5. The color image forming method of claim 3, wherein a maximum deposition quantity of each of toner layers of said three color toners of yellow, magenta, and cyan is smaller than a toner layer of said black toner.

6. The color image forming method of claim 1, further comprising concurrently transferring the color toner image formed on an image forming body onto a transfer material after superposing the toner images of the three color toners of yellow, magenta, and cyan and the black toner on the image forming body to form the color toner image.

7. The color image forming method of claim 6, wherein when the color toner image is formed on the image forming body, the superposing step is carried out so that the toner image of said black toner comes to an upper side of the toner images of said color toners.

8. The color image forming method of claim 6, wherein a shape of coefficient of each of said three color toners when viewed from a direction to make a projection area maximum, is 0.95 to 1.00, where the shape of coefficient=(a circumferential length of a circle obtained from an equivalent circle diameter)/(a circumferential length of a projection image of a particle).

9. The color image forming method of claim 6, wherein a maximum deposition quantity of each of toner layers of said three color toners of yellow, magenta, and cyan is smaller than a toner layer of said black toner.

10. The color image forming method of claim 1, wherein the superimposing step comprises sequentially transferring toner images formed on a plurality of image forming bodies onto a transfer material to form the color image after forming the toner images of the three color toners of yellow, magenta, and cyan and the black toner on the plurality of image forming bodies, respectively.

11. The color image forming method of claim 10, wherein when the toner images are sequentially transferred onto the transfer material to form the color toner image, the superposing step is carried out so that the toner image of said black toner comes to an upper side of the toner images of said color toners.

12. The color image forming method of claim 10, wherein a shape of coefficient of each of said three color toners when viewed from a direction to make a projection area maximum, is 0.95 to 1.00, where the shape of coefficient=(a circumferential length of a circle obtained from an equivalent circle diameter)/(a circumferential length of a projection image of a particle).

13. The color image forming method of claim 10, wherein a maximum deposition quantity of each of toner layers of said three color toners of yellow, magenta, and cyan is smaller than a toner layer of said black toner.

14. The color image forming method of claim 1, wherein the superposing step comprises sequentially transferring toner images formed on a plurality of image forming bodies onto an intermediate transfer material to form the color toner image after forming the toner images of the three color toners of yellow, magenta, and cyan and the black toner on the plurality of image forming bodies, respectively, and the color toner image forming method further comprising concurrently transferring the color toner image onto a transfer material after forming the toner images of the three color toners of yellow, magenta, and cyan and the black toner on the plurality of image forming bodies, respectively.

15. The color image forming method of claim 14, wherein when the toner images are sequentially transferred onto the intermediate transfer material to form the color image, the superposing step is carried out so that the toner image of said black toner comes to an upper side of the toner images of said color toners.

16. The color image forming method of claim 14, wherein a shape of coefficient of each of said three color toners when viewed from a direction to make a projection area maximum, is 0.95 to 1.00, where the shape of coefficient=(a circumferential length of a circle obtained from an equivalent circle diameter)/(a circumferential length of a projection image of a particle).

17. The color image forming method of claim 14, wherein a maximum deposition quantity of each of toner layers of said three color toners of yellow, magenta, and cyan is smaller than a toner layer of said black toner.

18. The color image forming method of claim 1, wherein the thickness t of the particles of each of said three color toners is smaller than the thickness $t_k$ of the particles of said black toner.

19. The color image forming method of claim 18, wherein the thickness t of particles of each of said three color toners is 0.25 to 0.7 times the thickness $t_k$ of the particles of said black toner.

20. The color image forming method of claim 18, wherein a shape of coefficient of each of said three color toners when viewed from a direction to make a projection area maximum, is 0.95 to 1.00, where the shape of coefficient=(a circumferential length of a circle obtained from an equivalent circle diameter)/(a circumferential length of a projection image of a particle).

21. The color image forming method of claim 18, wherein a maximum deposition quantity of each of toner layers of said three color toners of yellow, magenta, and cyan is smaller than a toner layer of said black toner.

* * * * *